US009620904B2

(12) United States Patent
Kao et al.

(10) Patent No.: US 9,620,904 B2
(45) Date of Patent: Apr. 11, 2017

(54) ELECTRICAL CONNECTOR ASSEMBLY

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 11 days.

(21) Appl. No.: 14/667,237

(22) Filed: Mar. 24, 2015

(65) Prior Publication Data

US 2015/0270646 A1 Sep. 24, 2015

(30) Foreign Application Priority Data

Mar. 24, 2014 (TW) ..... 103110941 A
Mar. 18, 2015 (TW) ..... 104108696 A

(51) Int. Cl.

| | |
|---|---|
| ***H01R 33/00*** | (2006.01) |
| ***H01R 13/6581*** | (2011.01) |
| ***H01R 13/52*** | (2006.01) |
| ***H01R 13/6461*** | (2011.01) |
| ***H01R 13/6582*** | (2011.01) |

(52) U.S. Cl.

CPC ..... *H01R 13/6581* (2013.01); *H01R 13/5202* (2013.01); *H01R 13/6461* (2013.01); *H01R 13/6582* (2013.01)

(58) Field of Classification Search

CPC ..... H01R 23/688; H01R 23/6873; H01R 13/65802

USPC ..... 439/660, 607.4, 607.9, 607.11, 607.01, 439/607.05, 607.13

See application file for complete search history.

(56) References Cited

U.S. PATENT DOCUMENTS

| | | | | |
|---|---|---|---|---|
| 6,997,733 | B2 * | 2/2006 | Peng | H01R 13/6582 439/353 |
| 7,841,886 | B2 * | 11/2010 | Klein | H01R 13/506 439/352 |
| 7,922,535 | B1 * | 4/2011 | Jiang | H01R 13/5205 439/271 |
| 8,221,163 | B2 * | 7/2012 | Kawakami | H01R 13/6593 439/607.13 |

(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

An electrical connector assembly includes an electrical receptacle connector and an electrical plug connector. The electrical receptacle connector includes a first insulation housing, upper-row plate terminals, and lower-row plate terminals. The first insulation housing includes a first base portion and a tongue portion extending from one side of the base portion. The upper-row plate terminals and the lower-row plate terminals are at an upper surface and a lower surface of the tongue portion, respectively. The electrical plug connector includes a second insulation housing, upper-row elastic terminals, and lower-row elastic terminals. The second insulation housing includes a second base portion, an upper member, a lower member, and a mating room between the upper member and the lower member for receiving the tongue portion. The upper-row elastic terminals and the lower-row elastic terminals are respectively above and below the mating room.

63 Claims, 49 Drawing Sheets

(56) References Cited

U.S. PATENT DOCUMENTS 8,262,411 B2 * 9/2012 Kondo ..... H01R 13/6658 439/607.01
8,506,317 B2 * 8/2013 Lim ..... H01R 9/032 439/345
8,562,378 B2 * 10/2013 Su ..... H01R 13/502 439/607.55
8,968,031 B2 * 3/2015 Simmel ..... H01R 13/659 439/108
9,077,096 B2 * 7/2015 Simmel ..... H01R 13/502
9,088,108 B2 * 7/2015 Zhao ..... H01R 13/6581
9,112,312 B2 * 8/2015 Katayanagi ..... H01R 13/6582
9,178,319 B2 * 11/2015 Little ..... H01R 13/6585
2006/0141843 A1 * 6/2006 Huang ..... H01R 13/6275 439/350
2006/0148300 A1 * 7/2006 Huang ..... H01R 13/6275 439/353
2011/0268396 A1 * 11/2011 He ..... G02B 6/3817 385/93
2012/0156938 A1 * 6/2012 Zhang ..... H01R 13/6461 439/660
2013/0115826 A1 * 5/2013 Sloey ..... H01R 13/405 439/690
2013/0183844 A1 * 7/2013 Wang ..... H01R 24/68 439/271
2014/0187086 A1 * 7/2014 Little ..... H01R 13/6585 439/607.34
2014/0187094 A1 * 7/2014 Zhao ..... H01R 13/6581 439/626
2014/0302709 A1 * 10/2014 Zhao ..... H01R 12/57 439/519
2014/0322953 A1 * 10/2014 Katayanagi ..... H01R 13/6582 439/353
2015/0194761 A1 * 7/2015 Xie ..... H01R 24/60 439/521
2015/0229068 A1 * 8/2015 Wang ..... H01R 24/60 439/271
2015/0333435 A1 * 11/2015 Arai ..... H01R 12/716 439/589

* cited by examiner

300

100

100

| | | | | | | | | | | | | | | | |
|---|---|---|---|---|---|---|---|---|---|---|---|---|---|---|---|
| GND | TX1+ | TX1− | VBUS | CC1 | D+ | D− | RFU | VBUS | RX2− | RX2+ | GND | 151 |
| GND | RX1+ | RX1− | VBUS | RFU | D− | D+ | CC2 | VBUS | TX2− | TX2+ | GND | 161 |

Fig. 10B

| | | | | | | | | | | | | | | | | | | | |
|---|---|---|---|---|---|---|---|---|---|---|---|---|---|---|---|---|---|---|---|
| GND | RX2+ | RX2− | VBUS | RFU | D− | D+ | CC1 | VBUS | TX1− | TX1+ | GND | 24 |
| GND | TX2+ | TX2− | VBUS | CC2 | D+ | D− | RFU | VBUS | RX1− | RX1+ | GND | 25 |

ELECTRICAL CONNECTOR ASSEMBLY

CROSS-REFERENCES TO RELATED APPLICATIONS

This non-provisional application claims priority under 35 U.S.C. §119(a) on Patent Application No. 103110941 and 104108696, filed in Taiwan, R.O.C. on 2014 Mar. 24 and 2015 Mar. 18, the entire contents of which are hereby incorporated by reference.

FIELD OF THE INVENTION

The instant disclosure relates to an electrical connector, and more particularly to an electrical connector assembly provided with an electrical receptacle connector and an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

A conventional USB electrical receptacle connector comprises plate transmission terminals and a USB electrical plug connector comprises elastic transmission terminals. When the conventional USB electrical receptacle connector with the conventional USB electrical plug connector in an improper orientation, the elastic transmission terminals or a tongue portion of the conventional USB electrical plug connector may be damaged or even broken, resulting in the disablement of the elastic transmission terminals or the tongue portion.

Furthermore, the surface of an iron shell of the conventional USB electrical receptacle connector or the surface of the conventional USB electrical plug connector is provided with a crack for firmly connection. However, these cracks would adversely influence the shielding effect of the iron shell to induce interferences (such as Electromagnetic Interference (EMI), Radio-Frequency Interference (RFI), and the like), with other signals during signal transmission. Therefore, a problem of serious crosstalk between the terminals of conventional connector is to be solved.

SUMMARY OF THE INVENTION

In view of the above-mentioned problems, the instant disclosure provides an electrical connector assembly comprising an electrical receptacle connector and an electrical plug connector to be inserted into the electrical receptacle connector.

The electrical receptacle connector comprises a first metal shell, a first insulation housing, a plurality of upper-row plate terminals, and a plurality of lower-row plate terminals, where the metal shell defines a receptacle cavity therein for receiving the first insulation housing. The first insulation housing comprises a first base portion and a tongue portion extending from one side of the first base portion. The tongue portion comprises a first upper surface and a first lower surface. The upper-row plate terminals are held on the first base portion and tongue portion. The upper-row plate terminals comprise a plurality of upper-row plate signal terminals, at least one upper-row plate signal terminal, and at least one upper-row plate ground terminal. The upper-row plate terminals are on the first upper surface for transmitting first signals. The lower-row plate terminals are held on the first base portion and tongue portion. The lower-row plate terminals comprise a plurality of lower-row plate signal terminals, at least one lower-row plate power terminals, and at least one lower-row plate ground terminals. The lower-row plate terminals are on the first lower surface for transmitting second signals. The specification for transmitting the first signals is conformed to the specification for transmitting the second signals. The upper-row plate terminals and the lower-row plate terminals are point-symmetrical with a central point of the receptacle cavity as the symmetrical center.

The electrical plug connector is provided to be plugged into the electrical receptacle connector. The electrical plug connector comprises a second metal shell, a second insulation housing, a plurality of upper-row elastic terminals, and a plurality of lower-row elastic terminals, where the metal shell defines a receiving cavity therein for receiving the first metal shell, the second insulation housing is received in the receiving cavity and comprises a second base portion, an upper member, a lower member, and a mating room. The upper member and the lower member are extending from one side of the second base portion. The mating room is between the upper member and the lower member. The upper-row elastic terminals are held on the second insulation housing. The upper-row elastic terminals comprise a plurality of upper-row elastic signal terminals, at least one upper-row elastic power terminal, and at least one upper-row elastic ground terminal. The upper-row elastic terminals are on a second lower surface of the upper member for transmitting the first signals. The lower-row elastic terminals are held on the second insulation housing. The lower-row elastic terminals comprise a plurality of lower-row elastic signal terminals, at least one lower-row elastic power terminal, and at least one lower-row elastic ground terminal. The lower-row elastic terminals are on a second upper surface of the lower member for transmitting the second signals. The specification for transmitting the first signals is conformed to the specification for transmitting the second signals. The upper-row elastic terminals and the lower-row elastic terminals are point-symmetrical with a central point of the receiving cavity as the symmetrical center.

The instant disclosure also provides an electrical connector assembly, wherein the electrical receptacle connector is devoid of the upper-row plate terminals or the lower-row plate terminals, and wherein when the electrical plug connector is inserted into the receptacle connector, the upper-row elastic terminals and the lower-row elastic terminals of the electrical plug connector are in contact with the upper-row plate terminals or the lower-row plate terminals of the electrical receptacle connector.

The instant disclosure further provides an electrical connector assembly, wherein the electrical plug connector is devoid of the upper-row elastic terminals or the lower-row elastic terminals, and wherein when the electrical plug connector is inserted into the receptacle connector, the upper-row plate terminals and the lower-row plate terminals of the electrical receptacle connector are in contact with the upper-row elastic terminals or the lower-row elastic terminals of the electrical plug connector.

In conclusion, since the upper-row plate terminals and the lower-row plate terminals are arranged upside down, and the pin assignment of the upper-row plate signal terminals is left-right reversal with respect to that of the lower-row plate signal terminals. Accordingly, when the electrical plug connector is inserted into the electrical receptacle connector by a first orientation where the upper plane of the electrical plug connector is facing up, the upper-row elastic terminals of the electrical plug connector are in contact with the upper-row plate signal terminals of the electrical receptacle connector. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals of the electrical receptacle connector. Consequently, the inserting orientation of the electrical plug connector is not limited when inserting into the electrical receptacle connector. Moreover, a plurality of hook structures is protruded at the two sides of the tongue portion. Therefore, when the electrical plug connector is inserted into the electrical receptacle connector, the elastic pins at two sides of the electrical plug connector would not wear against the two sides of the tongue portion. In addition, a first grounding sheet is configured to locate within the first insulation housing and between the upper-row plate contact segment and the lower-row plate contact segment, thus the crosstalk interference between the plate terminals can be improved by the first grounding sheet during signal transmission. In the other words, the first grounding sheet could be a shielding sheet. Furthermore, the structural strength of the tongue portion can be further enhanced.

Additionally, since the upper-row elastic terminals and the lower-row elastic terminals are arranged upside down, and the pin assignment of the upper-row elastic signal terminals is left-right reversal with respect to that of the lower-row elastic signal terminals. When the electrical plug connector is inserted into an electrical receptacle connector by a first orientation where an upper plane of the electrical plug connector is facing up, the upper-row elastic terminals of the electrical plug connector are in contact with upper-row plate signal terminals of the electrical receptacle connector. Conversely, when the electrical plug connector is inserted into the electrical receptacle connector by a second orientation where the upper plane of the electrical plug connector is facing down, the upper-row elastic terminals of the electrical plug connector are in contact with lower-row plate signal terminals of the electrical receptacle connector. Consequently, the inserting orientation of the electrical plug connector is not limited when inserting into an electrical receptacle connector. Besides, a plurality of clamping structures are extending and inserted into two sides of the mating room to be in contact with buckle elastic springs located at two sides of an electrical receptacle connector. Therefore, the clamping structures are connected to the metal shell for conduction and grounding. Furthermore, a grounding sheet is located on the insulation housing and between the upper-row elastic terminals and the lower-row elastic terminals, thus the crosstalk interference between the elastic terminals can be improved by the second grounding sheet during signal transmission. In other words, the grounding sheet could be a shielding sheet.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 10B is a schematic configuration diagram of the plate terminals of the electrical receptacle connector shown in FIG. 10A;

DETAILED DESCRIPTION

Figure 1:
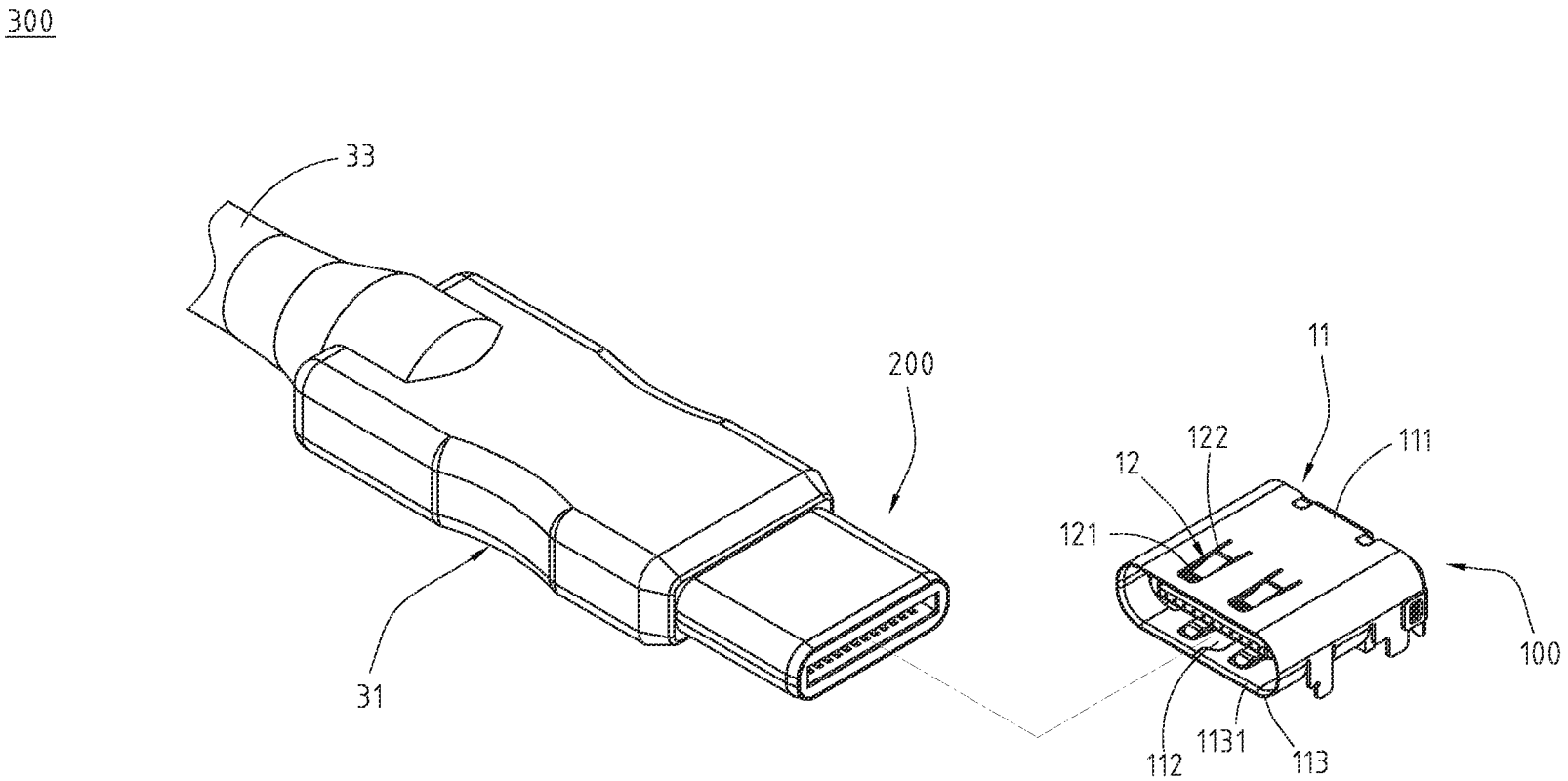
FIG. 1 illustrates an exploded view of an electrical connector assembly according to the instant disclosure, where the electrical connector assembly comprises an electrical plug connector and an electrical receptacle connector.
Figure 2:
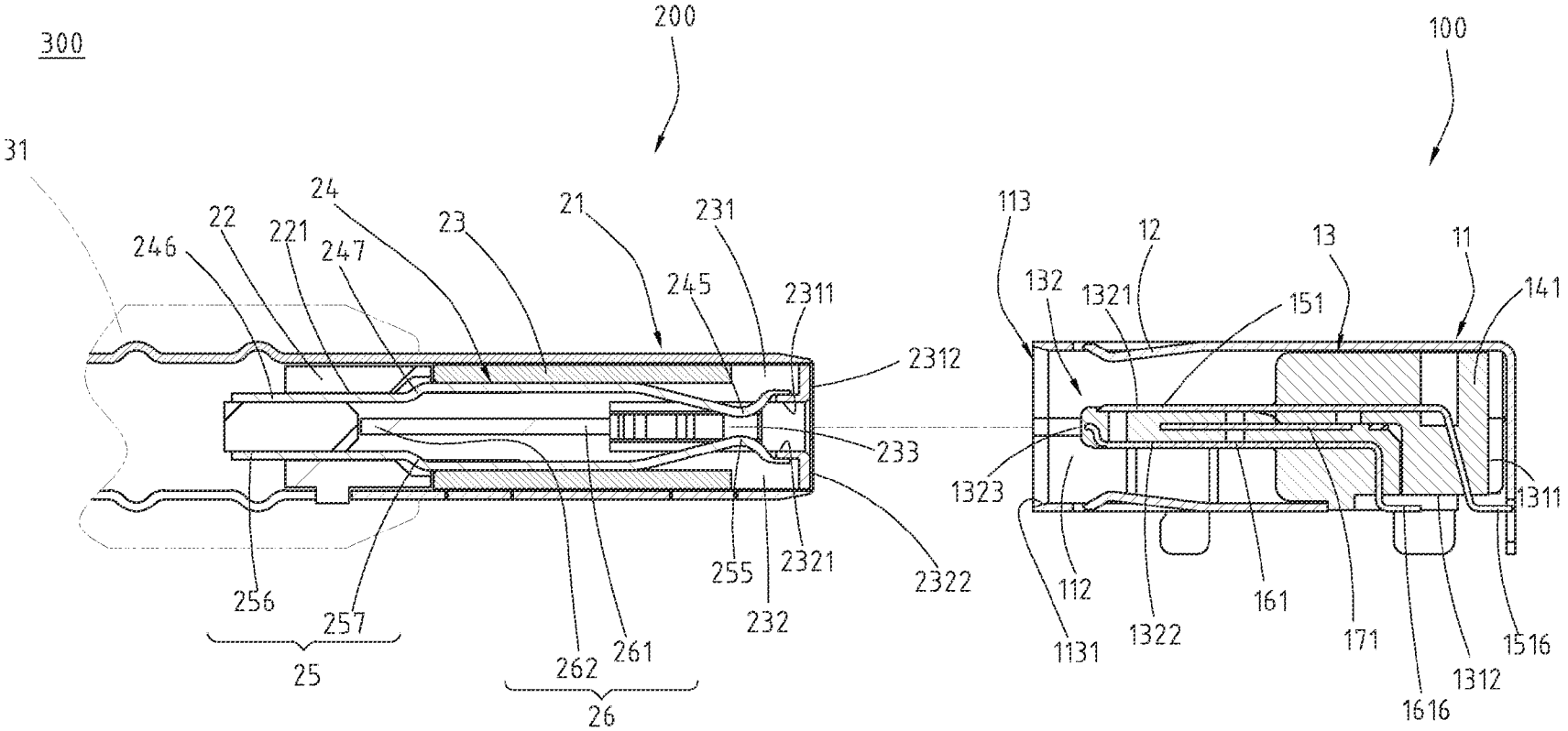
FIG. 2 illustrates a cross-sectional view of the electrical connector assembly according to the instant disclosure, where the electrical plug connector is detached from the electrical receptacle connector.
Figure 3:
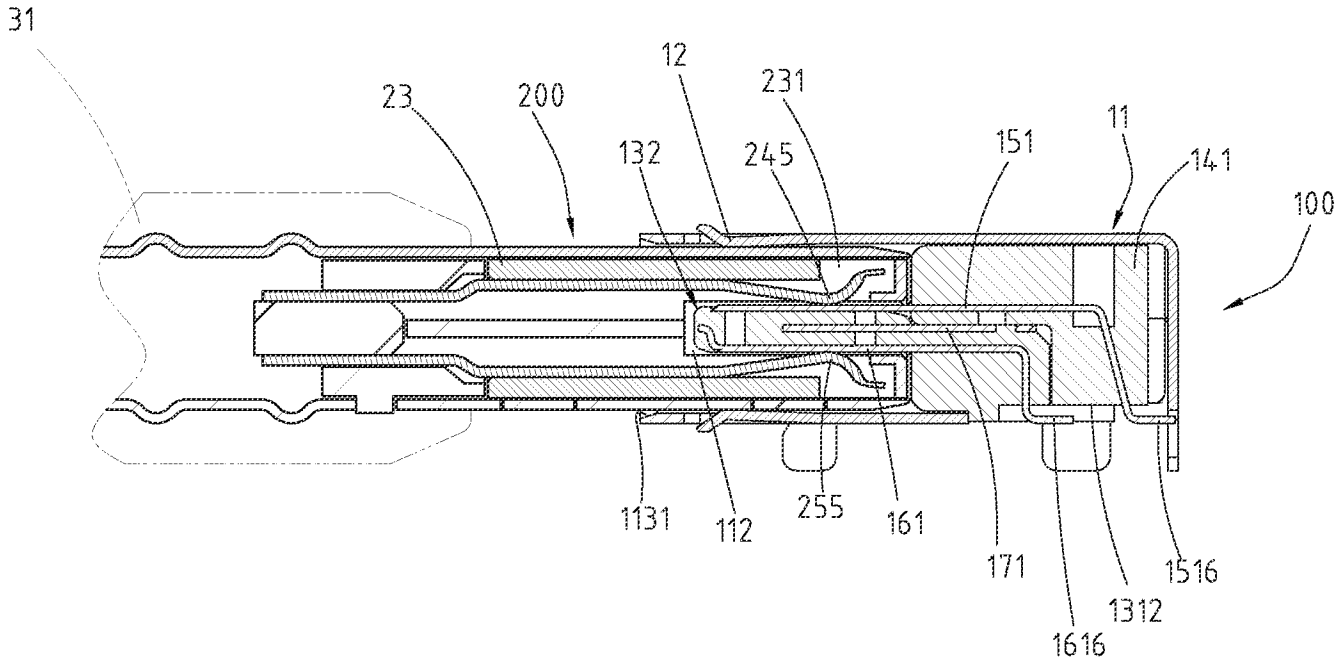
FIG. 3 illustrates a cross-sectional view of the electrical connector assembly according to the instant disclosure, where the electrical plug connector is inserted into the electrical receptacle connector.

Please refer to FIG. 1, FIG. 2, and FIG. 3, illustrating exemplary embodiments of an electrical connector assembly 300 according to the instant disclosure. The electrical connector assembly 300 according to the instant disclosure comprises an electrical receptacle connector 100 and an electrical plug connector 200.

Please refer to FIG. 8, FIG. 9, FIG. 10A and FIG. 10B, in which the electrical receptacle connector 100 is in accordance with the specification of a USB Type-C connection interface. In the embodiment, the electrical receptacle connector 100 comprises a first metal shell 11, a first insulation housing 13, a plurality of upper-row plate terminals 151, and a plurality of lower-row plate terminals 161.

Figure 8:
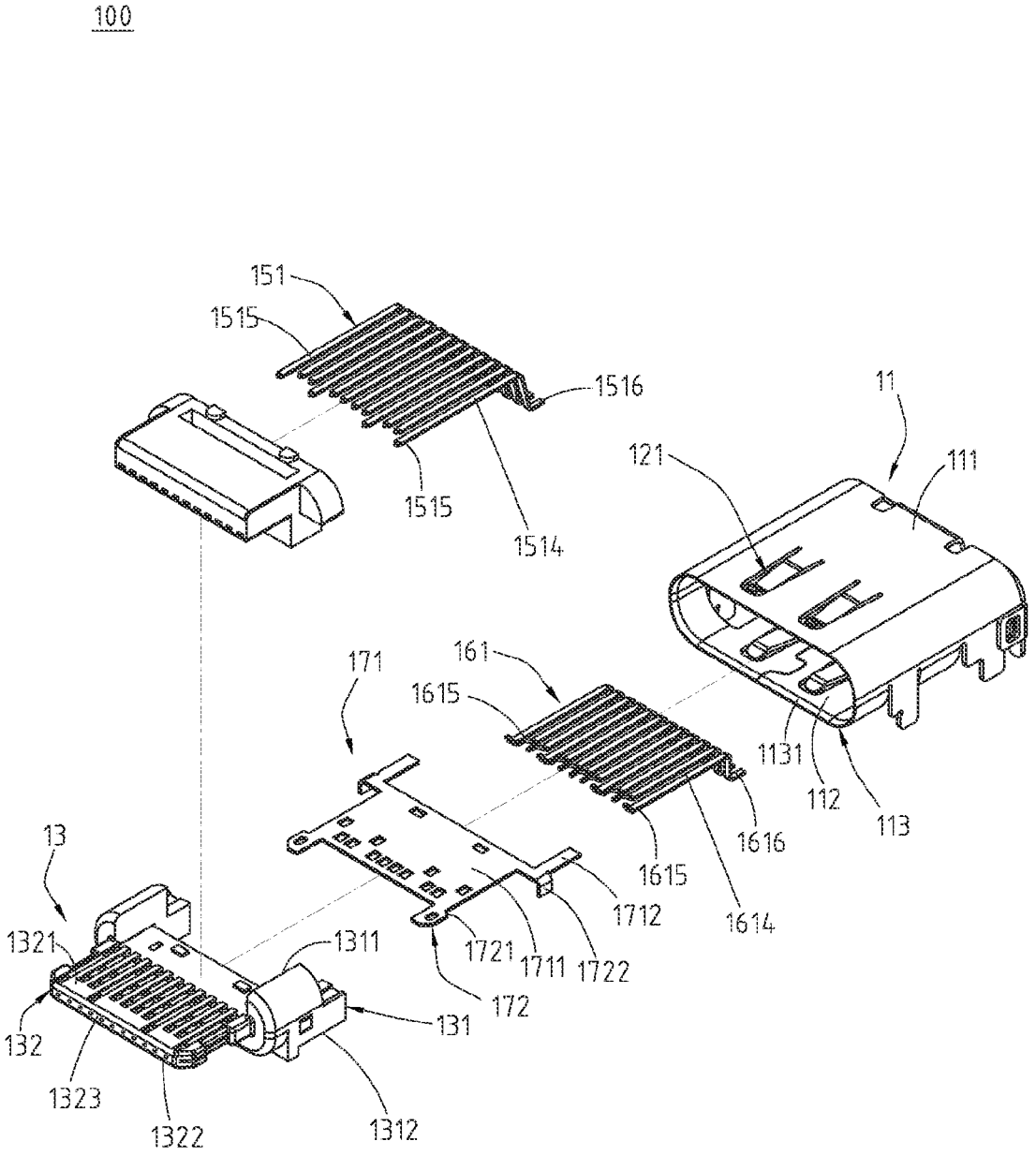
FIG. 8 illustrates an exploded view of the electrical receptacle connector of the electrical connector assembly according to the instant disclosure.
Figure 11:
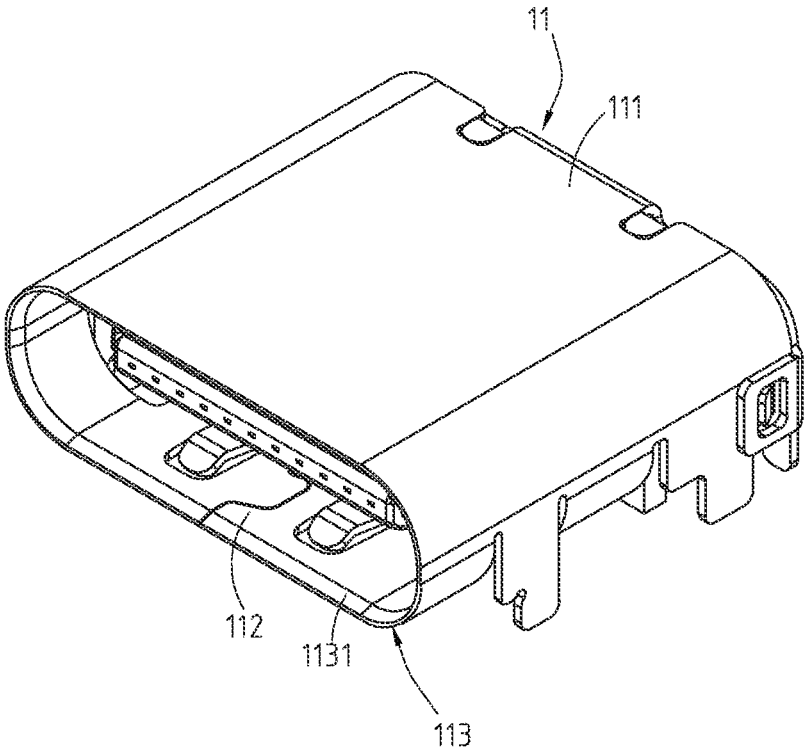
FIG. 11 illustrates a perspective view of a first metal shell of the electrical receptacle connector of the electrical connector assembly according to the instant disclosure.
Figure 12:
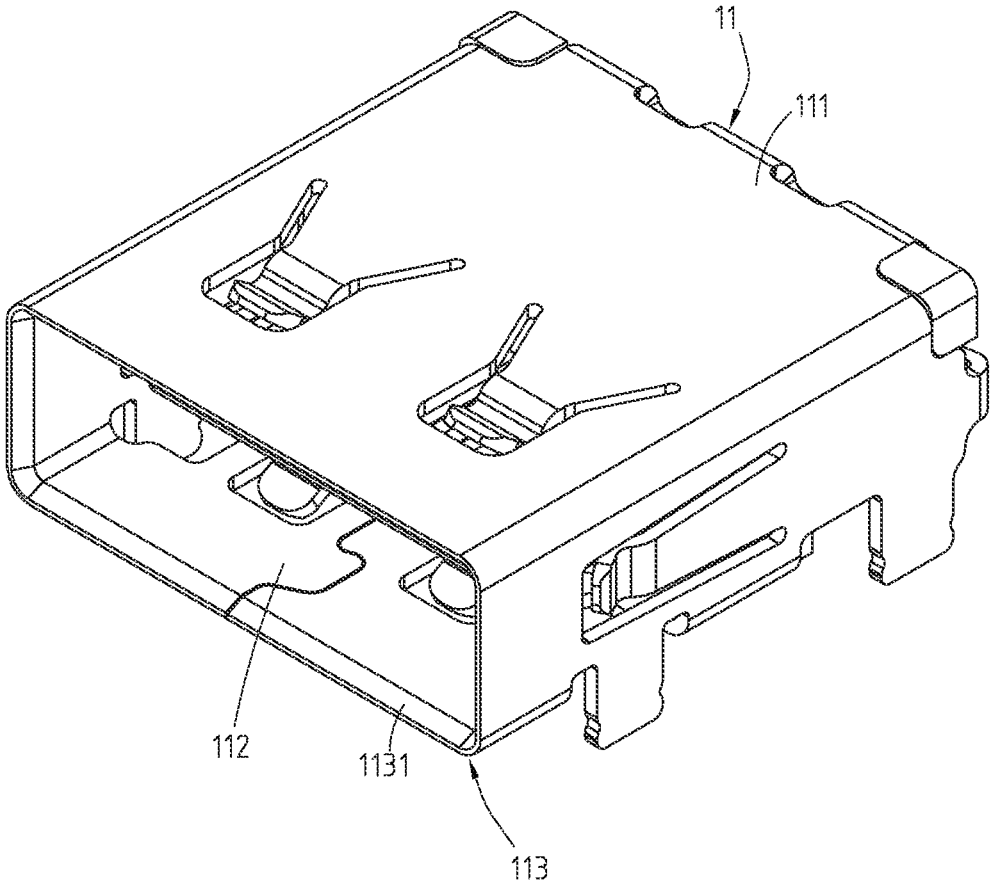
FIG. 12 illustrates a perspective view of a first metal shell of the electrical receptacle connector of the electrical connector assembly according to the instant disclosure, for one variation.
Figure 26:
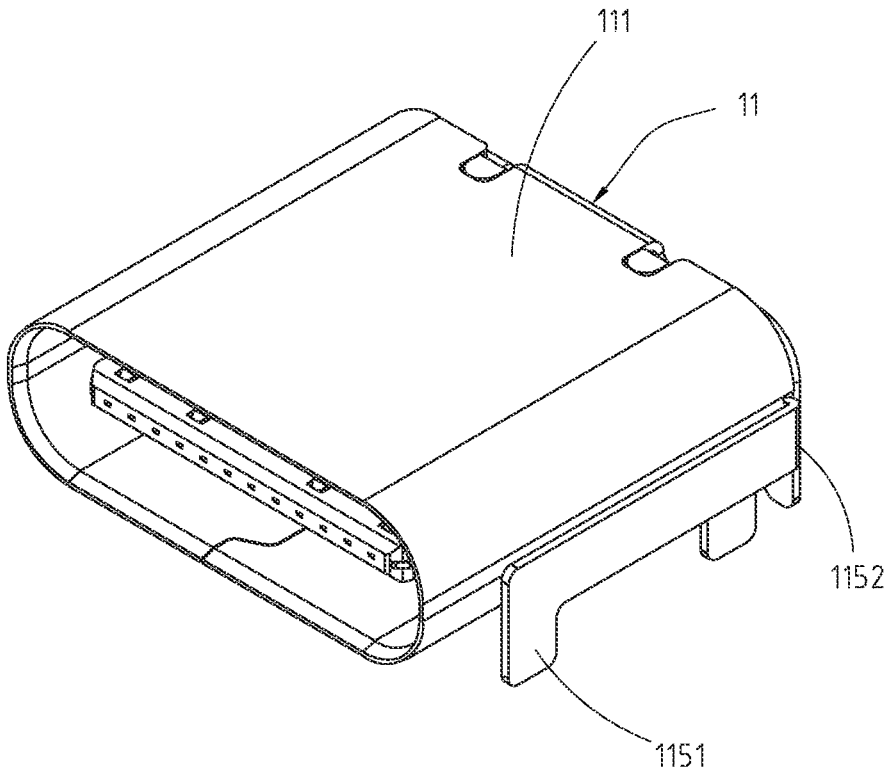
FIG. 26 illustrates a perspective view of the first metal shell of the electrical receptacle connector of the electrical connector assembly according to the instant disclosure, where the first metal shell is combined with a reversely-folded grounding piece.

The first metal shell 11 is a hollow shell and defines a receptacle cavity 112 therein. In the embodiment, the first metal shell 11 can be formed by bending a unitary structure. In addition, the first metal shell 11 may be provided with an elastic spring 12 and a crack 122 (as shown in FIG. 8). Alternatively, the first metal shell 11 may be devoid of the elastic spring 12 and the crack 122 (as shown in FIG. 11 and FIG. 26). An insertion opening 113, in oblong shaped, is formed on one side of the first metal shell 11 (as shown in FIG. 8). Alternatively, an insertion opening 113, in rectangular shaped, is formed on one side of the first metal shell 11 (as shown in FIG. 12). In addition, the insertion opening 113 communicates with the receptacle cavity 112.

Figure 9:
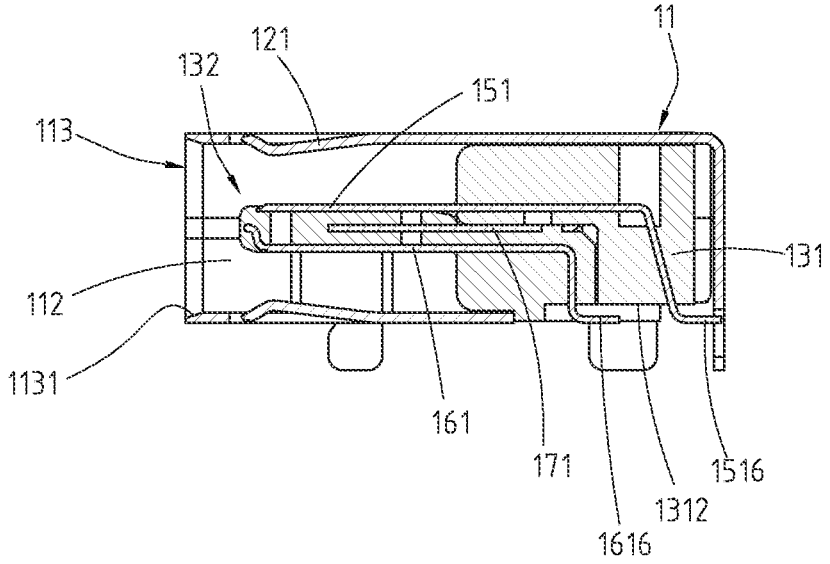
FIG. 9 illustrates a cross-sectional view of the electrical receptacle connector of the electrical connector assembly according to the instant disclosure.
Figure 10A:
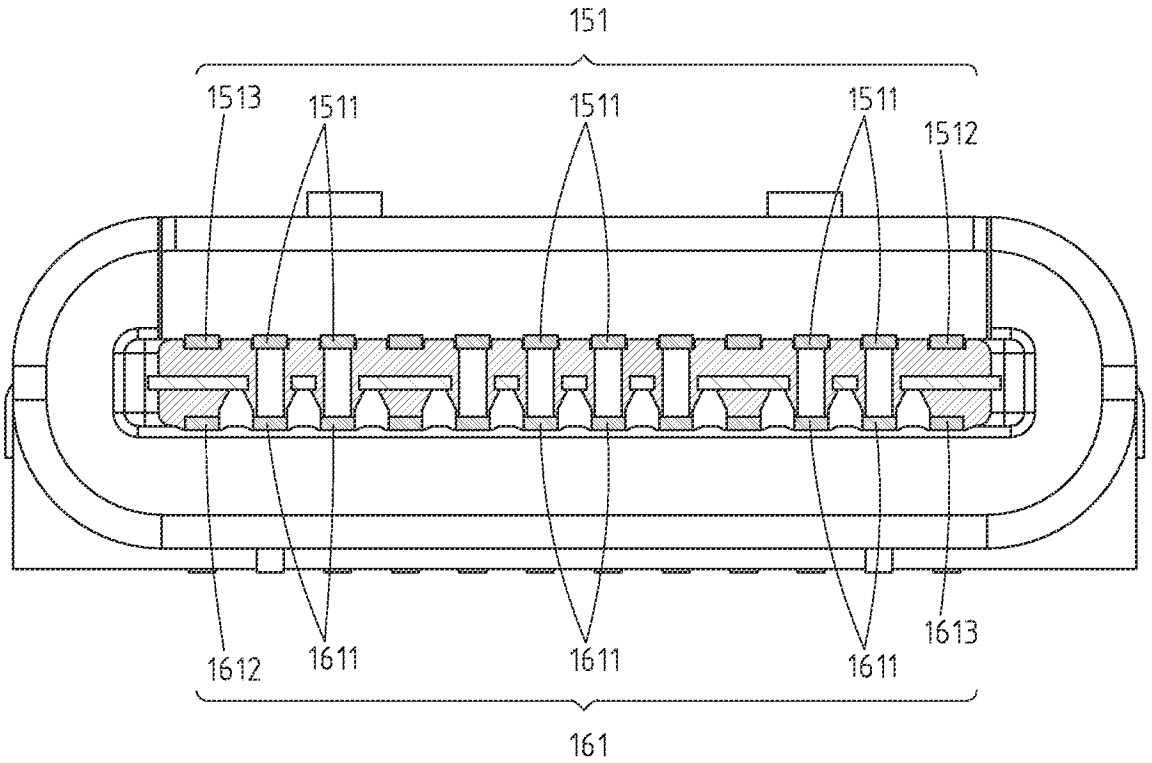
FIG. 10A illustrates a front sectional view of the electrical receptacle connector of the electrical connector assembly according to the instant disclosure.

Please refer to FIG. 8, FIG. 9 and FIG. 10A, in which the first insulation housing 13 is received in the receptacle cavity 112 and comprises a first base portion 131 and a tongue portion 132. Here, the first base portion 131 and the tongue portion 132 may be, but not limited to, formed by injection-molding technique. Furthermore, the tongue portion 132 is extending from one side of the first base portion 131. The tongue portion 132 has a first upper surface 1321, a second lower surface 1322 and a front lateral surface 1323.

Figure 18A:
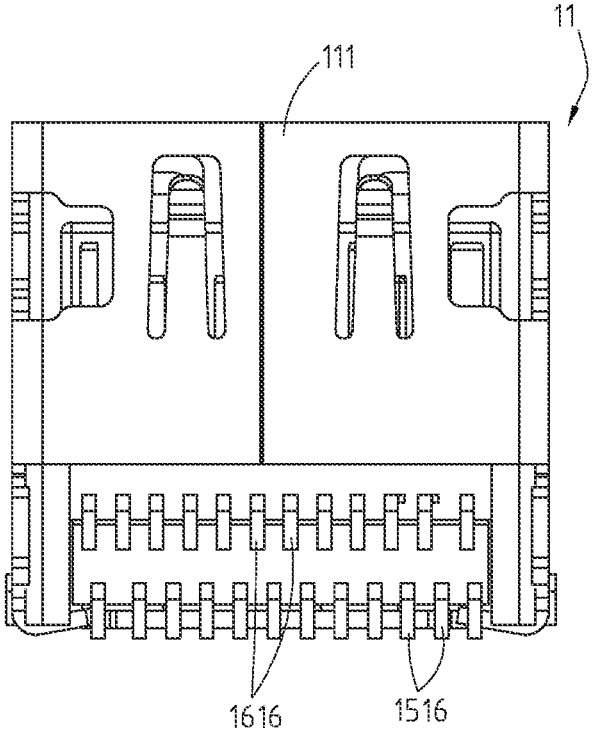
FIG. 18A is a top view illustrating that the upper-row plate terminals are offset with respect to the lower-row plate terminals of the electrical receptacle connector of the electrical connector assembly according to the instant disclosure.
Figure 18B:
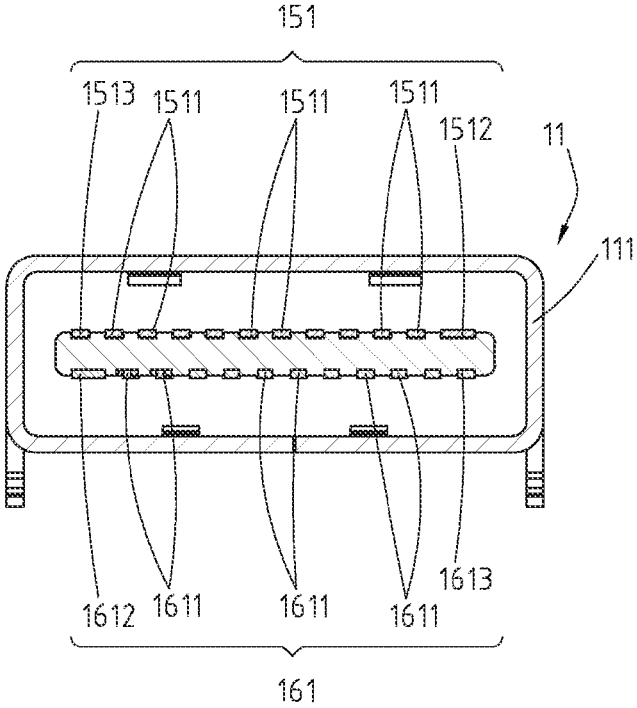
FIG. 18B is a front sectional view illustrating that the upper-row plate terminals are offset with respect to the lower-row plate terminals of the electrical receptacle connector of the electrical connector assembly according to the instant disclosure.
Figure 19:
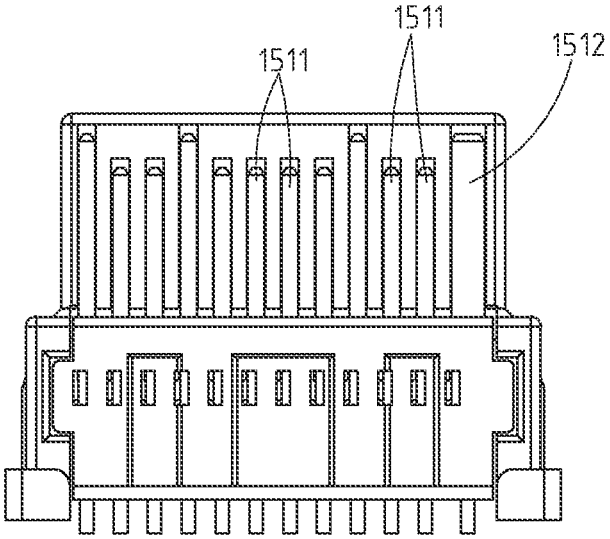
FIG. 19 is a top view illustrating an upper-row plate power terminal of the electrical receptacle connector of the electrical connector assembly according to the instant disclosure, for one variation.

Please refer to FIG. 10A and FIG. 10B, in which the upper-row plate terminals 151 comprise a plurality of upper-row plate signal terminals 1511, at least one upper-row plate power terminal 1512, and at least one upper-row plate ground terminal 1513. As shown in FIG. 10B, the upper-row plate terminals 1511 comprise, from left to right, an upper-row plate ground terminal 1513 (Gnd), a first pair of differential signal terminals (TX1+−), a second pair of differential signal terminals (D+−), and a third pair of differential signal terminals (RX2+−), of the upper-row plate signal terminals 1511, upper-row plate power terminals 1512 (Power/VBUS), between the three pairs of differential signal terminals, a retain terminal (RFU), (the retain terminal and a configuration channel 1 (CC1) are respectively arranged between the upper-row plate power terminals 1512 (Power/VBUS) and the second pair of differential signal terminals of the upper-row plate signal terminals 1511), and an upper-row plate ground terminal 1513 (Gnd) at the rightmost side. However, the pin assignment described herein is an example for illustrative purpose, but not a limitation. The electrical receptacle connector 100 described herein may comprise, but not limited to, twelve upper-row plate terminals 151 for transmitting USB 3.0 signals. In some embodiments, the rightmost (or leftmost) upper-row plate ground terminal 1513 (Gnd) and the retain terminal (RFU) can be omitted. Besides, the rightmost upper-row plate ground terminal 1513 (Gnd) may be replaced by an upper-row plate power terminal 1512 (Power/VBUS) for power transmission. Here, the width of the upper-row plate power terminal 1512 (Power/VBUS) may be, but not limited to, equal to the width of each of the upper-row plate signal terminals 1511 (as shown in FIG. 10A). In some embodiments, the width of the upper-row plate power terminal 1512 may be greater than the width of each of the upper-row plate signal terminals 1511 (as shown in FIG. 18B and FIG. 19). Accordingly, the electrical receptacle connector 100 can be applicable for an electronic product required for high current transmission.

Figure 13:
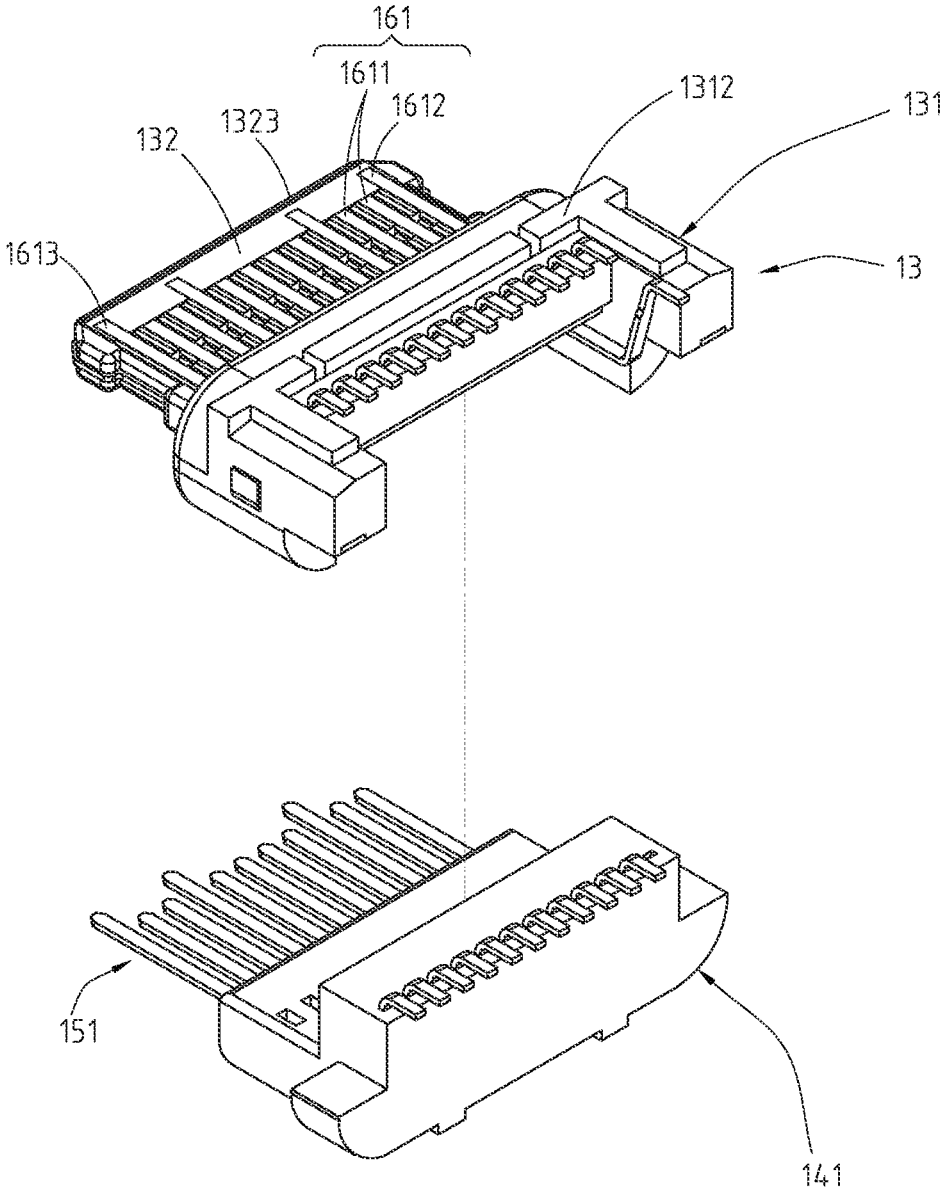
FIG. 13 illustrates an exploded view of a first insulation housing of the electrical receptacle connector of the electrical connector assembly according to the instant disclosure.

Please refer to FIG. 8 and FIG. 9, in which the upper-row plate terminals 151 are held on the first base portion 131 and the tongue portion 132. Each of the upper-row plate terminals 151 comprises an upper-row plate contact segment 1515, an upper-row plate connecting segment 1514, and an upper-row plate soldering segment 1516. For each upper-row plate terminal 151, the upper-row plate connecting segment 1514 is at the first base portion 131 and the tongue portion 132, the upper-row plate contact segment 1515 is extending from one of two ends of the upper-row plate connecting segment 1514 and on the first upper surface 1321, and the upper-row plate soldering segment 1516 is extending from the other end of the upper-row plate connecting segment 1514 and protruded out of the first base portion 131. The upper-row plate signal terminals 1511 are on the first upper surface 1321 for transmitting first signals (i.e., USB 3.0 signals). The upper-row plate soldering segments 1516 are protruded out of a bottom surface 1312 of the first base portion 131. Moreover, the upper-row plate soldering segments 1516 are horizontally aligned and provided as horizontal pins, i.e. SMT (surface mount technology) pins (as shown in FIG. 13).

Figure 15:
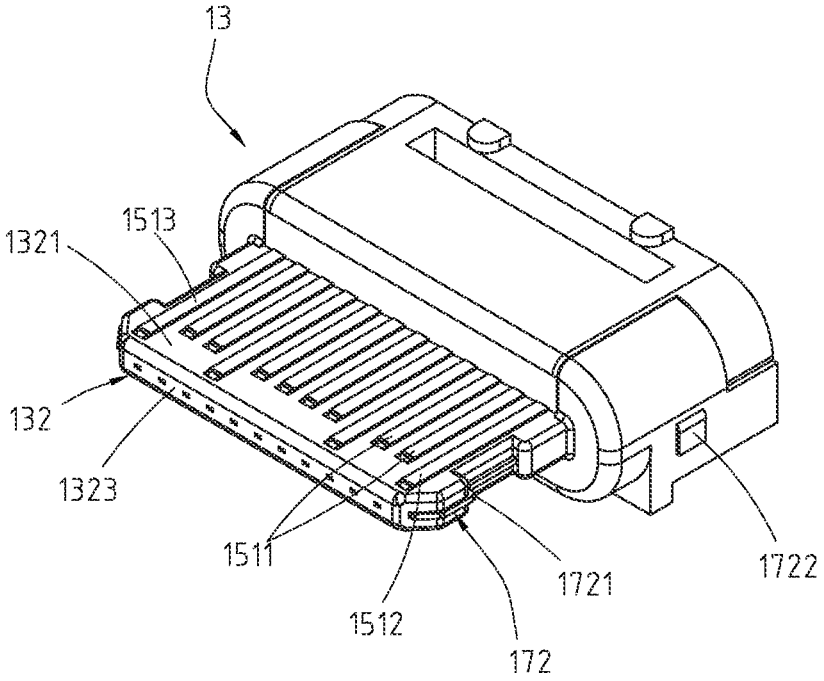
FIG. 15 illustrates a perspective view of the electrical receptacle connector of the electrical connector assembly according to the instant disclosure, where hook structures are combined to a tongue portion of the electrical receptacle connector.

Please refer to FIG. 8 and FIG. 15, in which embodiment the distance between the upper-row plate power terminal 1512 and the front lateral surface 1323 of the tongue portion 132 is less than the distance between each of the upper-row plate signal terminals 1511 and the front lateral surface 1323 of the tongue portion 132. In addition, the distance between the upper-row plate ground terminal 1513 and the front lateral surface 1323 of the tongue portion 132 is less than the distance between each of the upper-row plate signal terminals 1511 and the front lateral surface 1323 of the tongue portion 132. When the electrical plug connector 200 is plugged into the electrical receptacle connector 100, the upper-row plate power terminal 1512 or the upper-row plate ground terminal 1513 is preferentially in contact with one row of the upper-row elastic terminals 24 and the lower-row elastic terminals 25 of the electrical plug connector 200, and the upper-row plate signal terminals 1511 are then in contact with the row of the elastic terminals 24, 25 of the electrical plug connector 200. Accordingly, the electrical plug connector 200 is ensured to be completely plugged into the electrical receptacle connector 100 (i.e., to be plugged into the electrical receptacle connector 100 properly), before power or signal transmission. It should be understood that if the electrical plug connector 200 is not completely plugged into the electrical receptacle connector 100, arc burn may occur due to poor contact between the upper-row plate signal terminals 1511 and the elastic terminals 24, 25 of the electrical plug connector 200. Therefore, based on the upper-row plate terminals 151 with different lengths, the arc burn problem can be prevented.

Alternatively, in some embodiments, the upper-row plate terminals 151 may have an identical length. In other words, the distance between the upper-row plate power terminal 1512 and the front lateral surface 1323 of the tongue portion 132 is equal to the distance between each of the upper-row plate signal terminals 1511 and the front lateral surface 1323 of the tongue portion 132, and the distance between the upper-row plate ground terminal 1513 and the front lateral surface 1323 of the tongue portion 132 is equal to the distance between each of the upper-row plate signal terminals 1511 and the front lateral surface 1323 of the tongue portion 132.

Please refer to FIG. 10A and FIG. 10B, in which the lower-row plate terminals 161 comprise a plurality of lower-row plate signal terminals 1611, at least one lower-row plate power terminal 1612, and at least one lower-row plate ground terminals 1613. As shown in FIG. 10B, the lower-row plate terminals 161 comprise, from right to left, a lower-row plate ground terminal 1613 (Gnd), a first pair of differential signal terminals (TX2+−), a second pair of differential signal terminals (D+−), and a third pair of differential signal terminals (RX1+−), of the lower-row plate signal terminals 1611, lower-row plate power terminals 1612 (Power/VBUS), between the three pairs of differential signal terminals, a retain terminal (RFU), (the retain terminal and a configuration channel 2 (CC2) are respectively arranged between the lower-row plate power terminals 1612 (Power/VBUS) and the second pair of differential signal terminals of the lower-row plate signal terminal 1511), and a lower-row plate ground terminal 1613 (Gnd) at the leftmost side. However, the pin assignment described herein is an example for illustrative purpose, but not a limitation. The electrical receptacle connector 100 described herein may comprise, but not limited to, twelve lower-row plate terminals 161 for transmitting the USB 3.0 signals. In some embodiments, the rightmost (or leftmost) lower-row plate ground terminal 1613 (Gnd) and the retain terminal (RFU) can be omitted. Besides, the leftmost lower-row plate ground terminal 1613 (Gnd) may be replaced by a lower-row plate power terminal 1612 (Power/VBUS) for power transmission. Here, the width of the lower-row plate power terminal 1612 (Power/VBUS) may be, but not limited to, equal to the width of each of the lower-row plate signal terminals (as shown in FIG. 10A). In some embodiments, the width of the lower-row plate power terminal 1612 may be greater than the width of each of the lower-row plate signal terminals 1611 (as shown in FIG. 18B and FIG. 19). Accordingly, the electrical receptacle connector 100 is applicable for an electronic product required for high current transmission.

Figure 16:
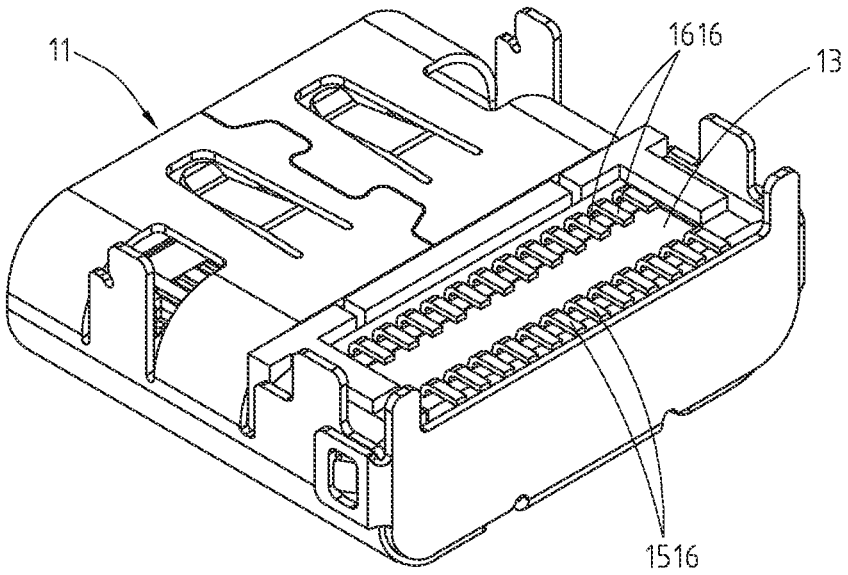
FIG. 16 is a perspective view illustrating a bottom surface of the electrical receptacle connector of the electrical connector assembly according to the instant disclosure.
Figure 17:
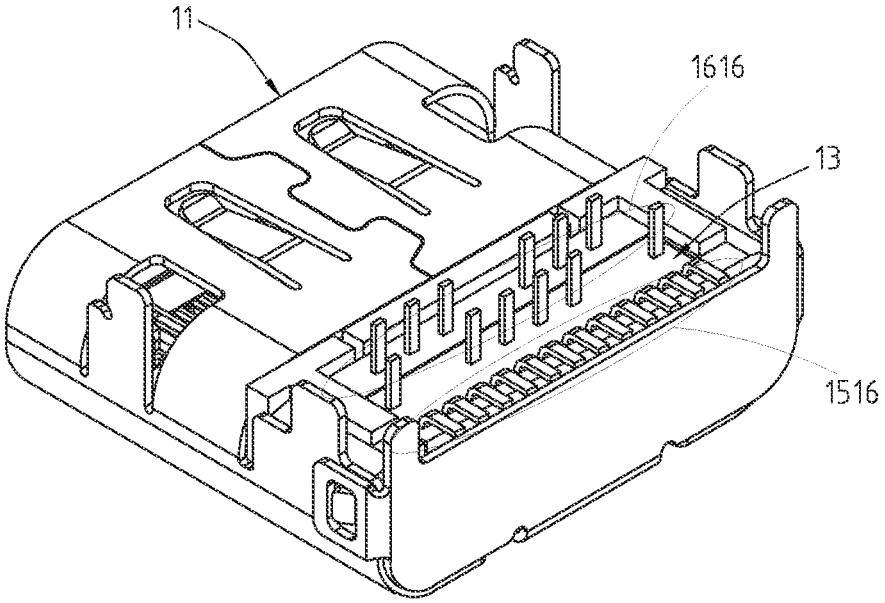
FIG. 17 is a perspective view illustrating a bottom surface of the electrical receptacle connector or the electrical connector assembly according to the instant disclosure, for one variation.

Please refer to FIG. 8 and FIG. 9, in which the lower-row plate terminals 161 are held on the first base portion 131 and the tongue portion 132. Each of the lower-row plate terminals 161 comprises a lower-row plate contact segment 1615, a lower-row plate connecting segment 1614, and a lower-row plate soldering segment 1616. For each lower-row plate terminal 161, the lower-row plate connecting segment 1614 is at the first base portion 131 and the tongue portion 132, the lower-row plate contact segment 1615 is extending from one of two ends of the lower-row plate connecting segment 1614 and on the first lower surface 1322, and the lower-row plate soldering segment 1616 is extending from the other end of the lower-row plate connecting segment 1614 and protruded out of the first base portion 131. The lower-row plate signal terminals 1611 are on the first lower surface 1322 for transmitting second signals (i.e., USB 3.0 signals). The lower-row plate soldering segments 1616 are protruded out of the bottom surface 1312 of the first base portion 131. Moreover, the lower-row plate soldering segments 1616 are horizontally aligned and provided as horizontal pins, i.e. SMT pins (as shown in FIG. 16). Alternatively, the lower-row plate soldering segments 1616 may be extended vertically and provided as vertical pins (as shown in FIG. 17).

Please refer back to FIG. 8, FIG. 9, FIG. 10A and FIG. 10B, in which embodiment the upper-row plate terminals 151 and the lower-row plate terminals 161 are respectively on the first upper surface 1321 and the lower surface 1322 of the tongue portion 132. Additionally, pin assignment of the upper-row plate terminals 161 and the lower-row plate terminals 161 are point-symmetrical with a central point of the receptacle cavity 112 as the symmetrical center. Here, point-symmetry means that after the upper-row plate terminals 151 (or the lower-row plate terminals 161), are rotated by 180 degrees with the symmetrical center as the rotating center, the upper-row plate terminals 151 and the lower-row plate terminals 161 are overlapped. That is, the rotated upper-row plate terminals 151 are arranged at the position of the original lower-row plate terminals 161, and the rotated lower-row plate terminals 161 are arranged at the position of the original upper-row plate terminals 151. In other words, the upper-row plate terminals 151 and the lower-row plate terminals 161 are arranged upside down, and the pin assignment of the upper-row plate terminals 151 are left-right reversal with respect to the pin assignment of the lower-row plate terminals 161. Accordingly the electrical plug connector 200 is inserted into the electrical receptacle connector 100 with a first orientation where the upper plane of the electrical plug connector 200 is facing up for transmitting first signals. Conversely, the electrical plug connector 200 is inserted into the electrical receptacle connector 100 with a second orientation where the lower plane of the electrical plug connector 200 is facing up for transmitting second signals. Besides, the specification for transmitting the first signals is conformed to the specification for transmitting the second signals. Note that, the inserting orientation of the electrical plug connector 200 is not limited by the electrical receptacle connector 100.

Please refer to FIG. 8, FIG. 9, FIG. 10A, and FIG. 10B, in which embodiment the position of the upper-row plate terminal 151 corresponds to the position of the lower-row plate terminals 161, as shown in FIG. 10A. In other words, in the embodiment, the upper-row plate contact segments 1515 are aligned to the lower-row plate contact segments 1615, one by one, but embodiments are not thus limited. In some embodiments, the upper-row plate contact segments 1515 are aligned parallel to the lower-row plate contact segments 1615, and the upper-row plate contact segments 1515 are offset with respect to the lower-row plate contact segments 1615 (as shown in FIG. 18B). Similarly, the upper-row plate soldering segments 1516 may be aligned with the lower-row plate soldering segments 1616, one by one. Alternatively, the upper-row plate soldering segments 1516 may be offset with respect to the lower-row plate soldering segments 1616 (as shown in FIG. 18A). Therefore, crosstalk interference between the plate terminals 151, 161 can be effectively improved with the offset configuration between the plate contact segments 1515, 1615 during signal transmission. Particularly, regarding the upper-row plate terminals 151 and the lower-row plate terminals 161 are configured with an offset, the elastic terminals 24, 25 of the electrical plug connector 200 would have to be configured correspondingly (i.e., the upper-row elastic terminals 24 and the lower-row elastic terminals 25 of the electrical plug connector 200 are configured with an offset). Thus, the upper-row elastic terminals 24 and the lower-row elastic terminals 25 of the electrical plug connector 200 can be correspondingly in contact with the upper-row plate terminals 151 and the lower-row plate terminals 161 for power or signal transmission.

Please refer to FIG. 9 and FIG. 13, in which embodiment, the distance between the lower-row plate power terminal 1612 and the front lateral surface 1323 of the tongue portion 132 is less than the distance between each of the lower-row plate signal terminals 1611 and the front lateral surface 1323 of the tongue portion 132. In addition, the distance between the lower-row plate ground terminal 1613 and the front lateral surface 1323 of the tongue portion 132 is less than the distance between each of the lower-row plate signal terminals 1611 and the front lateral surface 1323 of the tongue portion 132. When the electrical plug connector 200 is plugged into the electrical receptacle connector 100, the lower-row plate power terminal 1612 or the lower-row plate ground terminal 1613 is preferentially in contact with one row of the upper-row elastic terminals 24 and the lower-row elastic terminals 25 of the electrical plug connector 200, and the lower-row plate signal terminals 1611 are then in contact with the row of the elastic terminals 24, 25 of the electrical plug connector 200. Accordingly, the electrical plug connector 200 is ensured to be completely plugged into the electrical receptacle connector 100 (i.e., to be plugged into the electrical receptacle connector 100 properly), before power or signal transmission. It should be understood that if the electrical plug connector 200 is not completely plugged into the electrical receptacle connector 100, arc burn may occur due to poor contact between the lower-row plate signal terminals 1611 and the elastic terminals 24, 25 of the electrical plug connector 200. Therefore, based on the lower-row plate terminals 161 with different lengths, the arc burn problem can be prevented.

Alternatively, in some embodiments, the lower-row plate terminals 161 may have an identical length. In other words, the distance between the lower-row plate power terminal 1612 and the front lateral surface 1323 of the tongue portion 132 is equal to the distance between each of the lower-row plate signal terminals 1611 and the front lateral surface 1323 of the tongue portion 132, and the distance between the lower-row plate ground terminal 1613 and the front lateral surface 1323 of the tongue portion 132 is equal to the distance between each of the lower-row plate signal terminals 1611 and the front lateral surface 1323 of the tongue portion 132.

Please refer to FIG. 9 and FIG. 16, in which embodiment the upper-row plate soldering segments 1516 and the lower-row plate soldering segments 1616 are protruded out of the first base portion 131 to be arranged separately. The upper-row plate soldering segments 1516 and the lower-row plate soldering segments 1616 may be, but not limited to, arranged into two parallel lines, one by one. Alternatively, the lower-row plate soldering segments 1616 may be arranged into two lines, where the first line and the second line of the lower-row plate soldering segments 1616 does not completely correspond to each other (as shown in FIG. 17), and the two lines are further accompany with a single row of the upper-row plate soldering segments 1516 to form three rows.

In the above embodiments, the upper-row plate terminals 151 and the lower-row plate terminals 161 may be, but not limited to, provided for transmitting the USB 3.0 signals, individually. In some embodiments, for the upper-row plate terminals 151, the first pair of differential signal terminals (TX1+−) and the third pair of differential signal terminals (RX2+−) of the upper-row plate signal terminals 1511 can be omitted, and the second pair of differential signal terminals (D+−) and the upper-row plate power terminals 1512 (Power/VBUS) are retained, when transmitting USB 2.0 signals. For the lower-row plate terminals 161, the first pair of differential signal terminals (TX2+−) and the third pair of differential signal terminals (RX1+−) of the lower-row plate signal terminals 1611 can be omitted, and the second pair of differential signal terminals (D+−) and the lower-row plate power terminals 1612 (Power/VBUS) are retained, when transmitting the USB 2.0 signals.

Figure 14:
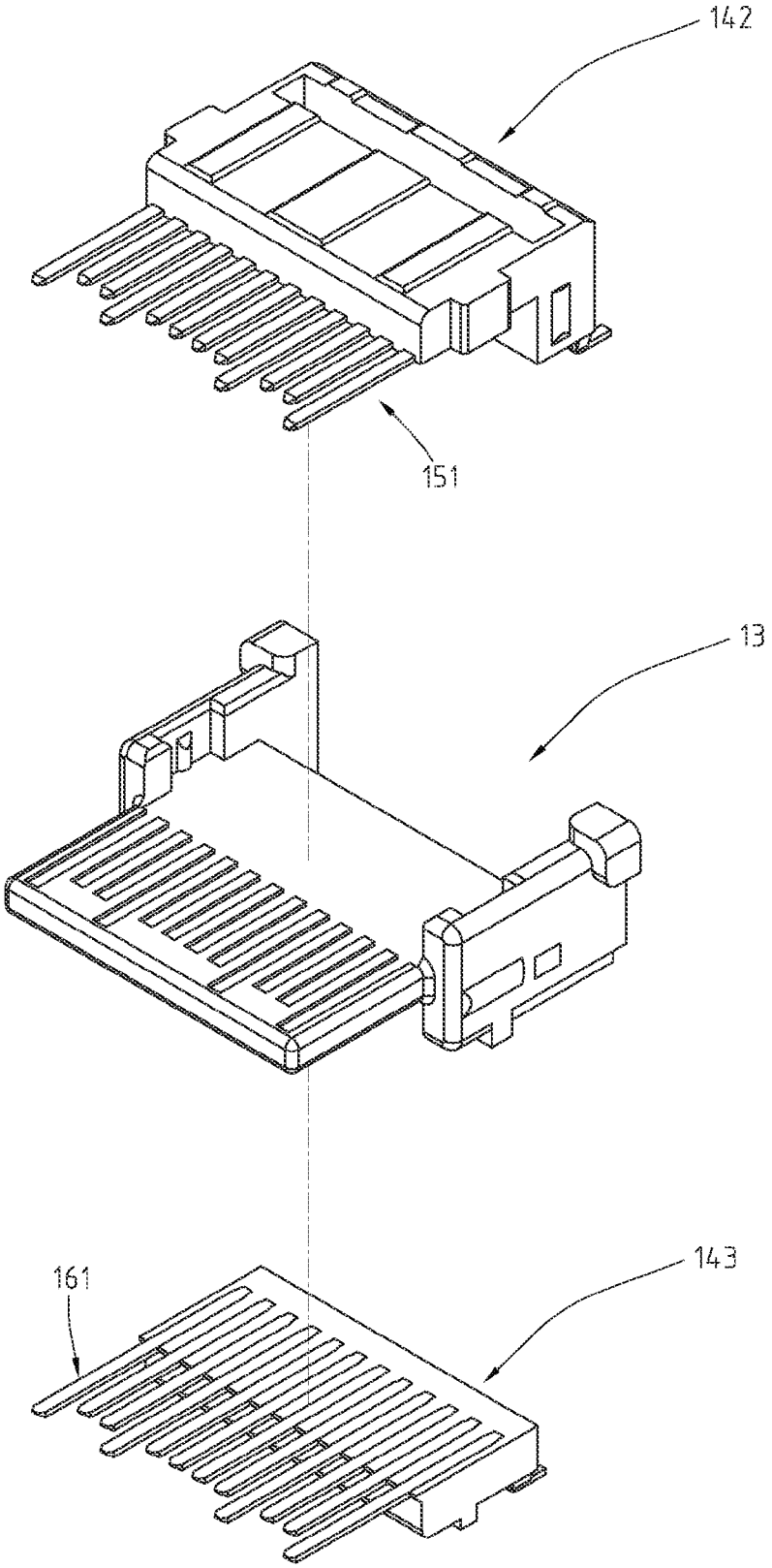
FIG. 14 illustrates an exploded view of a first insulation housing of the electrical receptacle connector according to the instant disclosure, for one variation.

Please refer to FIG. 13. In some embodiments, the first insulation housing 13 can be formed by a two-piece structure. Here, the first insulation housing 13 further comprises a first mount 141. The first mount 141 is combined with the upper-row plate terminals 151 during insert-molding, the first base portion 131 is combined with the lower-row plate terminals 161 during insert-molding, and then the first mount 141 is fixed on the first base portion 131, but embodiments are not limited thereto. In some embodiments, the first insulation housing 13 may be formed by a three-piece structure (as shown in FIG. 14). Here, the first insulation housing 13 may comprise a second mount 142 and a third mount 143. The second mount 142 is combined with the upper-row plate terminals 151 during insert-molding and then the second mount 142 is further combined with a top surface 1311 of the first base portion 131. The third mount 143 is combined with the lower-row plate terminals 161 during insert-molding, and then the third mount 143 is combined with a bottom surface 1312 of the first base portion 131.

Please refer to FIG. 8 and FIG. 9 In some embodiments, the electrical receptacle connector 100 is further provided with a first grounding sheet 171 located within the first insulation housing 13. The first grounding sheet 171 comprises a first body portion 1711 and a plurality of first pins 1712. The first body portion 1711 is arranged between the upper-row plate contact segments 1515 and the lower-row plate contact segments 1615. In other words, the first body portion 1711 is formed between the first base portion 131 and the tongue portion 132 and located between the upper-row plate contact segments 1515 and the lower-row plate contact segments 1615. In addition, the first pins 1712 may be, but not limited to, extending from two sides of the rear part of the first body portion 1711, protruded backward, and aligned horizontally. Alternatively, the first pins 1712 may be exposed out of the rear part of the first base portion 131 to be in contact with the first metal shell 11 or a circuit board 31. Accordingly, the crosstalk interference between the plate terminals 151, 161 can be improved due to the first grounding sheet 171 between the upper-row plate contact segments 1515 and the lower-row plate contact segments 1615 during signal transmission. Besides, the structural strength of the tongue portion 132 can be improved with the configuration of the first grounding sheet 171 on the tongue portion 132.

Figure 28:
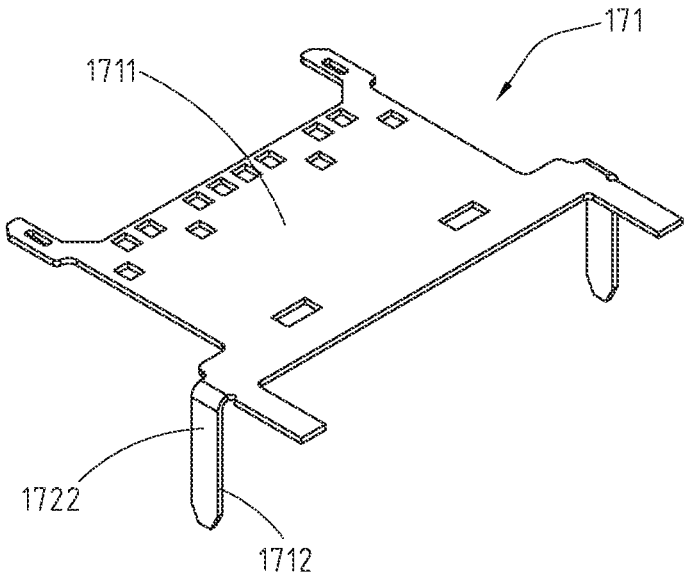
FIG. 28 illustrates a perspective view of a grounding sheet of the electrical receptacle connector of the electrical connector assembly according to the instant disclosure.
Figure 29:
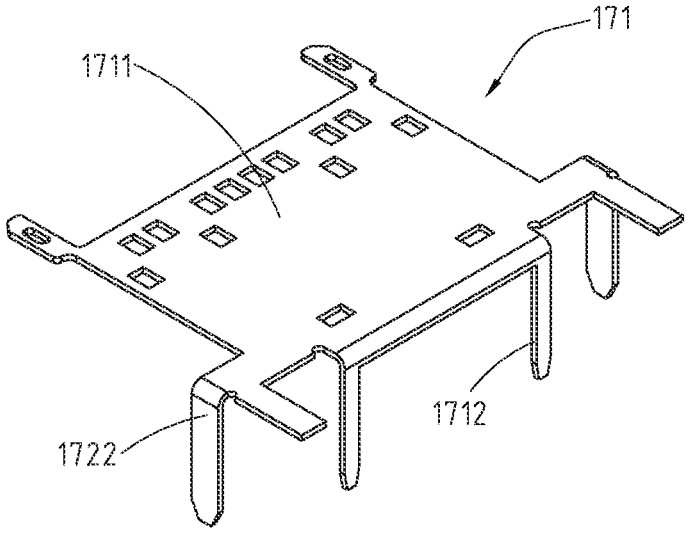
FIG. 29 illustrates a perspective view of a grounding sheet of the electrical receptacle connector of the electrical connector assembly according to the instant disclosure, for one variation.

Additionally, of the first pins 1712 may be located at the two sides of the first body portion 1711 and extending downward and vertically to be vertical pins (as shown in FIG. 28). Therefore, of the first pins 1712 are exposed out of the two sides of the first base portion 131 and in contact with the circuit board 32, and the outer surfaces of the first pins 1712 are in contact with the inner wall of the first metal shell 11 by laser soldering or common soldering. Alternatively, in some embodiments, of the first pins 1712 may be located at the rear part of the first body portion 1711 and extending downward and vertically to be vertical pins (as shown in FIG. 29). Therefore, the first pins 1712 are exposed out of the rear part of the first base portion 131 and in contact with the circuit board 32.

Please refer to FIG. 8 and FIG. 15. In some embodiments, the electrical receptacle connector 100 is further provided with a plurality of hook structures 172 located at the two sides of the first insulation housing 13. The hook structures 172 and the first grounding sheet 171 may be formed as a unitary structure, or the hook structures 172 and the first grounding sheet 171 may be formed separately. Each of the hook structures 172 comprises a projecting engaging portion 1721 and a projecting abutting portion 1722. The projecting engaging portions 1721 are extending from two sides of the front part of the first body portion 1711 and protruded from the two sides of the tongue portion 132. The projecting abutting portions 1722 are extending from the two sides of the rear part of the first body portion 1711 and protruded from the two sides of first base portion 131 to be in contact with the first metal shell 11. Specifically, the projecting abutting portions 1722 and the first pins 1712 may be integrated respectively, so that each projecting abutting portion 1722 and each corresponding first pin 1712 are formed as an extending leg, as shown in FIG. 28. The extending legs are located at the two sides of the first body portion 1711 with the outer surfaces of the extending legs being in contact with the inner wall of the first metal shell 11 by laser soldering or common soldering technique. Accordingly, when the electrical plug connector 200 is plugged into the electrical receptacle connector 100, the projecting engaging portions 1721 can be buckled with the clamping structures 27 located at the two sides of the electrical plug connector 200. Thus, the two sides of the tongue portion 132 are prevented from wearing against the clamping structures 27 at the two sides of the electrical plug connector 200. Moreover, noises at the clamping structures 27 can be grounded and conducted due to the projecting abutting portions 1722 are in contact with the first metal shell 11. Besides, the projecting abutting portions 1722 and the first metal shell 11 may be connected by welding or by a laser soldering.

Figure 21:
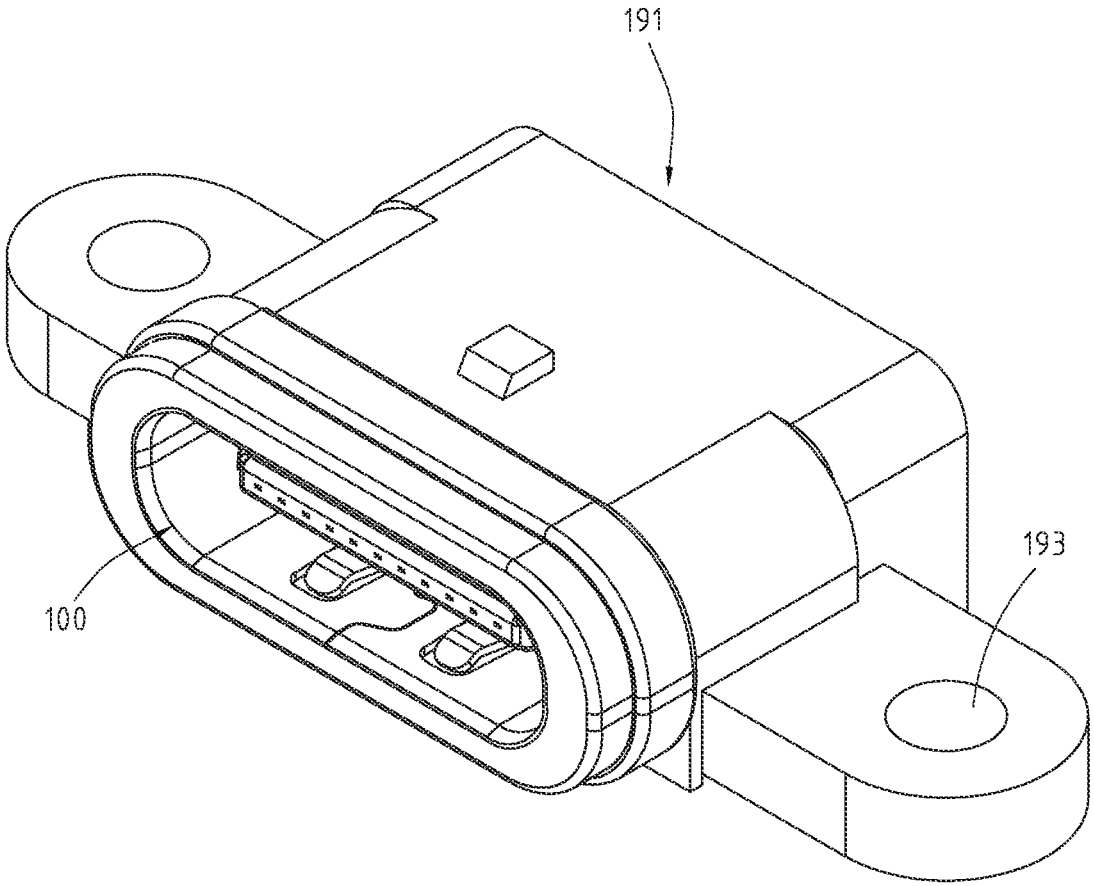
FIG. 21 illustrates a perspective view of the electrical receptacle connector combined with a first insulation casing.
Figure 22:
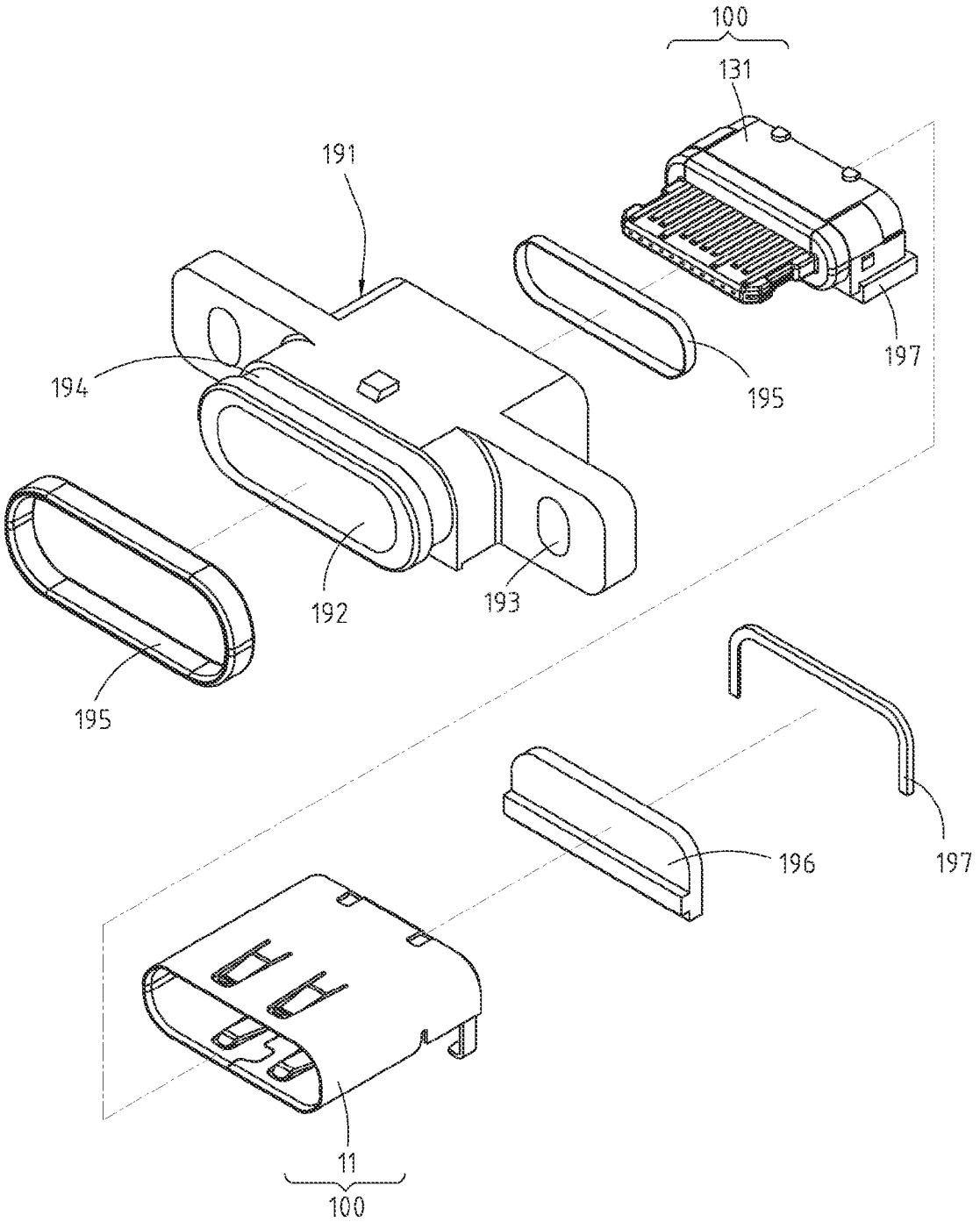
FIG. 22 illustrates an exploded view of the electrical receptacle connector combined with the first insulation casing.

Please refer to FIG. 21 and FIG. 22, in some embodiments, the electrical receptacle connector 100 is further provided with a first insulation casing 191, a plurality of waterproof gaskets 195, a waterproof cover 196, and a sealing material 197. The first insulation casing 191 is a hollow base made of plastic. The first insulation casing 191 defines a hollow opening 192 therein. The first metal shell 11 is accommodated in the first insulation casing 191. Lock holes 193, aligned horizontally or vertically, are formed at two side of the first insulation casing 191. The waterproof gaskets 195 are assembled with at least one of the first base portion 131 and the first insulation casing 191. The waterproof gasket 195 may be fitted over the first base portion 131 or the first insulation housing 191, alternatively, the waterproof gaskets 195 may be combined with the first base portion 131 or the first insulation housing 191 during insert-molding. Regarding the waterproof gaskets 195 are fitted over the first base portion 131, the waterproof gaskets 195 are abutted against between the first base portion 131 and the first metal shell 11 so as to prevent moist from penetrating inside through the junction between the first base portion 131 and the first metal shell 11. Regarding the waterproof gaskets 195 are fitted over the first insulation casing 191, the first insulation casing 191 is provided with a recessed portion 194 defined at the outer periphery thereof for accommodating the waterproof gaskets 195. Therefore, when the first insulation casing 191 is assembled to a shell of an electronic product, fixing elements (e.g., rivets or bolts) are provided into the lock holes 193 to secure the first insulation casing 191 with the shell of the electronic product, and the waterproof gasket 195 configured between the shell of the electronic product and the first insulation casing 191 prevent moist from penetrating inside through the junction between the shell of the electronic product and the first insulation casing 191. The waterproof cover 196 covers the rear part of the first insulation casing 191 and also covers the hollow opening 192. In addition, the space between the waterproof cover 196 and the hollow opening 192 may be, but not limited to, filled with the sealing material 197. In some embodiments, the sealing material 197 may be applied to completely seal the rear part of the first insulation casing 191; in other words, in the embodiments, the first insulation casing is devoid of the waterproof cover 196.

Figure 23:
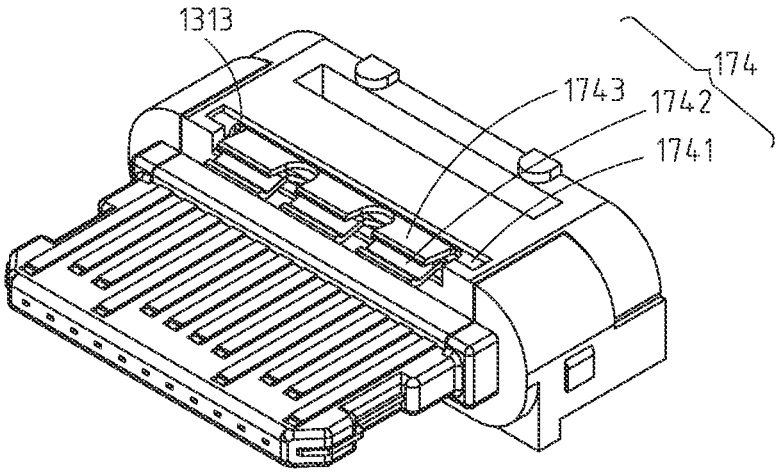
FIG. 23 is a perspective view illustrating the first insulation housing of the electrical receptacle connector of the electrical connector assembly according to the instant disclosure, where conductive plates are combined with the first insulation housing.
Figure 40:
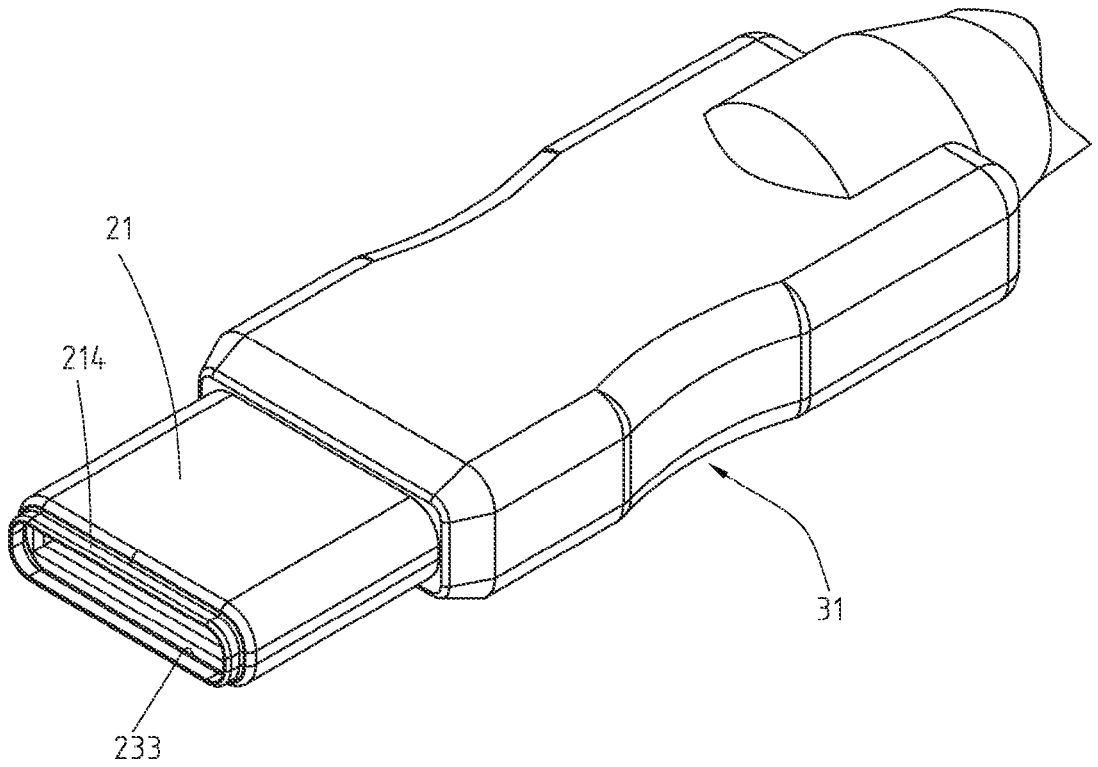
FIG. 40 illustrates a perspective view of the electrical plug connector of the electrical connector assembly provided with a tubular portion, according to the instant disclosure.

Please refer to FIG. 23. In some embodiments, the electrical receptacle connector 100 is further provided with a plurality of conductive plates 174. Each of the conductive plates 174 is a V-profiled, clamping piece. The conductive plates 174 are respectively at the top portion and the bottom portion of the first base portion 131. Here, the first base portion 131 is provided with a plurality of recessed portions 1313 on the top surface 1311 and the bottom surface 1312 of the first base portion 131, and the conductive plates 174 are received in the recessed portions 1313, so that the conductive plates 174 are in contact with the inner wall of the first metal shell 11. Here, each of the conductive plates 174 comprises a shaft 1741, a drive portion 1742, and a driven portion 1743. For each conductive plate 174, the shaft 1741 is pivotally received in of the corresponding recessed portion 1313, the drive portion 1742 is extending slantingly toward the tongue portion 132 from one of two sides of the shaft 1741, and the driven portion 1743 is extending from the other side of the shaft 1741 and movably in contact with the inner wall of the first metal shell 11. Accordingly, when the electrical plug connector 200 is plugged into the electrical receptacle connector 100, a second tubular portion 214 (as shown in FIG. 40) at the front end of the second metal shell 21 of the electrical plug connector 200 would be in contact with the drive portions 1742, so that each of the drive portions 1742 rotates about the axis of the corresponding shaft 1741 to simultaneously drive the corresponding driven portion 1743 be in contact with the inner wall of the first metal shell 11 of the electrical receptacle connector 100. Based on this, the conductive plates 174 allow effective conduction between the second metal shell 21 of the electrical plug connector 200 and the first metal shell 11 of the electrical receptacle connector 100, and the EMI problem can be further reduced.

Please refer to FIG. 8. In some embodiments, the first metal shell 11 is further provided with a first inclined guiding surface 1131 at the inner wall of the insertion opening 113. The first inclined guiding surface 1131 facilitates the connection between the electrical plug connector 200 and the electrical receptacle connector 100 when the electrical plug connector 200 is to be inserted into the electrical receptacle connector 100. In addition, referring to FIG. 20, the first metal shell 11 may be further provided with a rear cover portion 114 covering the rear part of the receptacle cavity 112. Accordingly, the exposed interior area of the first metal shell 11 can be reduced with the rear cover portion 114. Moreover, the bottom of the rear cover plate 114 may be provided with a plurality of extension grounding sheets 1141 extending downward and vertically to be vertical pins. The grounding of the electrical receptacle connector 100 can be further improved by the extension grounding sheets 1141.

Figure 20:
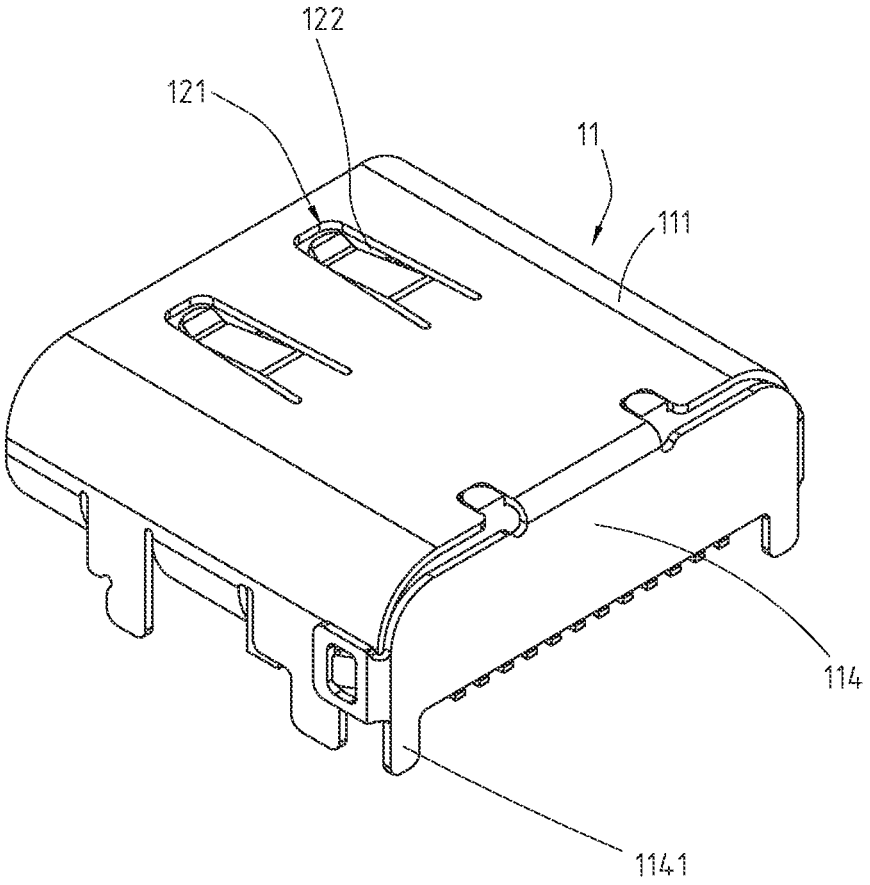
FIG. 20 illustrates another perspective view of the first metal shell shown in FIG. 5.
Figure 24:
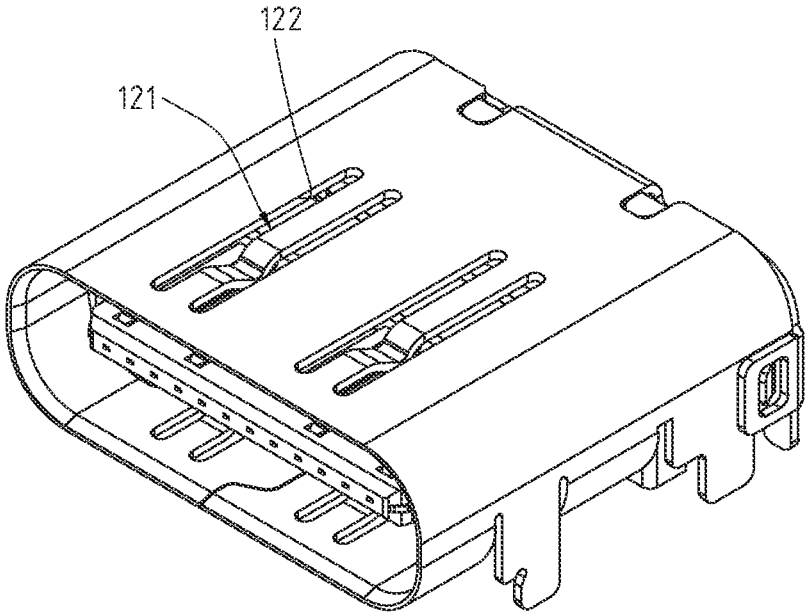
FIG. 24 is a perspective view illustrating the first metal shell of the electrical receptacle connector of the electrical connector assembly according to the instant disclosure, where elastic springs are assembled with the first metal shell.

Please refer to FIG. 20, in some embodiments, the first metal shell 11 is further provided with the elastic spring 12 and the crack 122. The elastic spring 12 has a bent contact portion 121 extending toward the receptacle cavity 112 for being in contact with the electrical plug connector 200. Besides, one of two ends of the elastic spring 12 may be, but not limited to, in contact with to the inner walls of the crack 122. Alternatively, in some embodiments, the two ends of the elastic spring 12 may be respectively in contact with two opposite sides of the inner wall of the crack 122 (as shown in FIG. 24), and a bent contact portion 121 is approximately configured at the middle portion of the elastic spring 12. Accordingly, when the second metal shell 21 of the electrical plug connector 200 is in contact with the bent contact portion 121, because the two ends of the elastic spring 12 are in contact with the inner wall of the crack 122, the motion of the bent contact portion 121 is thus restricted and the bent contact portion 121 does not protrude out of the first metal shell 11.

Figure 25:
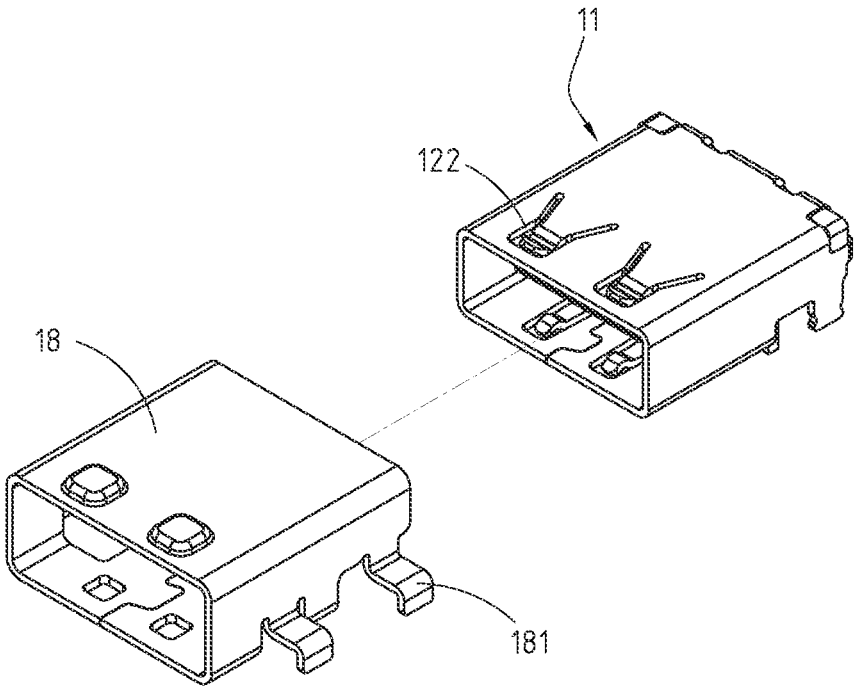
FIG. 25 is an exploded view illustrating a covering shell is combined with the electrical receptacle connector of the electrical connector assembly according to the instant disclosure.

Please refer to FIG. 25. In some embodiments, the electrical receptacle connector 100 may be further combined with a covering shell 18 covering the first metal shell 11 so as to shield the crack 122 for improving waterproof. The covering shell 18 and the first metal shell 11 may be combined with each other by buckling means or soldering means. Here, the covering shell 18 may be provided with a plurality of extending pins 181 extending downwardly and vertically. Accordingly, the electrical receptacle connector 100 can be installed to a sinking type circuit board.

Figure 27:
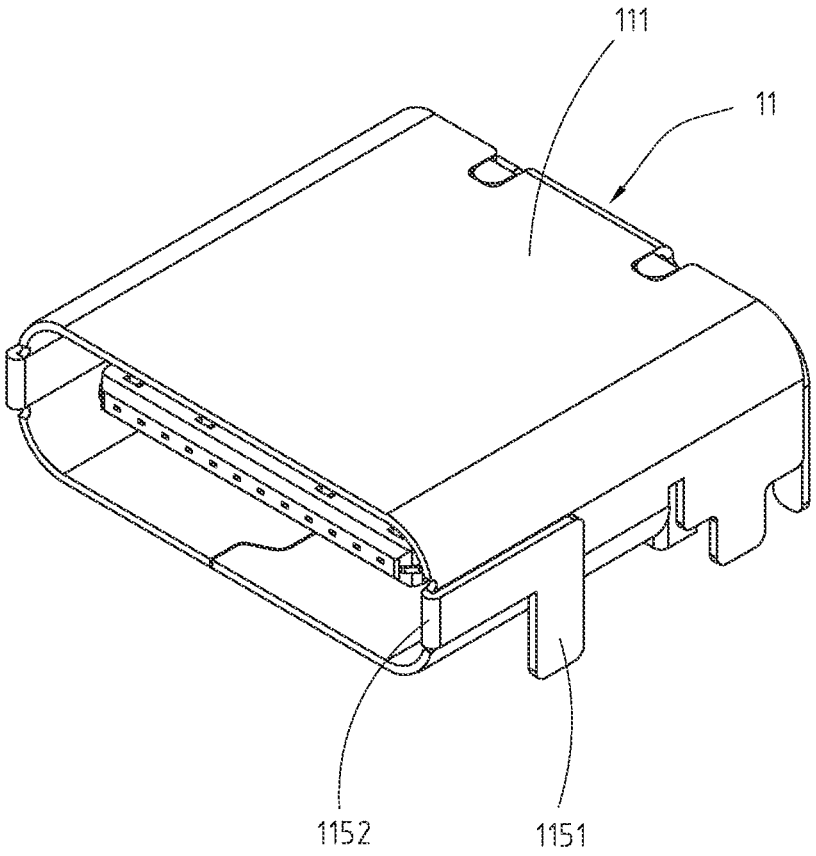
FIG. 27 illustrates a perspective view of the first metal shell of the electrical receptacle connector of the electrical connector assembly according to the instant disclosure, where the first metal shell is combined with a reversely-folded grounding piece, for one variation.

Please refer to FIG. 26. In some embodiments, the first metal shell 11 further comprises a first tubular portion 111, a reversely-folded grounding piece, 1151 and a bent segment 1152. One of two ends of the bent segment 1152 is extending from the first tubular portion 111 to be bent reversely, and the other end of the bent segment 1152 is extending toward the reversely-folded grounding pieces 1151. Here, the bent segments 1152 may be, but not limited to, arranged at the rear part of the first tubular portion 111. Alternatively, in some embodiments, the bent segment 1152 may be arranged at the front part of the first tubular portion 111 (as shown in FIG. 27). Here, several reversely-folded grounding pieces 1151 are arranged at the two sides of the first tubular portion 111 and extending downward and vertically. Accordingly, the electrical receptacle connector 100 can be installed on a sinking type circuit board.

Figure 29A:
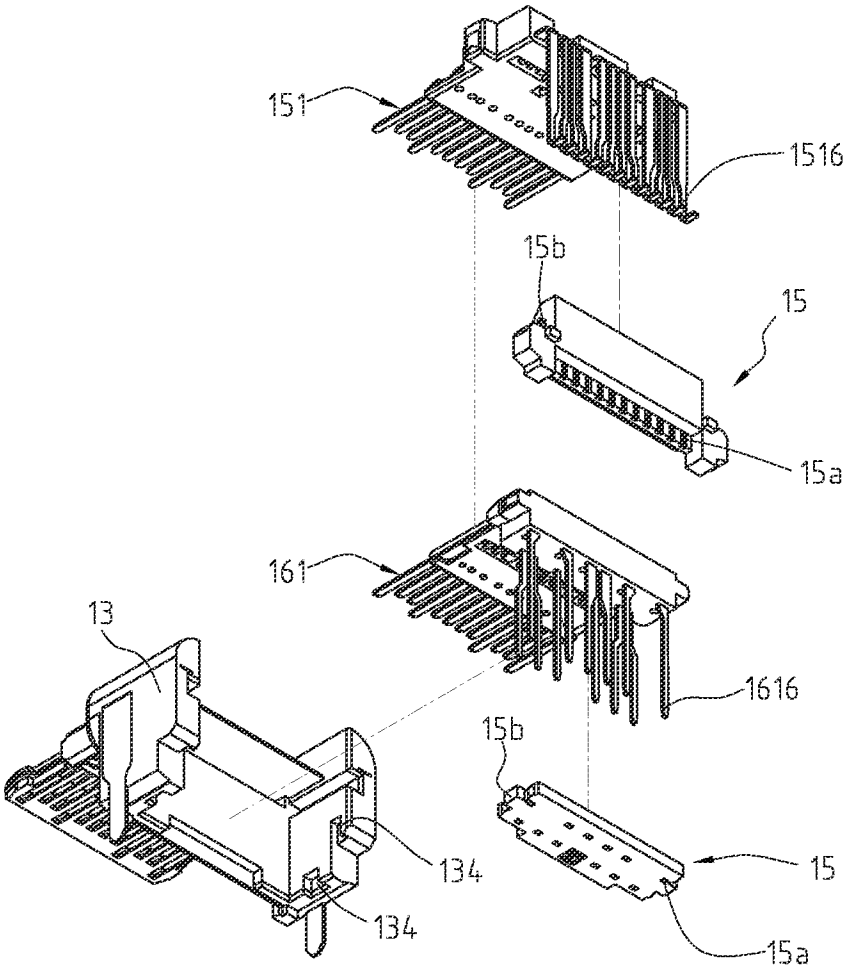
FIG. 29A illustrates an exploded view of the electrical receptacle connector of the electrical connector assembly provided with a rear terminal organizer, according to the instant disclosure.
Figure 29B:
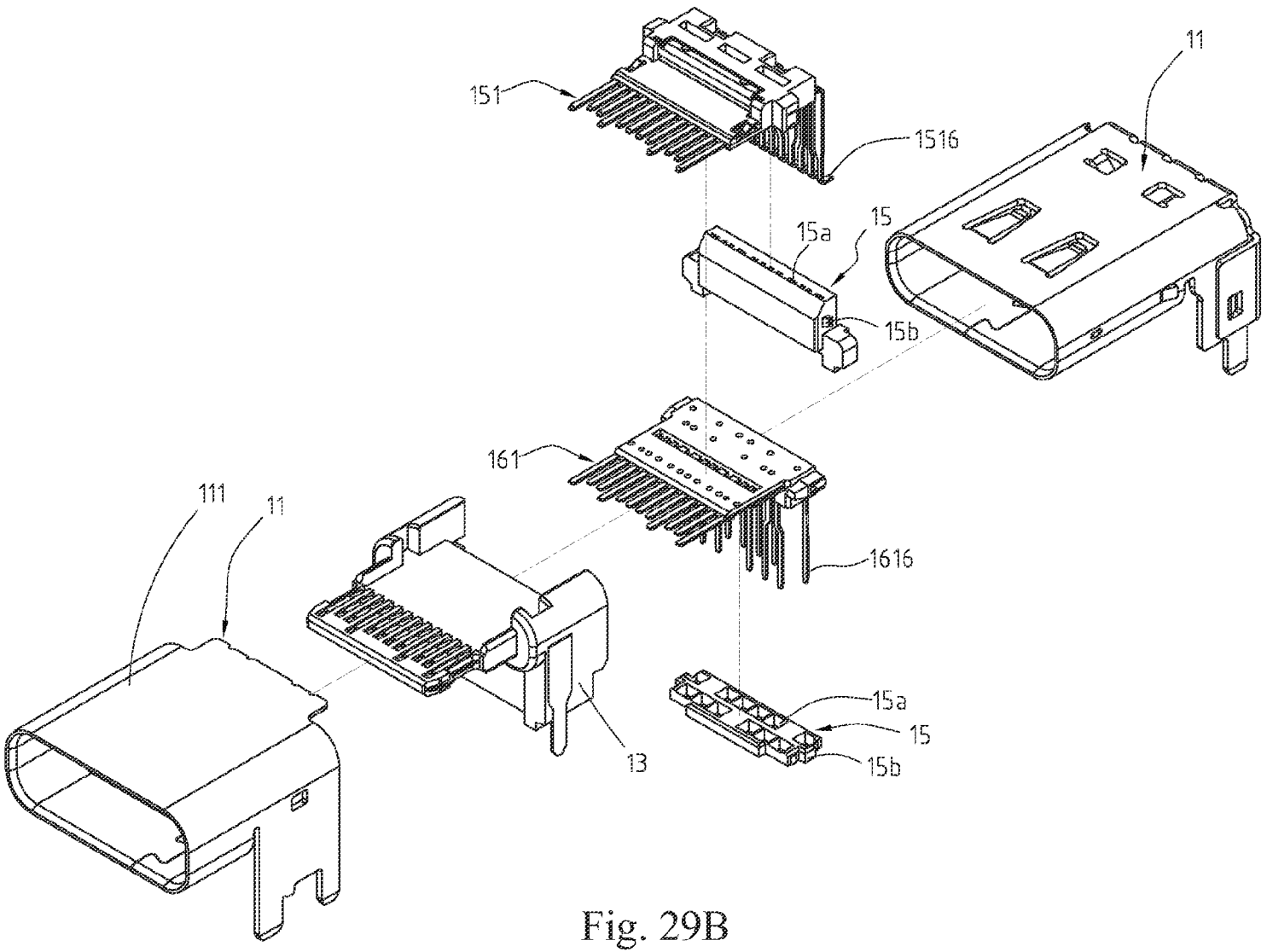
FIG. 29B illustrates a partial exploded view of the electrical receptacle connector of the electrical connector assembly provided with the rear terminal organizer, according to the instant disclosure.
Figure 29C:
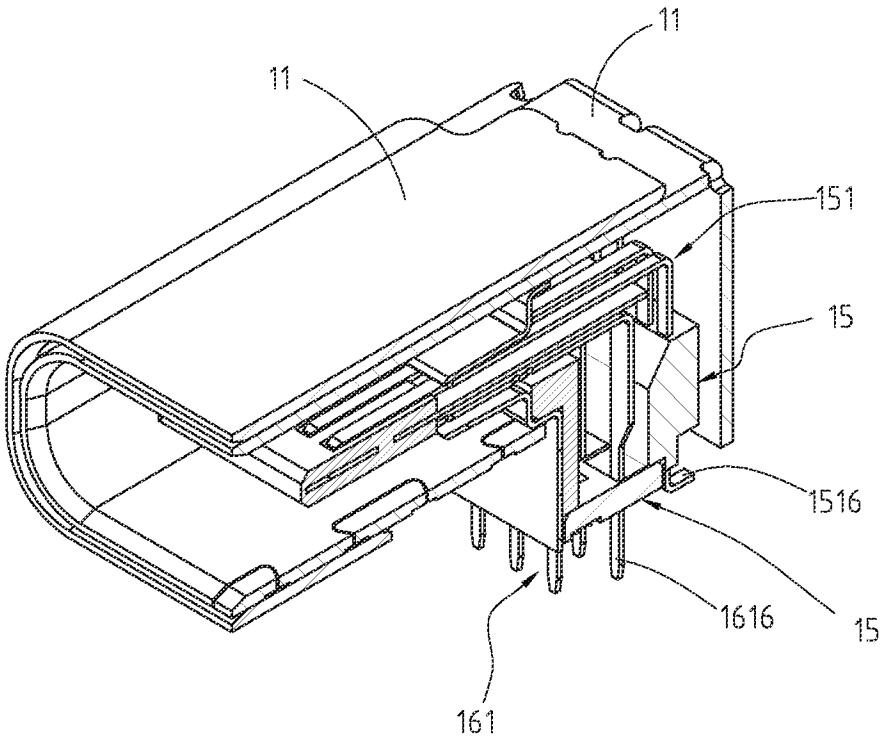
FIG. 29C illustrates a cross-sectional view of the electrical receptacle connector of the electrical connector assembly provided with the rear terminal organizer, according to the instant disclosure.

Please refer to FIG. 29A to FIG. 29C. In some embodiments, the electrical receptacle connector 100 further comprises one or more first rear terminal organizers 15. Here, several first rear terminal organizers 15 are fixed at the rear part of the first insulation housing 13. Each of the first rear terminal organizers 15 are elongate shaped and comprises a first main body, a plurality of first through grooves 15*a* defined through the first main body, and protruding blocks 15*b* protruded from the two sides of the first main body. In addition, the upper-row plate soldering segments 1516 and the lower-row plate soldering segments 1616 are held in the first through grooves 15*a*, namely, the first rear terminal organizers 15 are adapted to fit over the upper-row plate soldering segments 1516 and the lower-row plate soldering segments 1616. The first rear terminal organizers 15 may be combined with the upper-row plate soldering segments 1516 and the lower-row plate soldering segments 1616 during insert-molding. When the first rear terminal organizers 15 are to be assembled to the first insulation housing 13, the protruded blocks 15*b* are engaged with engage cavities 134 defined at the rear part of the first insulation housing 13. Accordingly, the upper-row plate soldering segments 1516 and the lower-row plate soldering segments 1616 are firmly positioned by the first rear terminal organizers 15.

Figure 30:
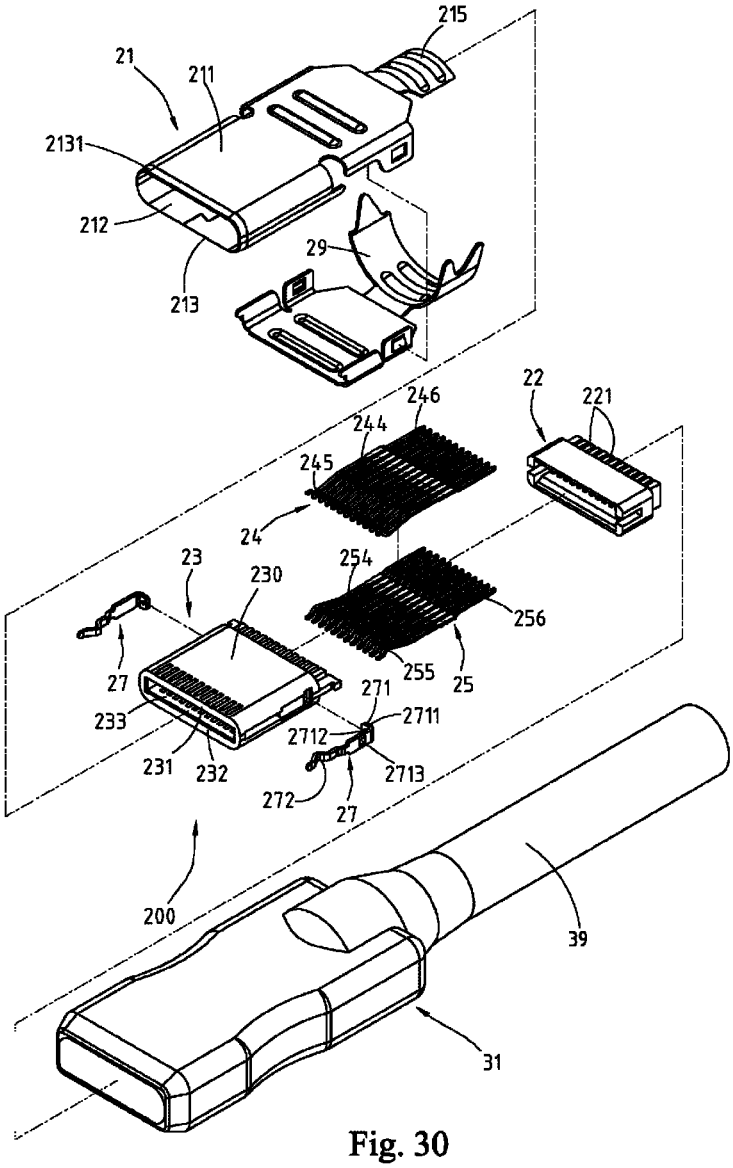
FIG. 30 illustrates an exploded view of the electrical plug connector of the electrical connector assembly according to the instant disclosure.
Figure 31:
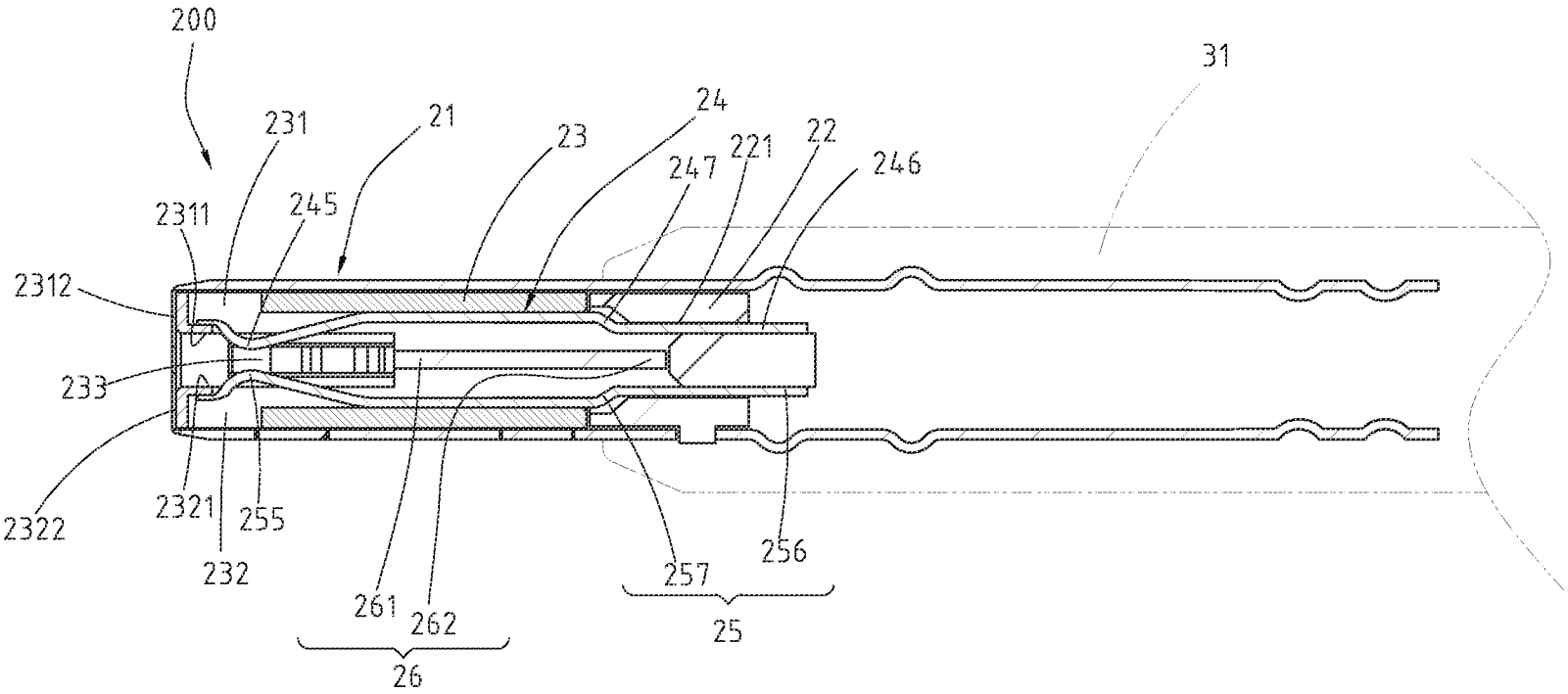
FIG. 31 illustrates a cross-sectional view of the electrical plug connector of the electrical connector assembly according to the instant disclosure.
Figure 34A:
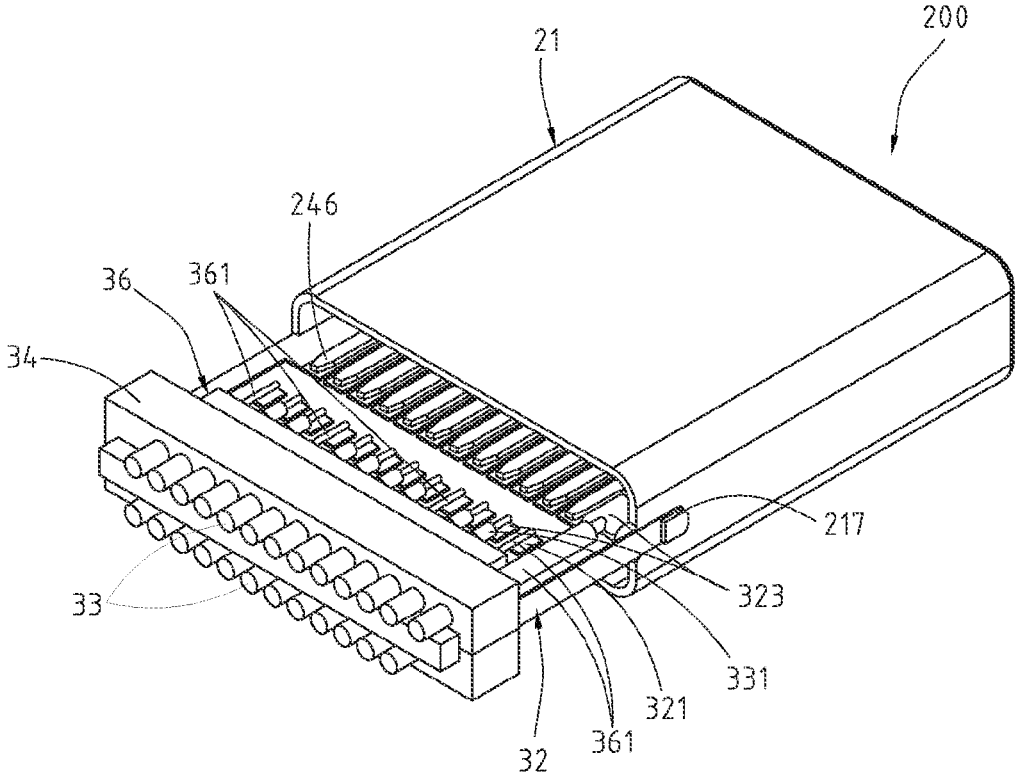
FIG. 34A illustrates a perspective view of the electrical plug connector of the electrical connector assembly according to the instant disclosure, where the electrical plug connector is connected to a ground plate.
Figure 39:
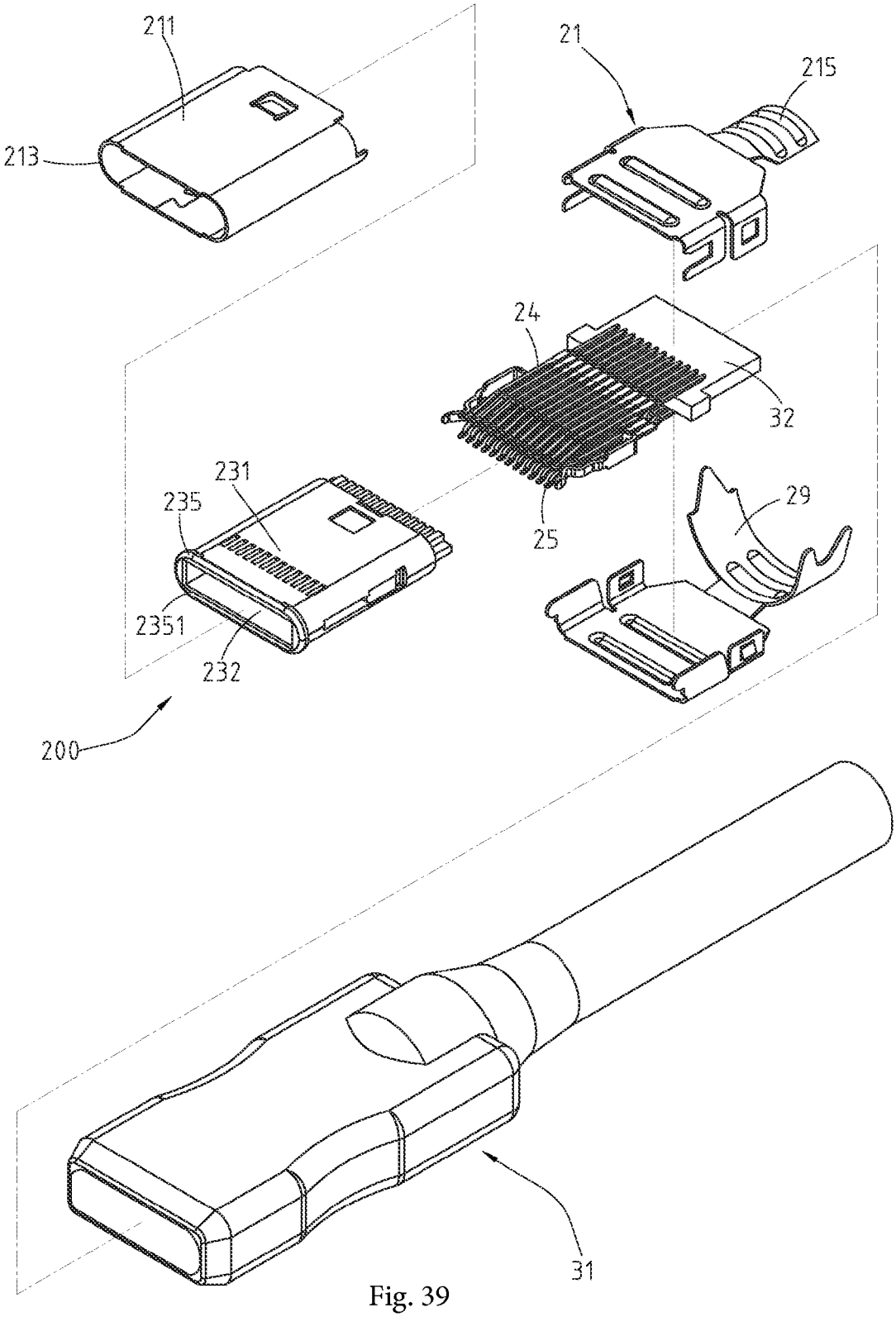
FIG. 39 illustrates an exploded view of the electrical plug connector of the electrical connector assembly according to the instant disclosure, where the electrical plug connector is provided with a frame portion.

Please refer to FIG. 30 and FIG. 31, illustrating exemplary embodiments of the electrical plug connector 200 combined with a second insulation casing 31 and a cable 39, but embodiments are not thus limited thereto. In some embodiments, the electrical plug connector 200 may be combined with a circuit board 32 (as shown in FIG. 34A and FIG. 39) to form a flash drive or a vertical charging dock without the cable 39. The electrical plug connector 200 is in accordance with the specification of the USB Type-C connection interface. In the embodiment, the electrical plug connector 200 comprises the second metal shell 21, a second insulation housing 23, the upper-row elastic terminals 24, and the lower-row elastic terminals 25.

Figure 34B:
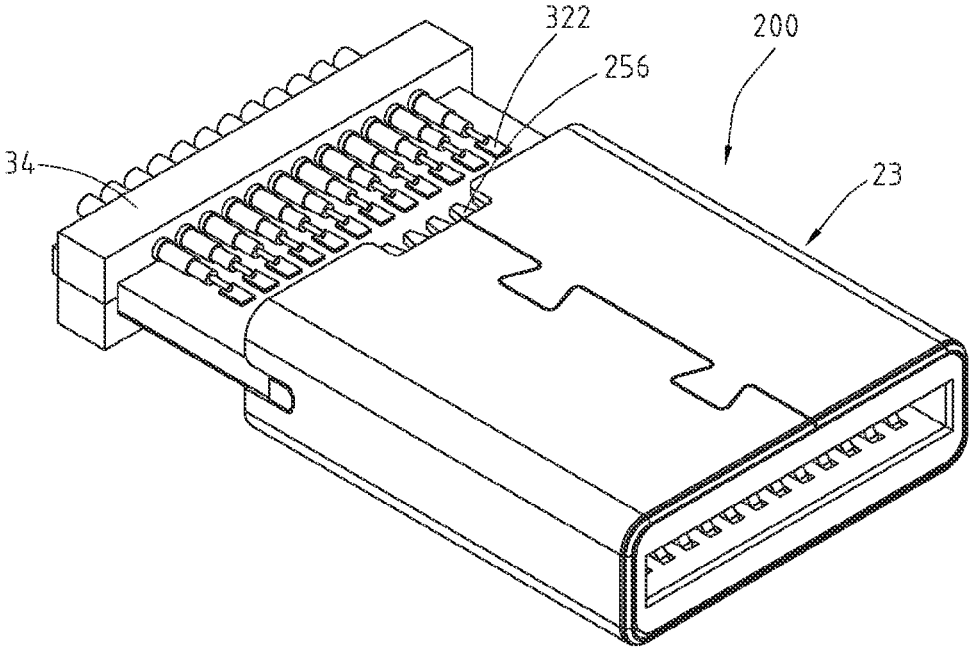
FIG. 34B illustrates a perspective view of the electrical plug connector of the electrical connector assembly according to the instant disclosure, where the electrical plug connector is connected to a plurality of wires, for one variation.
Figure 41:
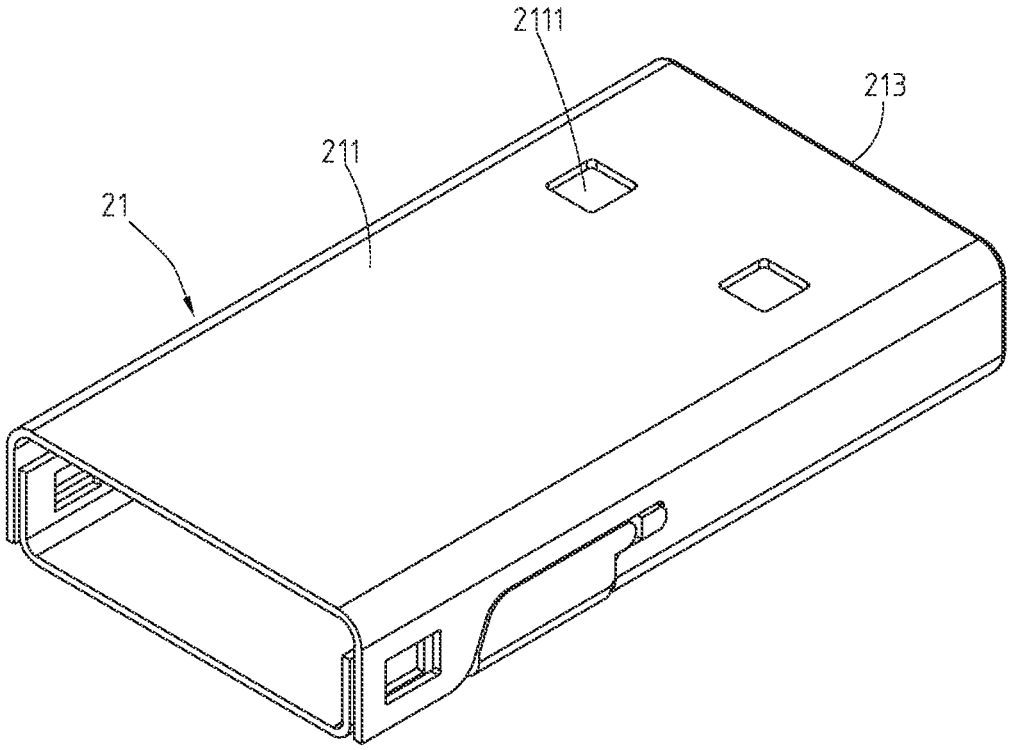
FIG. 41 illustrates a perspective view of the electrical plug connector of the electrical connector assembly provided with buckle holes, according to the instant disclosure.
Figure 44:
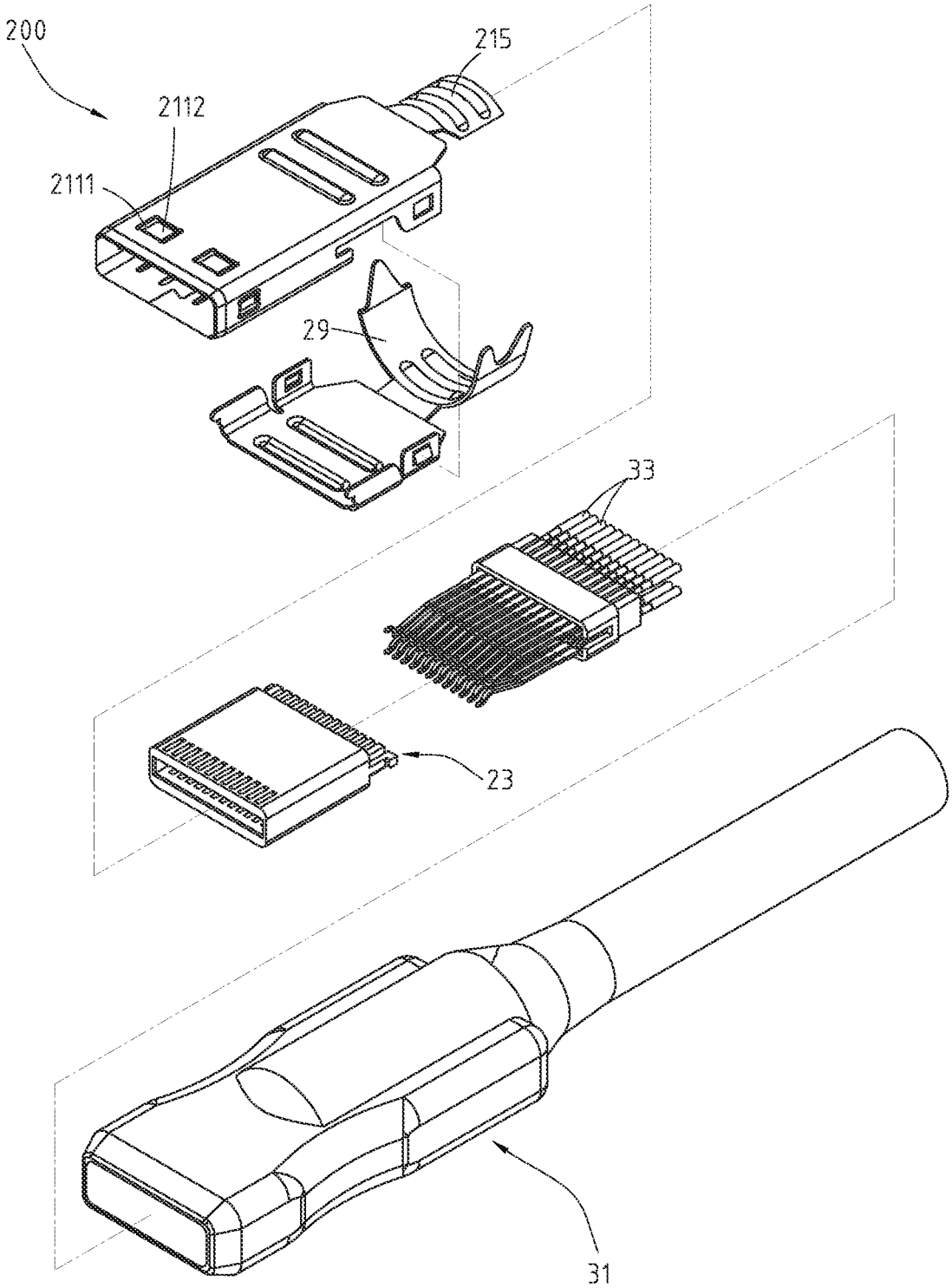
FIG. 44 illustrates an exploded view of the electrical plug connector of the electrical connector assembly combined with a clamping shell, according to the instant disclosure.

Please refer to FIG. 30 and FIG. 31, in which the second metal shell 21 is a hollow shell and defines a receiving cavity 212 therein. In the embodiment, the second metal shell 21 is formed by bending a unitary structured, second main body 211. In some embodiments, the second main body 211 may be formed as a two-piece structure (as shown in FIG. 39). The connection between the two pieces of the second main body 211 can be formed by a dovetail manner (as shown in FIG. 34B), an overlapped manner, or an extruded manner. In addition, after bending, the connection between the two pieces of the second main body 211 can be lined up to each other or tilted toward the interior of the receiving cavity 212 (i.e., the connection between the two pieces of the second main body 211 is formed as a V profile when viewing laterally). Besides, the second metal shell 21 may be provided with buckle holes 2111 formed on the surface of the second metal shell 21 (as shown in FIG. 41). Alternatively, in some embodiments, the second metal shell 21 is devoid of the buckle holes 2111 (as shown in FIG. 30). In addition, a plug opening 213, in oblong shaped, is formed on one side of the second metal shell 21 (as shown in FIG. 39). Alternatively, a plug opening 213, in rectangular shaped, is formed on one sides of the second metal shell 21 (as shown in FIG. 44). Additionally, the plug opening 213 communicates with the receiving cavity 212.

Please refer to FIG. 30 and FIG. 31, in which the second insulation housing 23 is in the receiving cavity 212 and comprises a second base portion 230, an upper member 231, a lower member 232, and a mating room 233. The second base portion 230, the upper member 231, and the lower member 232 are formed by injection-molding. Specifically, the upper member 231 and the lower member 232 are extending from one side of the second base portion 230. In addition, the mating room 233 is located between the upper member 231 and the lower member 232. The upper member 231 is provided with a second lower surface 2311 and an upper front lateral surface 2312. The lower member 232 is provided with a second upper surface 2321 and a lower front lateral surface 2322, and the second lower surface 2311 of the upper member 231 is opposite to the second upper surface 2321 of the lower member 232.

Figures 32A, 32B:
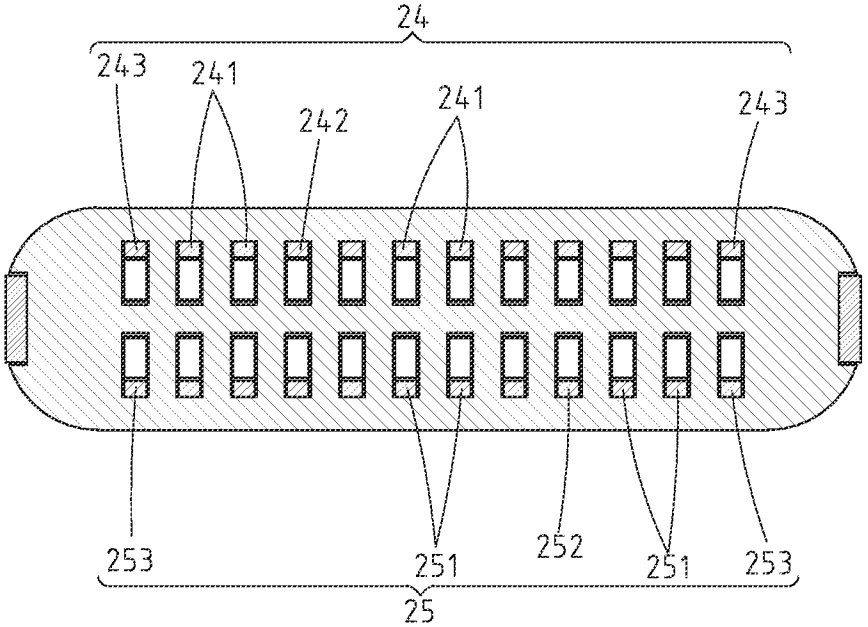
FIG. 32A illustrates a front sectional view of the electrical plug connector of the electrical connector assembly according to the instant disclosure.
FIG. 32B is a schematic configuration diagram of the elastic terminals of the electrical plug connector shown in FIG. 32A.
Figure 42:
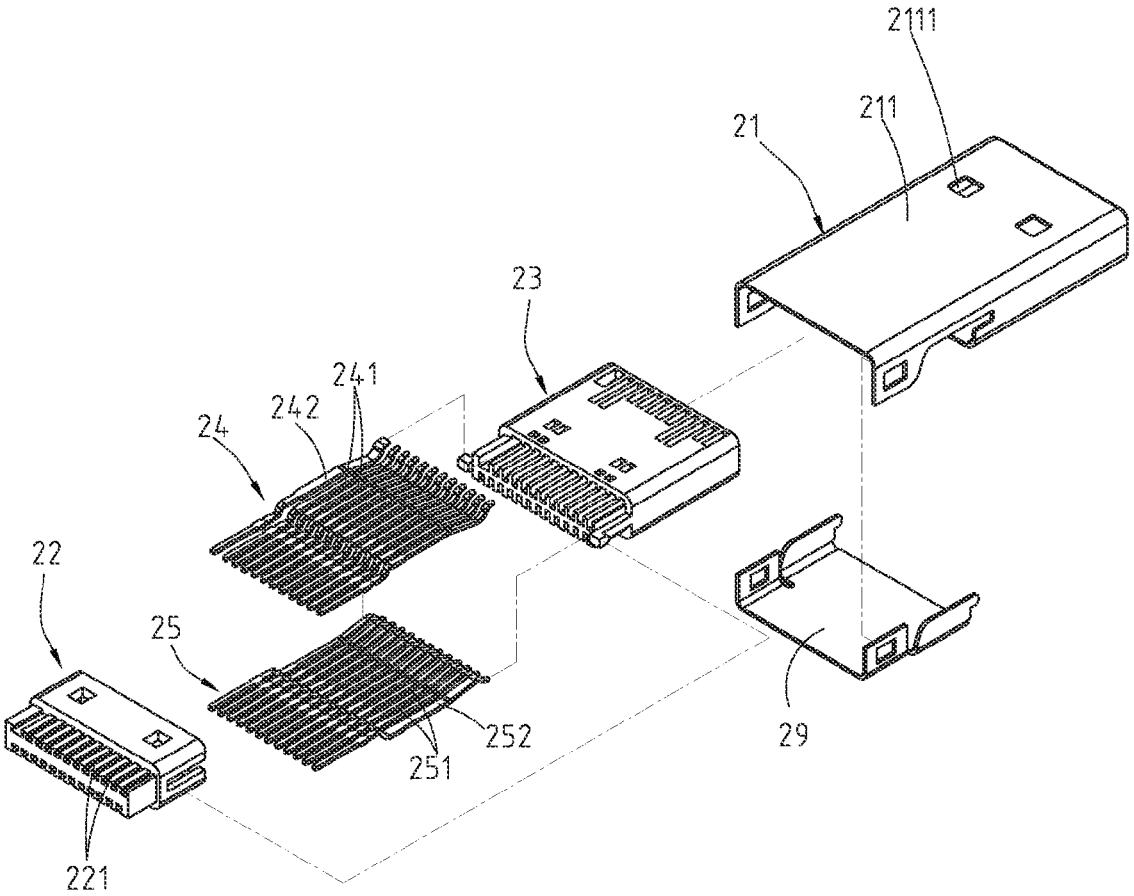
FIG. 42 illustrates an exploded view of the electrical plug connector of the electrical connector assembly provided with the buckle holes, according to the instant disclosure.

Please refer to FIG. 32A and FIG. 32B, in which the upper-row elastic terminals 24 comprise a plurality of upper-row elastic signal terminals 241, at least one upper-row elastic power terminal 242, and at least one upper-row elastic ground terminal 243. As shown in FIG. 32B, the upper-row elastic terminals 24 comprise, from right to left, an upper-row elastic ground terminal 243 (Gnd), a first pair of differential signal terminals (TX1+−), a second pair of differential signal terminals (D+−), a third pair of differential signal terminals (RX2+−), of the upper-row elastic signal terminals 241, upper-row elastic power terminals 242 (Power/VBUS), between the three pairs of differential signal terminals, a retain terminal (RFU), (the retain terminal and a configuration channel 1 (CC1) are respectively arranged between the upper-row elastic power terminals 142 (Power/VBUS) and the second pair of differential signal terminals of the upper-row elastic signal terminals 241), and an upper-row elastic ground terminal 243 (Gnd) at the leftmost side. However, the pin assignment described herein is an example for illustrative purpose, but not a limitation. The electrical plug connector 200 described herein may comprise, but not limited to, twelve upper-row elastic terminals 24 for transmitting the USB 3.0 signals. In some embodiments, the rightmost (or leftmost) upper-row elastic ground terminal 243 (Gnd) and the retain terminal (RFU) can be omitted. Furthermore, the rightmost upper-row elastic ground terminal 243 (Gnd) may be replaced by an upper-row elastic power terminal 242 (Power/VBUS) for power transmission. Here, the width of the upper-row elastic power terminal 242 (Power/VBUS) may be, but not limited to, equal to the width of each of the upper-row elastic signal terminals 241. In some embodiments, the width of the upper-row elastic power terminal 242 may be greater than the width of each of the upper-row elastic signal terminals 241 (as shown in FIG. 42). Accordingly, the electrical plug connector 200 is applicable for an electronic product required for high current transmission.

Please refer to FIG. 30 and FIG. 31, in which each of the upper-row elastic terminals 24 comprises an upper-row elastic contact segment 245, an upper-row elastic connecting segment 244, and an upper-row elastic soldering segment 246. For each upper-row elastic terminal 24, the upper-row elastic connecting segment 244 is at the upper member 231, the upper-row elastic contact segment 245 is extending from one of two ends of the upper-row elastic connecting segment 244 and at the second lower surface 2311 of the upper member 231, and the upper-row elastic soldering segment 246 is extending from the other end of the upper-row elastic connecting segment 244 and protruded out of the second insulation housing 23. The upper-row elastic signal terminals 241 are extending toward the mating room 233 for transmitting first signals (i.e., USB 3.0 signals). The upper-row elastic soldering segments 246 are protruded out of the rear part of the second insulation housing 23. Moreover, the upper-row elastic soldering segments 246 are horizontally aligned and separated from the lower-row elastic soldering segments 256, so that the upper-row elastic soldering segments 246 and the lower-row elastic soldering segments 256 are formed as two lines. Alternatively, by bending the upper-row elastic soldering segments 246, the upper-row elastic soldering segments 246 and the lower-row elastic soldering segments 256 may be formed as one line.

Please refer to FIG. 30 and FIG. 31, in which embodiment the distance between the upper-row elastic power terminal 242 and the upper front lateral surface 2312 of the upper member 231 is equal to the distance between each of the upper-row elastic signal terminals 241 and the upper front lateral surface 2312 of the upper member 231. In addition, the distance between the upper-row elastic ground terminal 243 and the upper front lateral surface 2312 of the upper member 231 is equal to the distance between each of the upper-row elastic signal terminals 341 and the upper front lateral surface 2312 of the upper member 231. In one word, each of the upper-row elastic terminals 24 described herein has an identical length, but embodiments are not thus limited thereto.

In some embodiments, the upper-row elastic terminals 24 are provided with difference lengths (not shown). In other words, the distance between the upper-row elastic power terminal 242 and the upper front lateral surface 2312 of the upper member 231 is less than the distance between each of the upper-row elastic signal terminals 241 and the upper front lateral surface 2312 of the upper member 231. Moreover, the distance between the upper-row elastic ground terminal 243 and the upper front lateral surface 2312 of the upper member 231 is less than the distance between each of the upper-row elastic signal terminals 241 and the upper front lateral surface 2312 of the upper member 231. When the electrical plug connector 200 is plugged into the electrical receptacle connector 100, the upper-row elastic power terminal 242 or the upper-row elastic ground terminal 243 is preferentially in contact with one row of the upper-row plate terminals 151 and the lower-row plate terminals 161 of the electrical receptacle connector 100, and the upper-row elastic signal terminals 241 are then in contact with the row of the plate terminals 151, 161 of the electrical receptacle connector 100. Accordingly, the electrical plug connector 200 is ensured to be completely plugged into the electrical receptacle connector 100 (i.e., to be plugged into the electrical receptacle connector 100 properly), before power or signal transmission. It should be understood that if the electrical plug connector 200 is not completely plugged into the electrical receptacle connector 100, arc burn may occur due to poor contact between the upper-row elastic signal terminals 241 and the plate terminals 151, 161 of the electrical receptacle connector 100. Therefore, based on the upper-row elastic terminals 24 with different lengths, the arc burn problem can be prevented.

Please refer to FIG. 32A and FIG. 32B, in which the lower-row elastic terminals 25 comprise a plurality of lower-row elastic signal terminals 251, at least one lower-row elastic power terminal 252, and at least one lower-row elastic ground terminal 253. As shown in FIG. 32B, the lower-row elastic terminals 25 comprise, from left to right, a lower-row elastic ground terminal 253 (Gnd), a first pair of differential signal terminals (TX2+−), a second pair of differential signal terminals (D+−), and a third pair of differential signal terminals (RX1+−), of the lower-row elastic signal terminals 251, lower-row elastic power terminals 252 (Power/VBUS), between the three pairs of differential signal terminals, a retain terminal (RFU), (the retain terminal and a configuration channel 2 (CC2) are respectively arranged between the lower-row elastic power terminals 252 (Power/VBUS) and the second pair of differential signal terminals of the lower-row elastic signal terminals 251), and a lower-row elastic ground terminal 253 (Gnd) at the leftmost side. However, the pin assignment described herein is an example for illustrative purpose, but not a limitation. The electrical plug connector described herein may comprise, but not limited to, twelve lower-row elastic terminals 25 for transmitting the USB 3.0 signals. In some embodiments, the rightmost (or leftmost) lower-row elastic ground terminal 253 (Gnd) at the leftmost and the retain terminal (RFU) can be omitted. Furthermore, the leftmost lower-row elastic ground terminal 253 (Gnd) may be replaced by a lower-row elastic power terminal 252 (Power/VBUS) for power transmission. Here, the width of the lower-row elastic power terminal 252 (Power/VBUS) may be, but not limited to, equal to the width of each of the lower-row elastic signal terminals. In some embodiments, the width of the lower-row elastic power terminal 252 may be greater than the width of each of the lower-row elastic signal terminals 251 (as shown in FIG. 42). Accordingly, the electrical plug connector 200 is applicable for an electronic product required for high current transmission.

Please refer to FIG. 32A and FIG. 32B, in which each of the lower-row elastic terminals 25 comprises a lower-row elastic contact segment 255, a lower-row elastic connecting segment 254, and a lower-row elastic soldering segment 256. For each lower-row elastic terminal 25, the lower-row elastic connecting segment 254 is on the lower member 232, the lower-row elastic contact segment 255 is extending from one of two ends of the lower-row elastic connecting segment 254 and at the second upper surface 2321 of the lower member 232, and the lower-row elastic soldering segment 256 is extending from the other end of the lower-row elastic connecting segment 254 and protruded out of the second insulation housing 23. The lower-row elastic signal terminals 251 are extending toward the mating room 233 for transmitting second signals (i.e., USB 3.0 signals). The lower-row elastic soldering segments 256 are protruded out of the rear part of the second insulation housing 23. Moreover, the lower-row elastic soldering segments 256 are horizontally aligned.

Please refer to FIG. 31, in the embodiment, the distance between the lower-row elastic power terminal 252 and the lower front lateral surface 2322 of the lower member 232 is equal to the distance between each of the lower-row elastic signal terminals 251 and the lower front lateral surface 2322 of the lower member 232. Moreover, the distance between the lower-row elastic ground terminal 253 and the lower front lateral surface 2322 of the lower member 232 is equal to the distance between each of the lower-row elastic signal terminals 251 and the lower front lateral surface 2322 of the lower member 232. In one word, each of the lower-row elastic terminals 25 described herein has an identical length, but embodiments are not thus limited thereto.

In some embodiments, the lower-row elastic terminals 25 are provided with difference lengths (not shown). In other words, the distance between the lower-row elastic power terminal 252 and the lower front lateral surface 2322 of the lower member 232 is less than the distance between each of the lower-row elastic signal terminals 251 and the lower front lateral surface 2322 of the lower member 232, and, the distance between the lower-row elastic ground terminal 253 and the lower front lateral surface 2322 of the lower member 232 is less than the distance between each of the lower-row elastic signal terminals 251 and the lower front lateral surface 2322 of the lower member 232. When the electrical plug connector 200 is plugged into the electrical receptacle connector 100, the lower-row elastic power terminal 252 or the lower-row elastic ground terminal 253 is preferentially in contact with one row of the upper-row plate terminals 151 and the lower-row plate terminals 161 of the electrical receptacle connector 100, and the lower-row elastic signal terminals 251 are then in contact with the row of the plate terminals 151, 161 of the electrical receptacle connector 100. Accordingly, the electrical plug connector 200 is ensured to be completely plugged into the electrical receptacle connector 100 (i.e., to be plugged into the electrical receptacle connector 100 properly), before power or signal transmission. It should be understood that if the electrical plug connector 200 is not completely plugged into the electrical receptacle connector 100, arc burn may occur due to poor contact between the lower-row elastic signal terminals 251 and the plate terminals 151, 161 of the electrical receptacle connector 100. Therefore, based on the lower-row elastic terminals 25 with different lengths, the arc burn problem can be prevented.

Please refer back to FIG. 30, FIG. 31, FIG. 32A, and FIG. 32B, in which embodiment the upper-row elastic terminals 24 and the lower-row elastic terminals 25 are respectively on the second lower surface 2311 of the upper member 231 and the second upper surface 2321 of the lower member 232. Additionally, pin assignment of the upper-row elastic terminals 24 and the lower-row elastic terminals 25 are point-symmetrical with a central point of the receiving cavity 212 as the symmetrical center. Here, point-symmetry means that after the upper-row elastic terminals 24 (or the lower-row elastic terminals 25), are rotated by 180 degrees with the symmetrical center as the rotating center, the upper-row elastic terminals 24 and the lower-row elastic terminals 25 are overlapped. That is, the rotated upper-row elastic terminals 24 are arranged at the position of the original lower-row elastic terminals 25, and the rotated lower-row elastic terminals 25 are arranged at the position of the original upper-row elastic terminals 24. In other words, the upper-row elastic terminals 24 and the lower-row elastic terminals 25 are arranged upside down, and the pin assignment of the upper-row elastic terminals 24 are left-right reversal with respect to that of the lower-row elastic terminals 25. Accordingly, the electrical plug connector 200 is inserted into the electrical receptacle connector 100 with a first orientation where the upper plane of the electrical plug connector 200 is facing up for transmitting first signals. Conversely, the electrical plug connector 200 is inserted into the electrical receptacle connector 100 with a second orientation where the upper plane of the electrical plug connector 200 is facing down for transmitting second signals. Besides, the specification for transmitting the first signals is conformed to the specification for transmitting the second signals. Note that, the inserting orientation of the electrical plug connector 200 is not limited by the electrical receptacle connector 100.

Figure 33:
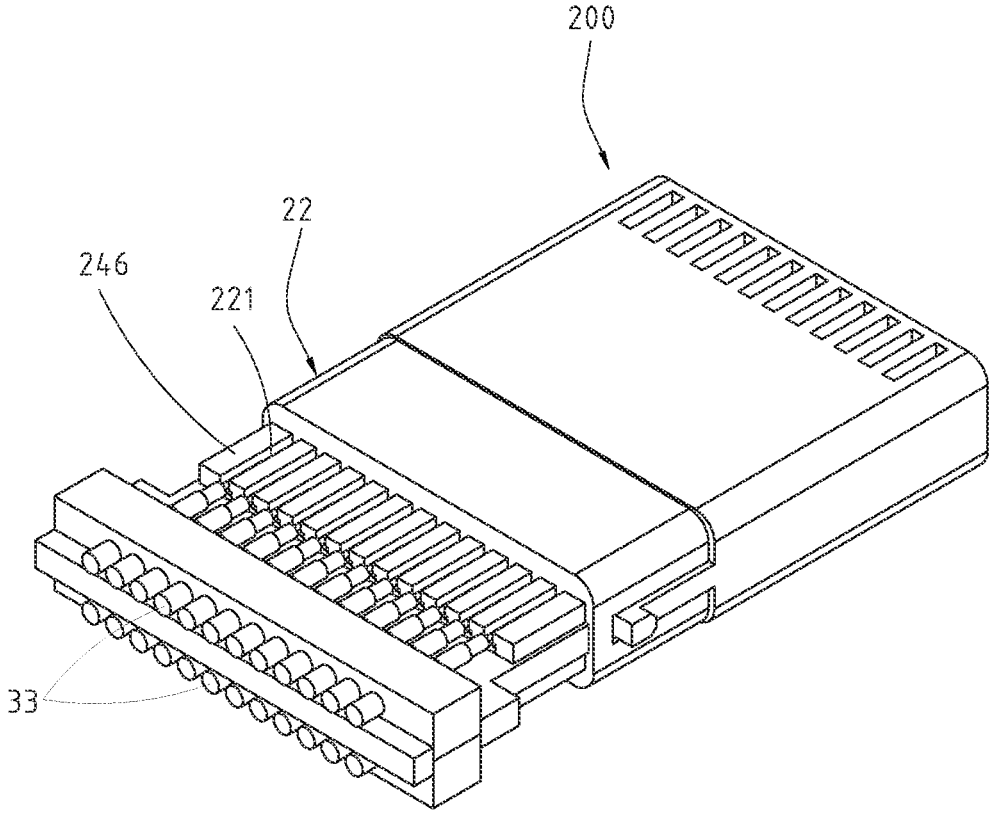
FIG. 33 illustrates a perspective view of the electrical plug connector of the electrical connector assembly according to the instant disclosure, where the electrical plug connector is connected to a plurality of wires.

Please refer to FIG. 31, FIG. 34A, and FIG. 34B, in which embodiment, the upper-row elastic soldering segments 246 and the lower-row elastic soldering segments 256 are protruded out of the rear part of the second insulation housing 23 to be arranged separately. The upper-row elastic soldering segments 246 and the lower-row elastic soldering segments 256 may be, but not limited to, arranged into two parallel lines, one by one. Here, each of the upper-row elastic terminals 24 is provided with an upper-row elastic bending segment 247 extending between the upper-row elastic connecting segment 244 and the upper-row elastic soldering segment 246, and the upper-row elastic bending segments 247 are provided for adjusting the distance between the upper-row elastic soldering segments 246 and the lower-row elastic soldering segments 256. Alternatively, each of the lower-row elastic terminals 25 may be provided with a lower-row elastic bending segment 257 extending between the lower-row elastic connecting segment 254 and the lower-row elastic soldering segment 256, and the lower-row elastic bending segments 257 are provided for adjusting the distance between the lower-row elastic soldering segments 256 and the upper-row elastic soldering segments 246. Accordingly, the upper-row elastic soldering segments 246 and the lower-row elastic soldering segments 256 can be directly connected to the wires 33 by soldering means (as shown in FIG. 33), or can be soldered on the circuit board 32 (as shown in FIG. 39). Moreover, the upper-row elastic bending segments 247 and the lower-row elastic bending segments 257 enable the distance the upper-row elastic soldering segments 246 and the lower-row elastic soldering segments 256 being adjustable. Additionally, the elastic bending segments 247, 257 also allow proper spatial assignment of the terminals and high-frequency characteristic. Here, the distance between the upper-row elastic soldering segments 246 and the lower-row elastic soldering segments 256 is greater than, or equal to over three times of the width of each of the upper-row elastic terminals 24 (or each of the lower-row elastic terminals 25). In addition, the space between the upper-row elastic terminals 24 and the lower-row elastic terminals 25 can be 0.6 mm, 0.8 mm, or 1.0 mm.

Figure 37:
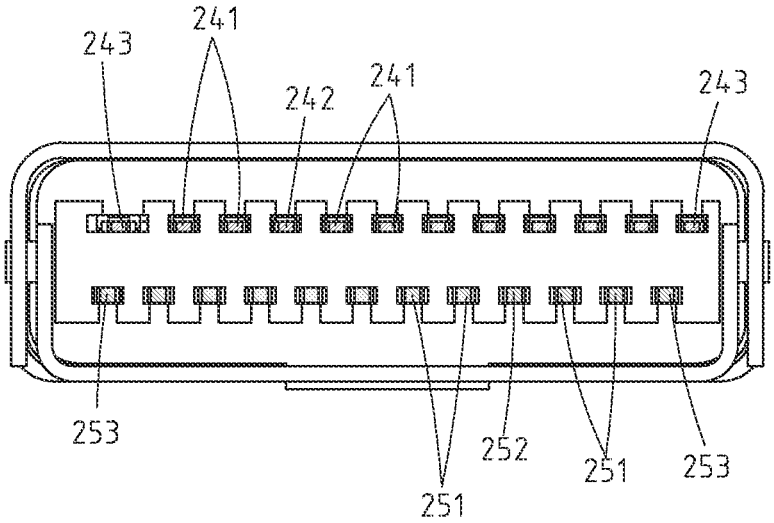
FIG. 37 is a front sectional view illustrating that the upper-row elastic terminals are offset with respect to the lower-row elastic terminals of the electrical plug connector of the electrical connector assembly according to the instant disclosure.

Please refer to FIG. 30 and FIG. 32A, in which embodiment, the position of the upper-row elastic terminals 24 corresponds to the position of the lower-row elastic terminals 25, as shown in FIG. 32A. In other words, in the embodiment, the upper-row elastic contact segments 245 are aligned to the lower-row elastic contact segments 255, one by one, but embodiments are not thus limited thereto. In some embodiments, the upper-row elastic contact segments 245 are aligned parallel to the lower-row elastic contact segments 255, and the upper-row elastic contact segments 245 are offset with respect to the lower-row elastic contact segments 255 (as shown in FIG. 37). Similarly, the upper-row elastic soldering segments 246 may be offset with respect to the lower-row elastic soldering segments 256. Therefore, crosstalk interference between the elastic terminals 24, 25 can be effectively improved with the offset configuration between the elastic contact segments 245, 255 during signal transmission. Particularly, regarding the upper-row elastic terminals 24 and the lower-row elastic terminals 25 are configured with an offset, the terminals of the electrical receptacle connector 100 would have to be configured corresponding (i.e., the upper-row plate terminals 151 and the lower-row plate terminals 161 of the electrical receptacle connector 100 are configured with an offset). Thus, the upper-row plate terminals 151 and the lower-row plate terminals 161 of the electrical receptacle connector 100 can be correspondingly in contact with the upper-row elastic terminals 24 and the lower-row elastic terminals 25 for power or signal transmission.

In the above embodiments, the upper-row elastic terminals 24 or the lower-row elastic terminals 25 may be, but not limited to, provided for transmitting the USB 3.0 signals, individually. In some embodiments, for the upper-row elastic terminals 24, the first pair of differential signal terminals (TX1+−) and the third pair of differential signal terminals (RX2+−) of the upper-row elastic signal terminals 241 can be omitted, and the second pair of differential signal terminals (D+−) and the upper-row elastic power terminal 242 (Power/VBUS) are retained, when transmitting USB 2.0 signals. For the lower-row elastic terminals 25, the first pair of differential signal terminals (TX2+−) and the third pair of differential signal terminals (RX1+−) of the lower-row elastic signal terminals 251 can be omitted, and the second pair of differential signal terminals (D+−) and the lower-row elastic power terminals 252 (Power/VBUS) are retained, when transmitting USB 2.0 signals.

Please refer to FIG. 30 and FIG. 31, in some embodiments, the electrical plug connector 200 is combined with a second rear terminal organizer 22. The second rear terminal organizer 22 is fixed at the rear part of the second insulation housing 23. From a side view of the second rear terminal organizer 22, the second rear terminal organizer 22 is formed as a U-profile structure. The second rear terminal organizer 22 defines a plurality of second through grooves 221 therethrough, and upper-row elastic soldering segments 246 and the lower-row elastic soldering segments 256 are held in the second through grooves 221. That is the second rear terminal organizer 22 is fitted over the upper-row elastic soldering segments 246 and the lower-row elastic soldering segments 256 to enclose the periphery of the elastic soldering segments 246, 256. Accordingly, when the electrical plug connector 200 is wrapped with an outer mould (e.g., a cover piece 35 shown in FIG. 35A), the second rear terminal organizer 22 prevents glues of the outer mould from flowing out of the space between the upper-row elastic soldering segments 246 and the lower-row elastic soldering segments 256.

Please refer to FIG. 33. In some embodiments, the electrical plug connector 200 is further connected with the wires 33. When the upper-row elastic soldering segments 246 and the lower-row elastic soldering segments 256 are exposed out of the second through grooves 221 of the second rear terminal organizer 22, the wires 33 can be correspondingly soldered with the upper-row elastic soldering segments 246 and the lower-row elastic soldering segments 256 on the second rear terminal organizer 22. In addition, the wires 33 connected with the electrical plug connector 200 can be of a coaxial structure, and the wires 33 can be soldered to the elastic soldering segments 246, 256 via means of hot bar soldering, hot air fixing, or automatic ultrahigh-frequency soldering.

The electrical plug connector 200 combined with the second rear terminal organizer 22 and soldered with the wires 33 described above is for illustrative purpose, embodiments are not limited thereto. In some embodiments, the electrical plug connector 200 may be combined with the circuit board 32 and devoid of the second rear terminal organizer 22 (as shown in FIG. 39). Here, the circuit board 32 is fixed at the rear part of the second insulation housing 23. In other words, one of two sides of the circuit board 32 is soldered with the upper-row elastic soldering segments 246 and the lower-row elastic soldering segments 256 (as shown in FIG. 34A and FIG. 34B), and the other side of the circuit board 32 is connected to the wires 33. Here, a plurality of upper-surface contacts 321 is located on one of two surfaces of the circuit board 32 and connected to the second upper-low elastic soldering segments 246. Likewise, a plurality of lower-surface contacts 322 is located on the other surface of the circuit board 32 and connected to the lower-row elastic soldering segments 256. Furthermore, two sides of the circuit board 32 are protruded outside the second metal shell 21. The wires 33 may be soldered on at least one of the two surfaces of the circuit board 32. Particularly, the circuit board 32 is further provided with a plurality of ground contacts 323 used for grounding, the second metal shell 21 is soldered with the ground contacts 323, and a ground wire 331 of the wires 33 is soldered with the ground contacts 323.

Please refer to FIG. 34A and FIG. 34B. In some embodiments, a plurality of fixing grooves 217 is defined at the rear part of the second metal shell 21. The fixing grooves 217 are cut elongate grooves formed on the two sides of the second metal shell 21. The width of each of the fixing grooves 217 is greater than the thickness of the circuit board 32, so that two sides of the circuit board 32 are held in the fixing grooves 217.

Please refer to FIG. 34A and FIG. 34B. In some embodiments, the electrical plug connector 200 is further provided with a ground plate 36. The ground plate 36 is a strip-shaped plate and integrated with the wires 33. The ground plate 36 is provided with a plurality of rods 361 protruded therefrom, at least one of the rods 361 is extending toward and in contact with at least one of the ground contacts 323, and the rods 361 are further extending toward and in contact with the upper-surface contacts 321 of the circuit board 32. Accordingly, regarding the number of the wires 33 is reduced, the rods 361 are in contact with the upper-surface contacts 321 when the wires 33 are soldered with the upper-surface contacts 321.

Please refer to FIG. 34A and FIG. 34B. In some embodiments, the electrical plug connector 200 may be further connected with a fixing plate 34 when connecting to the wires 33. The fixing plate 34 is an elongate case. Here, plural fixing plates 34 are combined to the top and the bottom of the rear part of the circuit board 32, and the wires 33 may be then fixed with the fixing plates 34. The fixing between the wires 33 and the fixing plates 34 may be carried out with following means. In one embodiment, the fixing plates 34 are combined with the wires 33 during insert-molding. In one variation, the fixing plates 34 are buckled with the wires 33. Or, the fixing plates 34 are fixed with the wires 33 via an auxiliary tool.

Figure 35A:
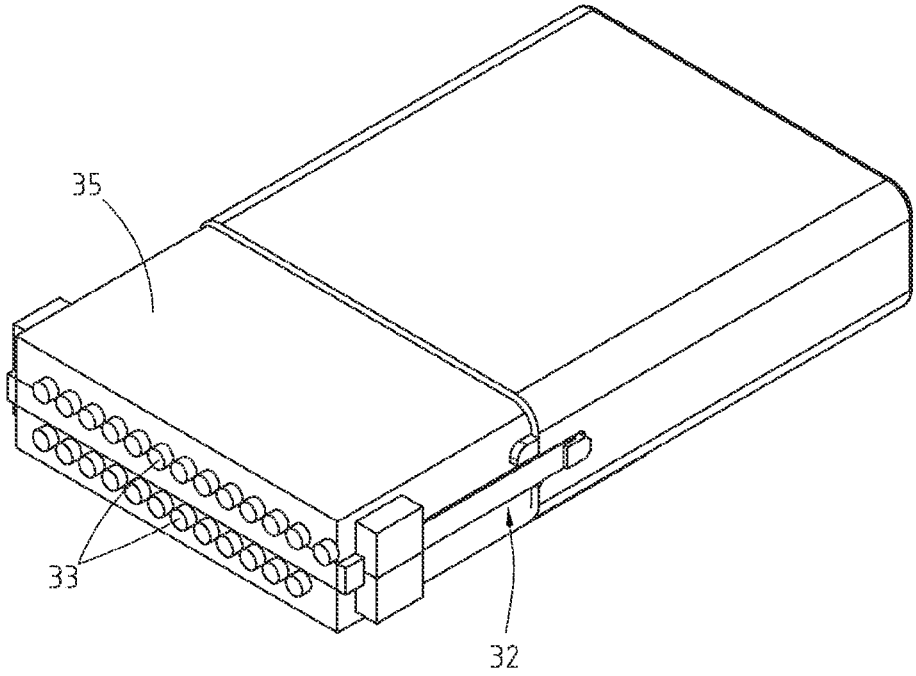
FIG. 35A illustrates a perspective view of the electrical plug connector of the electrical connector assembly according to the instant disclosure, where the electrical plug connector is combined with a cover piece.
Figure 35B:
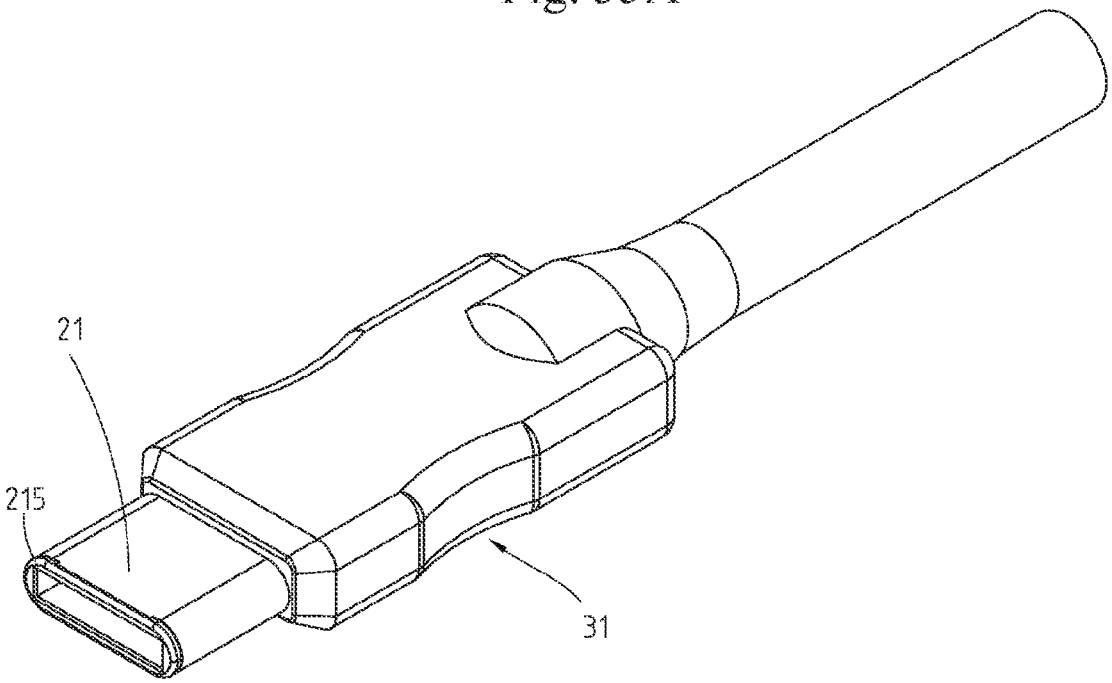
FIG. 35B illustrates a perspective view of the electrical plug connector of the electrical connector assembly according to the instant disclosure, where the electrical plug connector is combined with a second insulation casing.

Please refer to FIG. 35A and FIG. 35B. In some embodiments, the electrical plug connector 200 may be further combined with the cover piece 35 (an inner mould) and the second insulation casing 31 (the outer mould). The cover piece 35 covers the wires 33, the upper-row elastic soldering segments 246, and the lower-row elastic soldering segments 256. When the wires 33 are soldered on the circuit board 32, the cover piece 35 may be combined with the electrical plug connector 200 by means of gluing over-molding. Therefore, the wires 33, the upper-row elastic soldering segments 246, and the lower-row elastic soldering segments 256 are securely fixed to the circuit board 32. Besides, the second insulation casing 31 is further combined with the electrical plug connector by means of over-molding, so that the wires 33 and the rear part of the second metal shell 21 are enclosed properly. Accordingly, an electrical plug connector 200 provided with the wires 33 is carried out.

Figure 36A:
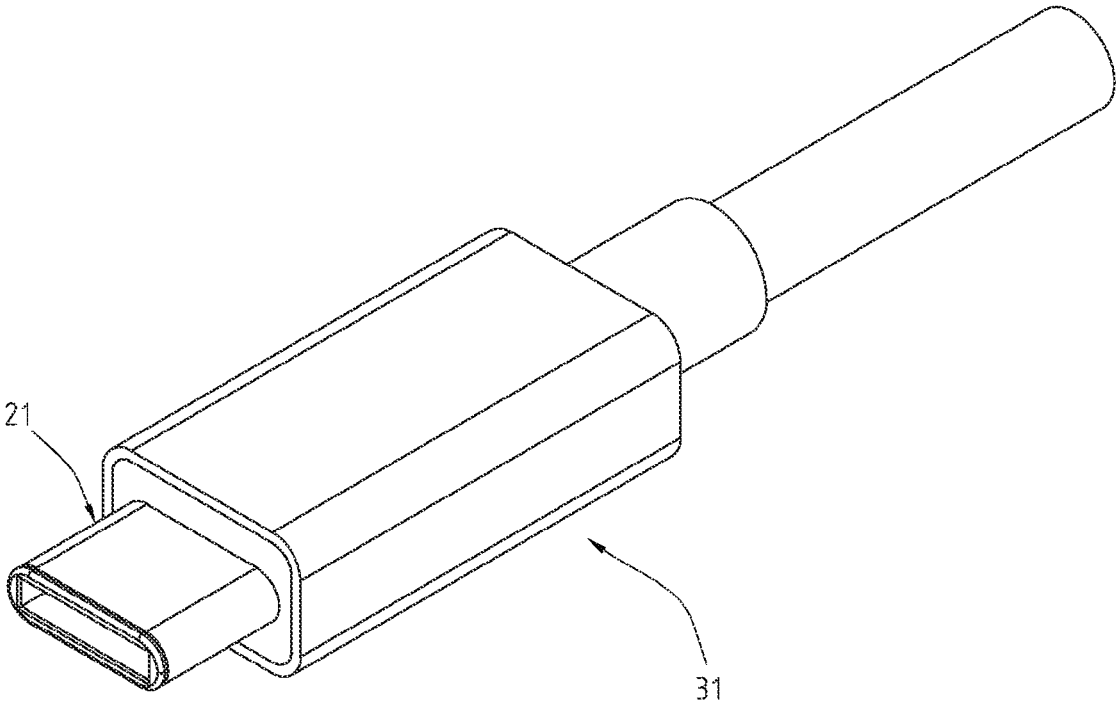
FIG. 36A illustrates a perspective view of the electrical plug connector of the electrical connector assembly according to the instant disclosure, where the electrical plug connector is combined with a second insulation casing, for one variation.
Figure 36B:
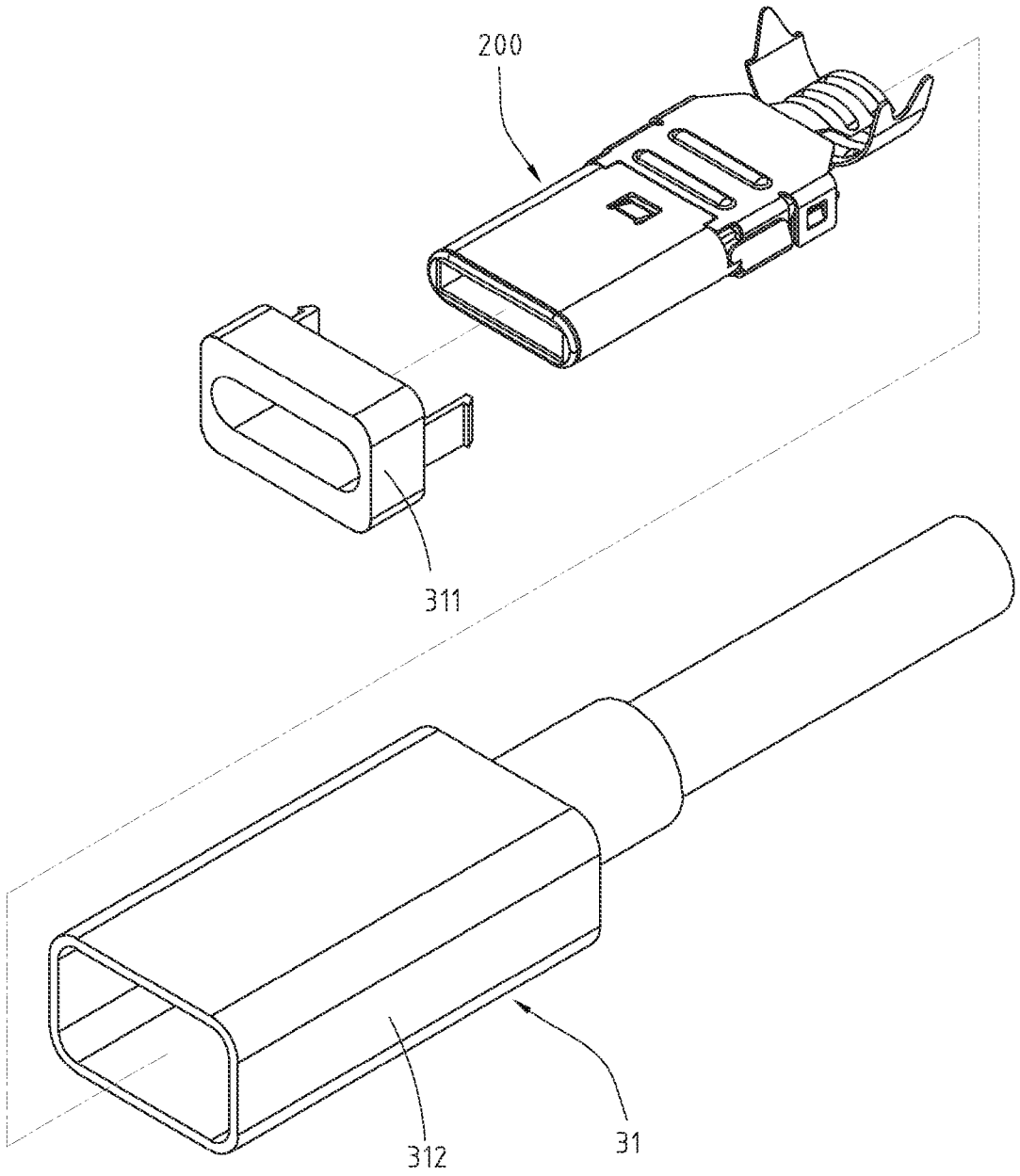
FIG. 36B is illustrates a partial exploded view of the electrical plug connector of the electrical connector assembly according to the instant disclosure, where the electrical plug connector is combined with a second insulation casing, for one variation.
Figure 38:
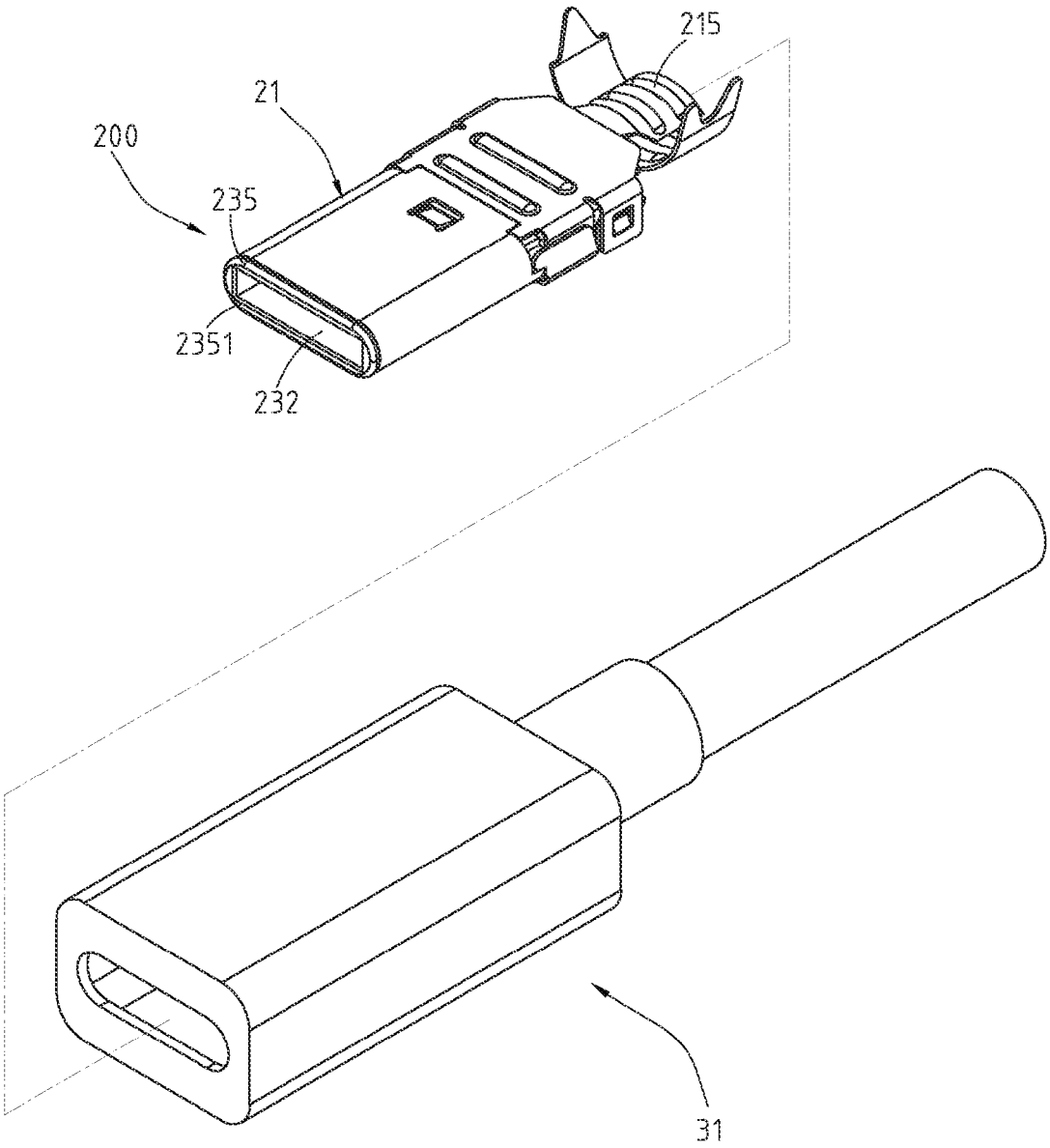
FIG. 38 illustrates a partial exploded view of the electrical plug connector of the electrical connector assembly according to the instant disclosure, where the electrical plug connector is provided with a frame portion.

In some embodiments, the second insulation casing 31 may be a unitary structure (as shown in FIG. 30 and FIG. 38) or a two-piece structure (as shown in FIG. 36A and FIG. 36B). Regarding the second insulation casing 31 being a two-piece structure, the second insulation casing 31 comprises a front cover 311 and a rear cover 312 (as shown in FIG. 36A and FIG. 36B). The front cover 311 and the rear cover 312 can be combined by means of gluing, buckling, or a combination of the foregoing two means. Alternatively, a further outer mould may be applied to enclose the front cover 311 and the rear cover 312 for the combination of the front cover 311 and the rear cover 312.

Please refer to FIG. 31. In some embodiments, the electrical plug connector 200 is further provided with a second grounding sheet 26 located within the second insulation housing 23. The second grounding sheet 26 comprises a second body portion 261 and a plurality of second pins 262. The second body portion 261 is located between the upper-row elastic terminals 24 and the lower-row elastic terminals 25 to separate the upper-row elastic terminals 24 from the lower-row elastic terminals 25. The second pins 262 are extending from the two sides of the second body portion 261, exposed out of the second insulation housing 23, and in contact with the second metal shell 21 or the circuit board 32. Accordingly, the crosstalk interference between the elastic terminals 24, 25 can be improved due to the second grounding sheet 26 during signal transmission. In other words, the second grounding sheet 26 could be a shielding sheet.

Please refer to FIG. 30 and FIG. 31. In some embodiments, the electrical plug connector 200 is further provided with a plurality of clamping structures 27 at the two sides of the second insulation housing 23. Each of the clamping structures 27 comprises a projecting hook portion 271 and a projecting contact portion 272. The projecting hook portions 271 are fixed at the two sides of the second insulation housing 23. The outer surface of each of the projecting hook portions 271 is in contact with the second metal shell 21. Here, each of the projecting hook portions 271 is provided with an inverse barbed bump 2711, a round bump 2712, and an elastic plate 2713, but embodiments are not limited thereto. In implementation, each of the projecting hook portions 271 may be provided with at least one of the inverse barbed bump 2711, the round bump 2712, and the elastic plate 2713. The projecting hook portions 271 are assembled to the second insulation housing 23. In addition, the projecting contact portions 272 are extending from the front portions of the projecting hook portions 271 and inserted into the two sides of the mating room 233. Accordingly, when the electrical plug connector 200 is plugged into the electrical receptacle connector 100, the hook structures 172 at the two sides of the electrical receptacle connector 100 can be in contact with the projecting contact portions 272. Therefore, the projecting engaging portions 271 are in contact with the second metal shell 21 to provide conduction and grounding.

Please refer to FIG. 40. In some embodiments, the second metal shell 21 is provided with a second tubular portion 214 extending from the front end of the plug opening 213. Here, the second tubular portion 214 may be formed by applying a suitable deep drawing technique to a conductive metal sheet to gradually deform the conductive metal sheet by repeated operations. When the electrical plug connector 200 is plugged into the electrical receptacle connector 100, the outer lateral surface of the second tubular portion 214 would be in contact with a plurality of conductive plates 174 (as shown in FIG. 23) of the electrical receptacle connector 100, so that the second tubular portion 214 and the second metal shell 21 are combined with each other for conduction and grounding. Accordingly, the EMI problem can be reduced.

Figure 43:
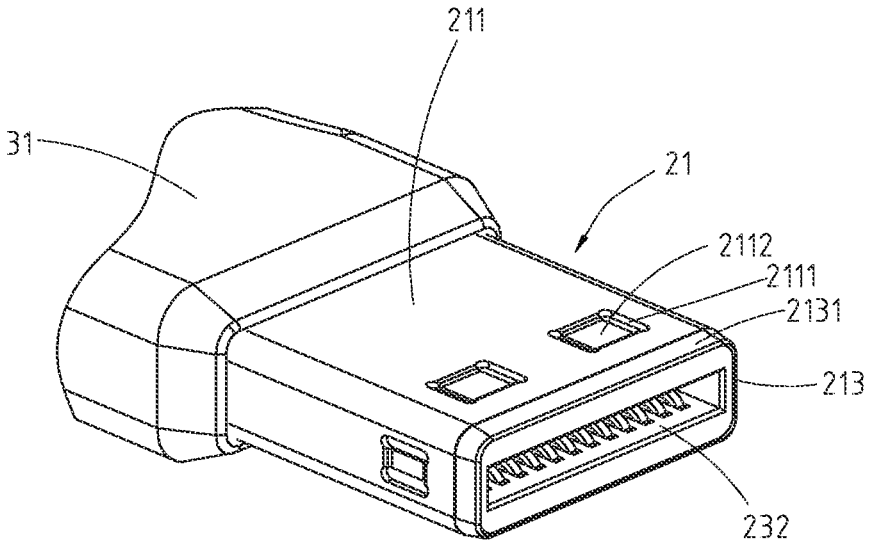
FIG. 43 illustrates a perspective view of the electrical plug connector of the electrical connector assembly provided with extension sheets, according to the instant disclosure.

Please refer to FIG. 43. In some embodiments, the second metal shell 21 is further provided with a second inclined guiding surface 2131 on the outer lateral surface of the plug opening 213. The second metal shell 21 can be provided with the second inclined guiding surface 2131 by applying a drawing or stamping technique. The second inclined guiding surface 2131 facilitates the connection between the electrical plug connector 200 and the electrical receptacle connector 100 when the electrical plug connector 200 is to be inserted into the electrical receptacle connector 100, but embodiments are not thus limited thereto. In some embodiments, the second insulation housing 23 is provided with a frame portion 235 (as shown in FIG. 39). The frame portion 235 is extending from the front end of the second insulation housing 23. In other words, the frame portion 235 is extending from the front portions of the upper member 231 and the lower member 232 to surround the periphery of the plug opening. The frame portion 235 is provided with a third inclined guiding surface 2351. When the electrical plug connector 200 is plugged into the electrical receptacle connector 100, the electrical receptacle connector 100 can be in contact with the third inclined guiding surface 2351 of the frame portion 235 to facilitate the connection between the electrical plug connector 200 and the electrical receptacle connector 100.

Please refer to FIG. 41 and FIG. 42. In some embodiments, the second metal shell 21 is further provided with a second main body 211 and a plurality of buckle holes 2111. The buckle holes 2111 are formed on the second main body 211 and adjacent to the plug opening 213. The second metal shell 21 can be provided with the buckle holes 2111 in a half-stamping or a stamping technique. When the electrical plug connector 200 is plugged into the electrical receptacle connector 100, the elastic springs 12 of the electrical receptacle connector 100 are buckled into the buckle holes 2111 (as shown in FIG. 20 and FIG. 24). In addition, the second metal shell 21 is further provided with a plurality of extension sheets 2112 (as shown in FIG. 43). Each of the extension sheets 2112 is connected between opposite inner walls of the corresponding buckle hole 2111. Accordingly, the elastic springs 12 of the electrical receptacle connector 100 provided by the instant disclosure are buckled onto the extension sheets 2112.

Please refer to FIG. 44. In some embodiments, the electrical plug connector 200 may be further combined with a clamping shell 29. The second metal shell 21 is provided with a rear-end clamping piece 215. The clamping shell 29 is combined with the rear-end clamping piece 215 to enclose the wires 33. Accordingly, the clamping shell 61 is combined with the second metal shell 21, where the clamping shell 29 may be a unitary structure or a multi-piece structure.

Figure 4:
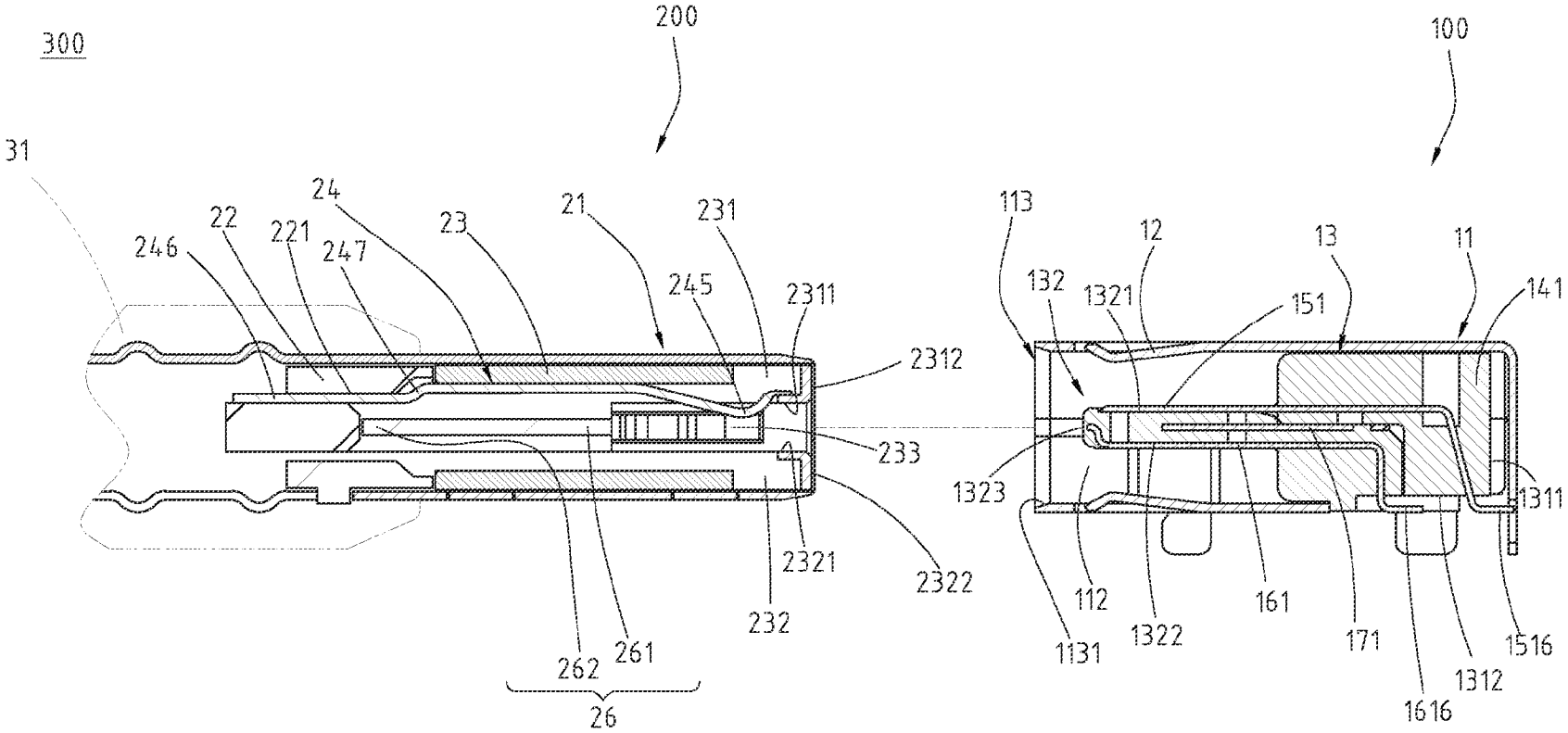
FIG. 4 illustrates a cross-sectional view of the electrical connector assembly according to the instant disclosure, where the electrical plug connector is devoid of lower-row elastic terminals.
Figure 5:
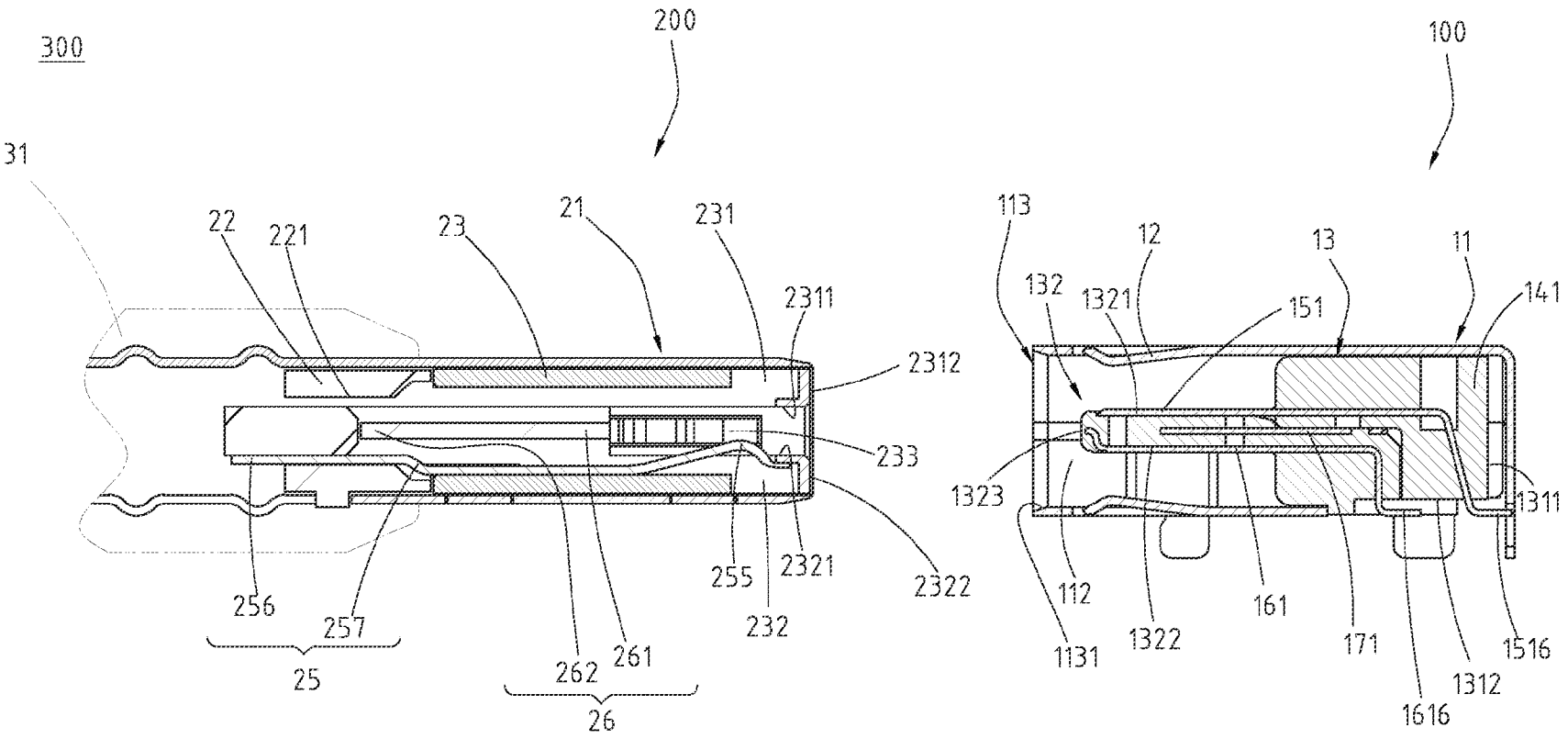
FIG. 5 illustrates a cross-sectional view of the electrical connector assembly according to the instant disclosure, where the electrical plug connector is devoid of upper-row elastic terminals.

Please refer to FIG. 4 and FIG. 5. In some embodiments, when the electrical receptacle connector 100 is provided with the upper-row plate terminals 151 and the lower-row plate terminals 161, the electrical plug connector may be devoid of the upper-row elastic terminals 24 or the lower-row elastic terminals 25. Regarding the upper-row elastic terminal 24 are omitted, when the electrical plug connector 200 is inserted into the electrical receptacle connector 100 with the first orientation or the second orientation, the lower-row elastic terminals 25 are in contact with the upper-row plate terminals 151 or the lower-row plate terminals 161 of the electrical receptacle connector. Conversely, regarding the lower-row elastic terminals 25 are omitted, when the electrical plug connector 200 is inserted into the electrical receptacle connector 100 with the first orientation or the second orientation, the upper-row elastic terminals 24 of the electrical plug connector are in contact with the upper-row plate terminals 151 or the lower-row plate terminals 161 of the electrical receptacle connector 100. Accordingly, the inserting orientation of the electrical plug connector 100 is not limited by the orientation of the electrical receptacle connector.

Figure 6:
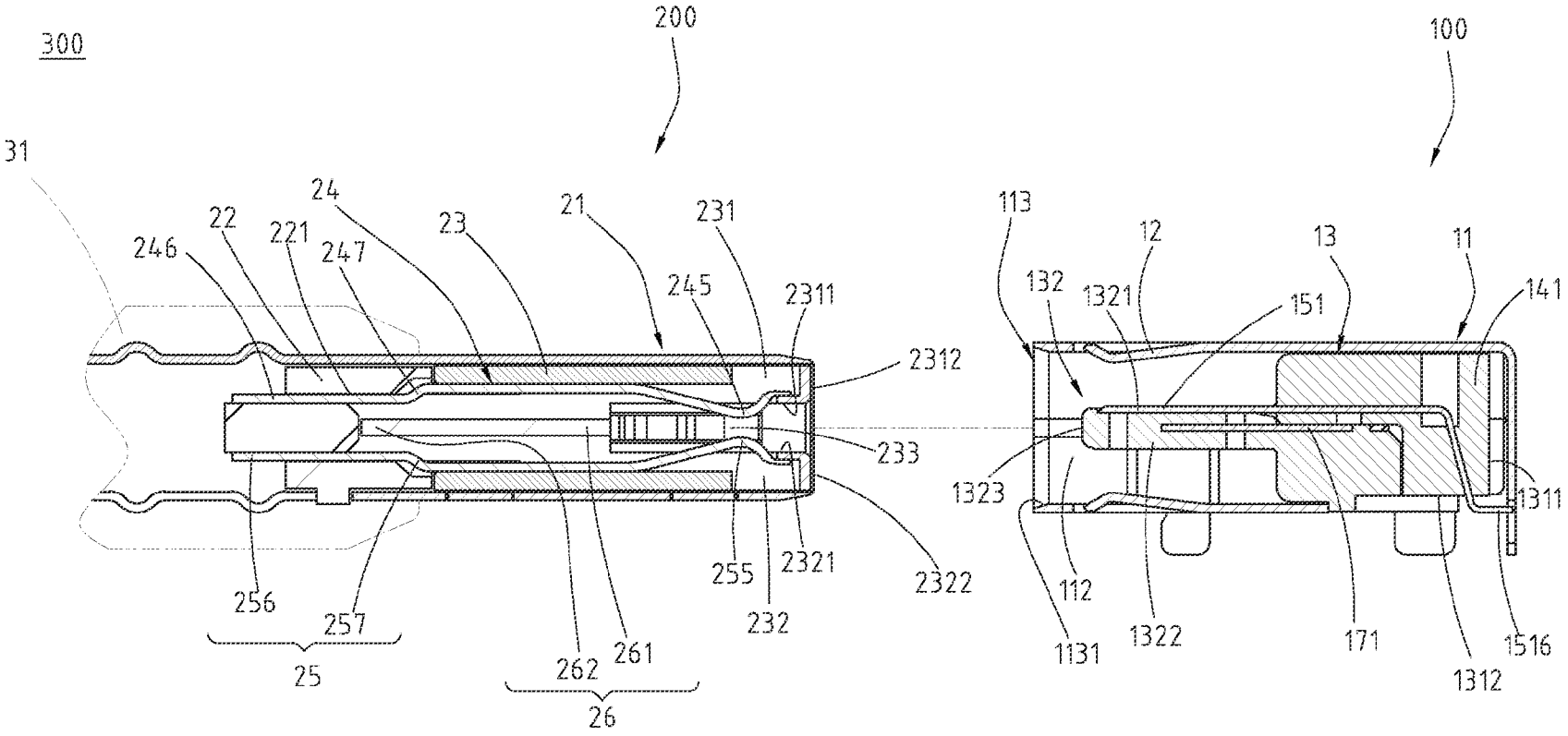
FIG. 6 illustrates a cross-sectional view of the electrical connector assembly according to the instant disclosure, where the electrical receptacle connector is devoid of lower-row plate terminals.
Figure 7:
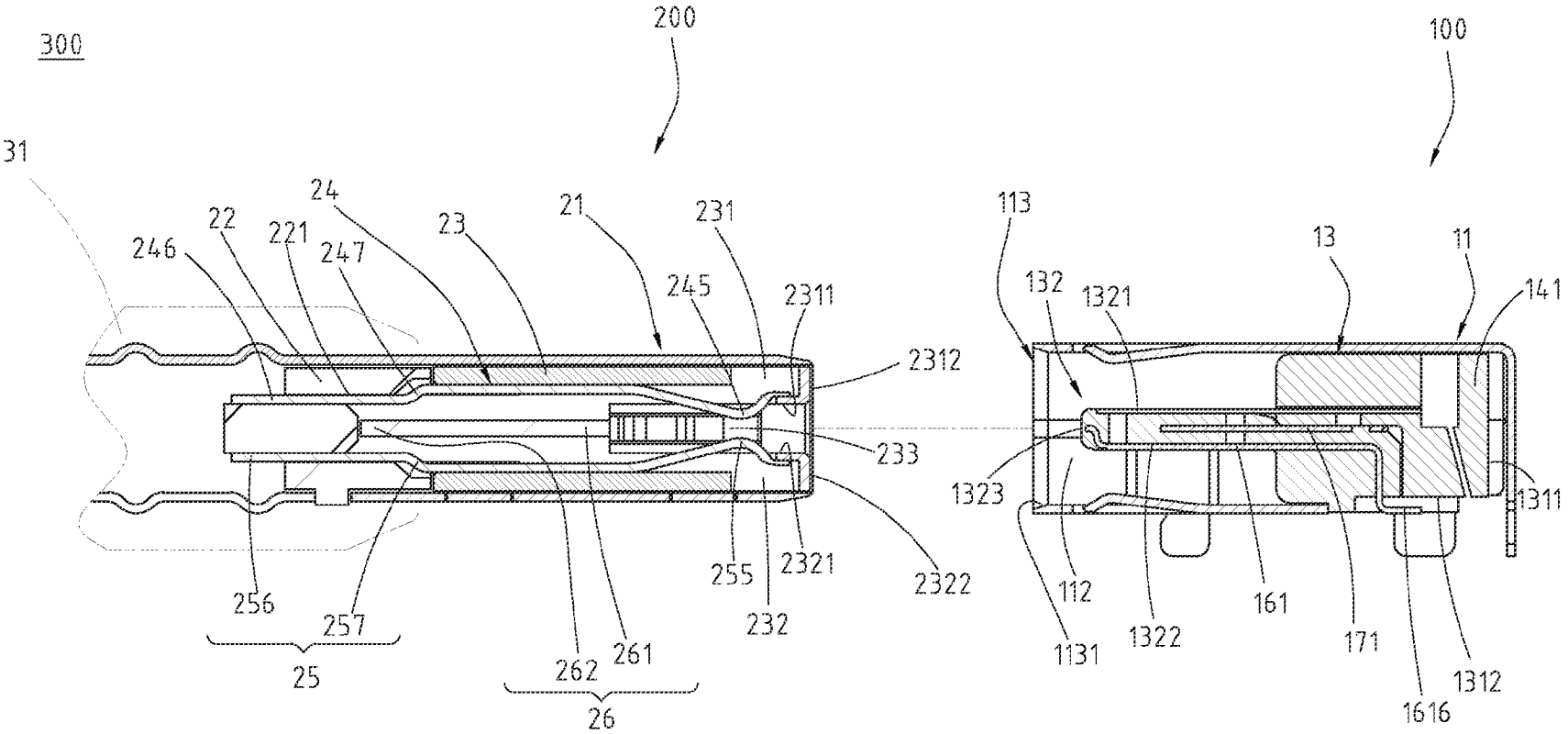
FIG. 7 illustrates a cross-sectional view of the electrical connector assembly according to the instant disclosure, where the electrical receptacle connector is devoid of upper-row plate terminals.

Please refer to FIG. 6 and FIG. 7, in some embodiments, when the electrical plug connector 200 is provided with the upper-row elastic terminals 24 and the lower-row elastic terminals 25, the electrical receptacle connector 100 may be devoid of the upper-row plate terminals 151 or the lower-row plate terminals 161. Regarding the upper-row plate terminals 151 are omitted, when the electrical plug connector 200 is plugged into the electrical receptacle connector 100 with the first orientation or the second orientation, the lower-row plate terminals 161 are in contact with the upper-row elastic terminals 24 or the lower-row elastic terminals 25 of the electrical plug connector 200. Conversely, regarding the lower-row plate terminals 161 are omitted, when the electrical plug connector 200 is plugged into the electrical receptacle connector 100 with the first orientation or the second orientation, the upper-row plate terminals 151 are in contact with the upper-row elastic terminals 24 or the lower-row elastic terminals 25 of the electrical plug connector 200. Accordingly, the inserting orientation of the electrical plug connector 200 is not limited by the orientation of the electrical receptacle connector 100.

In conclusion, since the upper-row plate terminals and the lower-row plate terminals are arranged upside down, and the pin assignment of the upper-row plate signal terminals is left-right reversal with respect to that of the lower-row plate signal terminals. Accordingly, when the electrical plug connector is inserted into the electrical receptacle connector by a first orientation where the upper plane of the electrical plug connector is facing up, the upper-row elastic terminals of the electrical plug connector are in contact with the upper-row plate signal terminals of the electrical receptacle connector. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals of the electrical receptacle connector. Consequently, the inserting orientation of the electrical plug connector is not limited when inserting into the electrical receptacle connector. Moreover, a plurality of hook structures is protruded at the two sides of the tongue portion. Therefore, when the electrical plug connector is inserted into the electrical receptacle connector, the elastic pins at two sides of the electrical plug connector would not wear against the two sides of the tongue portion. In addition, a first grounding sheet is configured to locate within the first insulation housing and between the upper-row plate contact segment and the lower-row plate contact segment, thus the crosstalk interference between the plate terminals can be improved by the first grounding sheet during signal transmission. Furthermore, the structural strength of the tongue portion can be further enhanced.

Additionally, since the upper-row elastic terminals and the lower-row elastic terminals are arranged upside down, and the pin assignment of the upper-row elastic signal terminals is left-right reversal with respect to that of the lower-row elastic signal terminals. When the electrical plug connector is inserted into an electrical receptacle connector by a first orientation where an upper plane of the electrical plug connector is facing up, the upper-row elastic terminals of the electrical plug connector are in contact with upper-row plate signal terminals of the electrical receptacle connector. Conversely, when the electrical plug connector is inserted into the electrical receptacle connector by a second orientation where the upper plane of the electrical plug connector is facing down, the upper-row elastic terminals of the electrical plug connector are in contact with lower-row plate signal terminals of the electrical receptacle connector. Consequently, the inserting orientation of the electrical plug connector is not limited when inserting into an electrical receptacle connector. Besides, a plurality of clamping structures are extending and inserted into two sides of the mating room to be in contact with buckle elastic springs located at two sides of an electrical receptacle connector. Therefore, the clamping structures are connected to the metal shell for conduction and grounding. Furthermore, a second grounding sheet is located within the second insulation housing and between the upper-row elastic terminals and the lower-row elastic terminals, thus the crosstalk interference between the elastic terminals can be improved by the second grounding sheet during signal transmission. In other words, the second grounding sheet could be a shielding sheet.

While the disclosure has been described by the way of example and in terms of the preferred embodiments, it is to be understood that the invention need not be limited to the disclosed embodiments. On the contrary, it is intended to cover various modifications and similar arrangements comprised within the spirit and scope of the appended claims, the scope of which should be accorded the broadest interpretation so as to encompass all such modifications and similar structures.

What is claimed is:

1. An electrical connector assembly, comprising:

an electrical receptacle connector, comprising:

a first metal shell defining a receptacle cavity therein;

a first insulation housing received in the receptacle cavity, wherein the first insulation housing comprises a first base portion and a tongue portion extending from one side of the first base portion, the tongue portion comprises a first upper surface and a first lower surface;

a plurality of upper-row plate terminals held on the first base portion and the tongue portion, wherein the upper-row plate terminals comprises a plurality of upper-row plate signal terminals, at least one upper-row plate power terminal, and at least one upper-row plate ground terminal, wherein the upper-row plate terminals are on the first upper surface for transmitting first signals;

a plurality of lower-row plate terminals held on the first base portion and the tongue portion, wherein the lower-row plate terminals comprises a plurality of lower-row plate signal terminals, at least one lower-row plate power terminal, and at least one lower-row plate ground terminal, wherein the lower-row plate terminals are on the first lower surface for transmitting second signals, wherein the specification for transmitting the first signals is conformed to the specification for transmitting the second signals, a pin assignment of the upper-row plate terminals and the lower-row plate terminals is point-symmetrical with a central point of the receptacle cavity as the symmetrical center; and a first grounding sheet located within the first insulation housing and between the upper-row plate terminals and the lower-row plate terminals, wherein two lateral sides of the first grounding sheet are exposed on two lateral sides of the first insulation housing; and an electrical plug connector, adapted to be plugged into the electrical receptacle connector, the electrical plug connector comprising:

a second metal shell defining a receiving cavity therein;

a second insulation housing received in the receiving cavity, wherein the second insulation housing comprises a second base portion, an upper member, a lower member, and a mating room, wherein the upper member and the lower member are extending from one side of the second base portion, and the mating room is between the upper member and the lower member;

a plurality of upper-row elastic terminals held on the second insulation housing, wherein the upper-row elastic terminals comprise a plurality of upper-row elastic signal terminals, at least one upper-row elastic power terminal, and at least one upper-row elastic ground terminal, wherein the upper-row elastic terminals are on a second lower surface of the upper member for transmitting the first signals; and a plurality of lower-row elastic terminals held on the second insulation housing, wherein the lower-row elastic terminals comprise a plurality of lower-row elastic signal terminals, at least one lower-row elastic power terminal, and at least one lower-row elastic ground terminal, wherein the lower-row elastic terminals are on a second upper surface of the lower member for transmitting the second signals, wherein the specification for transmitting the first signals is conformed to the specification for transmitting the second signals, a pin assignment of the upper-row elastic terminals and the lower-row elastic terminals is point-symmetrical with a central point of the receiving cavity as the symmetrical center and a plurality of clamping structures, wherein the clamping structures are located at two sides of the second insulation housing and each clamping structure comprise a projecting contact portion, the projecting contact portions are projected into the two sides of the mating room, and the projecting contact portions are in contact with the two lateral sides of the first grounding sheet when the electrical plug connector is plugged into the electrical receptacle connector.

2. The electrical connector assembly according to claim 1, wherein the distance between the upper-row plate power terminal and a front lateral surface of the tongue portion is less than or equal to the distance between each of the upper-row plate signal terminals and the front lateral surface of the tongue portion.

3. The electrical connector assembly according to claim 2, wherein the distance between the upper-row plate ground terminal and the front lateral surface of the tongue portion is less than or equal to the distance between each of the upper-row plate signal terminals and the front lateral surface of the tongue portion.

4. The electrical connector assembly according to claim 2, wherein the width of the upper-row plate power terminal is greater than or equal to the width of each of the upper-row plate signal terminals.

5. The electrical connector assembly according to claim 1, wherein the distance between the lower-row plate power terminal and a front lateral surface of the tongue portion is less than or equal to the distance between each of the lower-row plate signal terminals and the front lateral surface of the tongue portion.

6. The electrical connector assembly according to claim 5, wherein the distance between the lower-row plate ground terminal and the front lateral surface of the tongue portion is less than or equal to the distance between each of the lower-row plate signal terminals and the front lateral surface of the tongue portion.

7. The electrical connector assembly according to claim 5, wherein the width of the lower-row plate power terminal is greater than or equal to the width of each of the lower-row plate signal terminals.

8. The electrical connector assembly according to claim 1, wherein the first insulation housing comprises a first mount, wherein the upper-row plate terminals are combined with the first mount, the first mount is combined with the first base portion.

9. The electrical connector assembly according to claim 1, wherein the first insulation housing comprises a second mount and a third mount, wherein the upper-row plate terminals are combined with the second mount, the second mount is combined to a top surface of the first base portion, the lower-row plate terminals are combined with the third mount, the third mount is combined to a bottom surface of the first base portion.

10. The electrical connector assembly according to claim 1, wherein the first grounding sheet comprises a first body portion and a plurality of first pins, the first body portion is located between the upper-row plate terminals and the lower-row plate terminals, and the first pins are extending from a rear part of the first grounding sheet and exposed out of the first base portion.

11. The electrical connector assembly according to claim 10, wherein the first grounding sheet further comprises a plurality of hook structures, wherein the hook structures are located at two lateral sides of the first insulation housing and each hook structure comprises a projecting engaging portion and a projecting abutting portion, the projecting engaging portions are extending from two sides of the front part of the first body portion and protruded from two sides of the tongue portion, the projecting abutting portions are extending from two sides of the rear part of the first body portion and protruded from two sides of the first base portion, and the projecting abutting portions are in contact with the first metal shell.

12. The electrical connector assembly according to claim 1, wherein the first metal shell defines an insertion opening therein, wherein the insertion opening is in the shape of oblong or rectangular.

13. The electrical connector assembly according to claim 12, wherein the insertion opening comprises a first inclined guiding surface.

14. The electrical connector assembly according to claim 1, wherein the first metal shell comprises a rear cover portion covering the rear part of the receptacle cavity.

15. The electrical connector assembly according to claim 1, wherein the first metal shell comprises an elastic spring and a crack, wherein the elastic spring is extending from the inner wall of the crack, the elastic spring comprises a bent contact portion extending toward the receptacle cavity.

16. The electrical connector assembly according to claim 1, further comprising a covering shell covering the first metal shell.

17. The electrical connector assembly according to claim 1, wherein the first metal shell comprises a first tubular portion, a reversely-folded grounding piece, and a bent segment, the bent segment is arranged at the rear part of the first tubular portion, the reversely-folded grounding piece is arranged at the side portion of the first tubular portion, one of two ends of the bent segment is extending from the first tubular portion, and the other end of the bent segment is extending toward the reversely-folded grounding piece.

18. The electrical connector assembly according to claim 1, wherein the electrical receptacle connector further comprises a first insulation casing for surrounding four sides of the first metal shell.

19. The electrical connector assembly according to claim 18, wherein the electrical receptacle connector further comprises a waterproof gasket, wherein the first insulation casing comprises a recessed portion and the waterproof gasket is fitted over the recessed portion.

20. The electrical connector assembly according to claim 18, wherein the electrical receptacle connector further comprises a waterproof cover at the rear part of the first insulation casing to cover the rear part of the first insulation casing.

21. The electrical connector assembly according to claim 18, wherein the electrical receptacle connector further comprises a sealing material at the rear part of the first insulation casing to cover the rear part of the first insulation casing.

22. The electrical connector assembly according to claim 20, wherein the electrical receptacle connector further comprises a sealing material at the rear part of the first insulation casing to cover the rear part of the first insulation casing.

23. The electrical connector assembly according to claim 1, wherein the electrical receptacle connector further comprises a waterproof gasket in the first metal shell to abut against between the exterior of first base portion and interior of the first metal shell.

24. The electrical connector assembly according to claim 1, wherein each of the upper-row plate terminals comprises an upper-row plate contact segment, an upper-row plate connecting segment, and an upper-row plate soldering segment, wherein the upper-row plate connecting segment is at the first base portion and the tongue portion, the upper-row plate contact segment is extending from one of two ends of the upper-row plate connecting segment and on the first upper surface, and the upper-row plate soldering segment is extending from the other end of the upper-row plate connecting segment and protruded out of the first base portion, wherein each of the lower-row plate terminals comprises a lower-row plate contact segment, a lower-row plate connecting segment, and a lower-row plate soldering segment, wherein the lower-row plate connecting segment is at the first base portion and the tongue portion, the lower-row plate contact segment is extending from one of two ends of the lower-row plate connecting segment and on the first lower surface, and the lower-row plate soldering segment is extending from the other end of the lower-row plate connecting segment and protruded out of the first base portion.

25. The electrical connector assembly according to claim 24, wherein the electrical receptacle connector further comprises a first rear terminal organizer fixed at the rear part of the first insulation housing, wherein the first rear terminal organizer comprises a plurality of first through grooves, and the upper-row plate soldering segments and the lower-row plate soldering segments are held in the first through grooves.

26. The electrical connector assembly according to claim 1, wherein the position of the upper-row plate terminals corresponds to the position of the lower-row plate terminals.

27. The electrical connector assembly according to claim 1, wherein the upper-row plate terminals are aligned parallel to the lower-row plate terminals, and the position of the upper-row plate terminals is offset with respect to the position of the lower-row plate terminals.

28. The electrical connector assembly according to claim 1, wherein the distance between the upper-row elastic power terminal and an upper front lateral surface of the upper member is less than or equal to the distance between each of the upper-row elastic signal terminals and the upper front lateral surface of the upper member.

29. The electrical connector assembly according to claim 1, wherein the distance between the upper-row elastic ground terminal and an upper front lateral surface of the upper member is less than or equal to the distance between each of the upper-row elastic signal terminals and the upper front lateral surface of the upper member.

30. The electrical connector assembly according to claim 1, wherein the width of the upper-row elastic power terminal is greater than or equal to the width of each of the upper-row elastic signal terminals.

31. The electrical connector assembly according to claim 1, wherein each of the upper-row elastic terminals comprises an upper-row elastic contact segment, an upper-row elastic connecting segment, and an upper-row elastic soldering segment, wherein the upper-row elastic connecting segment is at the upper member, the upper-row elastic contact segment is extending from one of two ends of the upper-row elastic connecting segment and on the second lower surface of the upper member, and the upper-row elastic soldering segment is extending from the other end of the upper-row elastic connecting segment and protruded out of the second insulation housing, wherein each of the lower-row elastic terminals comprises a lower-row elastic contact segment, a lower-row elastic connecting segment, and a lower-row elastic soldering segment, wherein the lower-row elastic connecting segment is at the lower member, the lower-row elastic contact segment is extending from one of two ends of the lower-row elastic connecting segment and on the second upper surface of the lower member, and the lower-row elastic soldering segment is extending from the other end of the lower-row elastic connecting segment and protruded out of the second insulation housing.

32. The electrical connector assembly according to claim 1, wherein the position of the upper-row elastic terminals corresponds to the position of the lower-row elastic terminals.

33. The electrical connector assembly according to claim 1, wherein the upper-row elastic terminals are aligned parallel to the lower-row elastic terminals, and the position of the upper-row elastic terminals is offset with respect to the position of the lower-row elastic terminals.

34. The electrical connector assembly according to claim 31, wherein each of the upper-row elastic terminals comprises an upper-row elastic bending segment extending between the upper-row elastic connecting segment and the upper-row elastic soldering segment, and the upper-row elastic bending segment is provided for adjusting the distance between the upper-row elastic soldering segment and the lower-row elastic soldering segment.

35. The electrical connector assembly according to claim 31, wherein each of the lower-row elastic terminals comprises a lower-row elastic bending segment extending between the lower-row elastic connecting segment and the lower-row elastic soldering segment, and the lower-row elastic bending segment is provided for adjusting the distance between the lower-row elastic soldering segment and the upper-row elastic soldering segment.

36. The electrical plug connector assembly according to claim 31, wherein the electrical plug connector further comprises a second rear terminal organizer, wherein the second rear terminal organizer is fixed at the rear part of the second insulation housing and comprises a plurality of second through grooves, and the upper-row plate soldering segments and the lower-row plate soldering segments are held in the second through grooves.

37. The electrical connector assembly according to claim 30, wherein the electrical plug connector further comprises a circuit board, wherein the circuit board is fixed at the rear part of the second insulation housing, a plurality of upper-surface contacts is located on one of two surfaces of the circuit board to be connected to the upper-row elastic soldering segments, and a plurality of lower-surface contacts is located on the other surface of the circuit board to be connected to the lower-row elastic soldering segments.

38. The electrical connector assembly according to claim 37, wherein the second metal shell comprises a plurality of fixing grooves, wherein two sides of the circuit board are held in the fixing grooves, and the two sides of the circuit board are protruded outside the second metal shell.

39. The electrical connector assembly according to claim 37, wherein the electrical plug connector further comprises a plurality of wires located on the second rear terminal organizer to be connected to the upper-row elastic soldering segments and the lower-row elastic soldering segments.

40. The electrical connector assembly according to claim 39, wherein the electrical plug connector further comprises a fixing plate, wherein the circumferences of the wires are fixed to the fixing plate.

41. The electrical connector assembly according to claim 39, wherein the electrical plug connector further comprises a cover piece covering the wires, the upper-row elastic soldering segment, and the lower-row elastic soldering segments.

42. The electrical connector assembly according to claim 38, wherein the electrical plug connector further comprises a plurality of wires located on the second rear terminal organizer or the circuit board to be connected to the upper-row elastic soldering segments and the lower-row elastic soldering segments.

43. The electrical connector assembly according to claim 42, wherein the electrical plug connector further comprises a fixing plate, wherein the circumferences of the wires are fixed to the fixing plate.

44. The electrical connector assembly according to claim 42, wherein the electrical plug connector further comprises a ground plate to be connected to the wires and the circuit board.

45. The electrical connector assembly according to claim 42, wherein the electrical plug connector further comprises a cover piece covering the wires, the upper-row elastic soldering segment, and the lower-row elastic soldering segments.

46. The electrical connector assembly according to claim 1, wherein the electrical plug connector further comprises a second insulation casing covering the rear part of the second metal shell.

47. The electrical connector assembly according to claim 1, wherein the distance between the lower-row elastic power terminal and a lower front lateral surface of the lower member is less than or equal to the distance between each of the lower-row elastic signal terminals and the lower front lateral surface of the lower member.

48. The electrical connector assembly according to claim 47, wherein the distance between the lower-row elastic ground terminal and the lower front lateral surface of the lower member is less than or equal to the distance between each of the lower-row elastic signal terminals and the lower front lateral surface of the lower member.

49. The electrical connector assembly according to claim 47, wherein the width of the lower-row elastic power terminal is greater than or equal to the width of each of the lower-row elastic signal terminals.

50. The electrical connector assembly according to claim 1, wherein the electrical plug connector further comprises a second grounding sheet, wherein the second grounding sheet is located within the second insulation housing and comprises a second body portion and a plurality of second pins, wherein the second body portion is located between the upper-row elastic terminals and the lower-row elastic terminals, and the second pins are extending from two sides of the second body portion and exposed out of the second insulation housing.

51. The electrical connector assembly according to claim 1, wherein each of the clamping structures comprises a projecting hook portion, the projecting contact portion is extending from the front portions of the projecting hook portion and the projecting hook portions are fixed at the two sides of the second insulation housing.

52. The electrical connector assembly according to claim 1, wherein the second metal shell defines a plug opening therein, wherein the plug opening is in the shape of oblong or rectangular.

53. The electrical connector assembly according to claim 52, wherein the plug opening comprises a second inclined guiding surface.

54. The electrical connector assembly according to claim 52, wherein the second metal shell comprises a second tubular portion extending from the front end of the plug opening.

55. The electrical connector assembly according to claim 52, wherein the second insulation housing comprises a frame portion extending from the front end of the plug opening to surround the periphery of the plug opening.

56. The electrical connector assembly according to claim 55, wherein the frame portion comprises a second inclined guiding surface.

57. The electrical connector assembly according to claim 1, wherein the second metal shell comprises a second main body and a plurality of buckle holes formed on the surface of the second main body.

58. The electrical connector assembly according to claim 57, wherein the second metal shell comprises a plurality of extension sheets, each of the extension sheets is connected between opposite inner walls of the corresponding buckle hole.

59. The electrical connector assembly according to claim 1, wherein the electrical plug connector further comprises a clamping shell, the second metal shell comprises a rear-end clamping piece, and the clamping shell is combined with the rear-end clamping piece.

60. The electrical connector assembly according to claim 1, wherein the electrical receptacle connector is devoid of the upper-row plate terminals or the lower-row plate terminals, and wherein when the electrical plug connector is inserted into the receptacle connector, the upper-row elastic terminals and the lower-row elastic terminals of the electrical plug connector are in contact with the upper-row plate terminals or the lower-row plate terminals of the electrical receptacle connector.

61. The electrical connector assembly according to claim 1, wherein the electrical plug connector is devoid of the upper-row elastic terminals or the lower-row elastic terminals, and wherein when the electrical plug connector is inserted into the receptacle connector, the upper-row plate terminals and the lower-row plate terminals of the electrical receptacle connector are in contact with the upper-row elastic terminals or the lower-row elastic terminals of the electrical plug connector.

62. An electrical connector assembly, comprising:

an electrical receptacle connector, comprising:

a first metal shell defining a receptacle cavity therein;

a first insulation housing received in the receptacle cavity, wherein the first insulation housing comprises a first base portion and a tongue portion extending from one side of the first base portion, the tongue portion comprises a first upper surface and a first lower surface;

a plurality of upper-row plate terminals held on the first base portion and the tongue portion, wherein the upper-row plate terminals comprises a plurality of upper-row plate signal terminals, at least one upper-row plate power terminal, and at least one upper-row plate ground terminal, wherein the upper-row plate terminals are on the first upper surface for transmitting first signals;

a plurality of lower-row plate terminals held on the first base portion and the tongue portion, wherein the lower-row plate terminals comprises a plurality of lower-row plate signal terminals, at least one lower-row plate power terminal, and at least one lower-row plate ground terminal, wherein the lower-row plate terminals are on the first lower surface for transmitting second signals, wherein the specification for transmitting the first signals is conformed to the specification for transmitting the second signals, a pin assignment of the upper-row plate terminals and the lower-row plate terminals is point-symmetrical with a central point of the receptacle cavity as the symmetrical center; and a plurality of conductive plates respectively at the top portion and the bottom portion of the first base portion to be in contact with the first metal shell; and an electrical plug connector, adapted to be plugged into the electrical receptacle connector, the electrical plug connector comprising:

a second metal shell defining a plug opening and a receiving cavity therein, and the second metal shell comprising a second tubular portion extending from the front end of the plug opening, wherein the outer lateral surface of the second tubular portion is in contact with the plurality of conductive plates;

a second insulation housing received in the receiving cavity, wherein the second insulation housing comprises a second base portion, an upper member, a lower member, and a mating room, wherein the upper member and the lower member are extending from one side of the second base portion, and the mating room is between the upper member and the lower member;

a plurality of upper-row elastic terminals held on the second insulation housing, wherein the upper-row elastic terminals comprise a plurality of upper-row elastic signal terminals, at least one upper-row elastic power terminal, and at least one upper-row elastic ground terminal, wherein the upper-row elastic terminals are on a second lower surface of the upper member for transmitting the first signals; and a plurality of lower-row elastic terminals held on the second insulation housing, wherein the lower-row elastic terminals comprise a plurality of lower-row elastic signal terminals, at least one lower-row elastic power terminal, and at least one lower-row elastic ground terminal, wherein the lower-row elastic terminals are on a second upper surface of the lower member for transmitting the second signals, wherein the specification for transmitting the first signals is conformed to the specification for transmitting the second signals, a pin assignment of the upper-row elastic terminals and the lower-row elastic terminals is point-symmetrical with a central point of the receiving cavity as the symmetrical center.

63. The electrical connector assembly according to claim 62, wherein each of the conductive plates comprises a shaft, a drive portion, and a driven portion, the shaft is pivotally received in a corresponding recessed portion of the on the top surface or the bottom surface of the first base portion, the drive portion is extending slantingly toward the tongue portion from one of two sides of the shaft, and the driven portion is extending from the other side of the shaft and movably in contact with an inner wall of the first metal shell.

* * * * *